US011679336B2

(12) United States Patent
Kim et al.

(10) Patent No.: US 11,679,336 B2
(45) Date of Patent: Jun. 20, 2023

(54) TOY SET

(71) Applicant: DAEWON MEDIA CO., LTD., Seoul (KR)

(72) Inventors: Sun Il Kim, Gyeonggi-do (KR); Isao Kokubun, Tokyo (JP)

(73) Assignee: DAEWON MEDIA CO., LTD., Seoul (KR)

( * ) Notice: Subject to any disclaimer, the term of this patent is extended or adjusted under 35 U.S.C. 154(b) by 247 days.

(21) Appl. No.: 17/142,713

(22) Filed: Jan. 6, 2021

(65) Prior Publication Data

US 2021/0205725 A1 Jul. 8, 2021

(30) Foreign Application Priority Data

Jan. 8, 2020 (KR) ..... 10-2020-0002733

(51) Int. Cl.

| | |
|---|---|
| ***A63H 33/00*** | (2006.01) |
| ***A63H 17/25*** | (2006.01) |
| ***A63H 17/26*** | (2006.01) |

(52) U.S. Cl.

CPC ..... *A63H 33/003* (2013.01); *A63H 17/25* (2013.01); *A63H 17/26* (2013.01)

(58) Field of Classification Search

CPC ..... A63H 3/003; A63H 17/25; A63H 17/26

USPC ..... 446/69, 72, 376, 487

See application file for complete search history.

(56) References Cited

U.S. PATENT DOCUMENTS

| | | | | |
|---|---|---|---|---|
| 4,599,078 | A | 7/1986 | Obara | |
| 6,505,098 | B1 | 1/2003 | Sakamoto et al. | |
| 7,568,965 | B2 | 8/2009 | Toriyama et al. | |
| 7,662,016 | B2 * | 2/2010 | Okamoto ..... | A63H 11/00 446/376 |

(Continued)

FOREIGN PATENT DOCUMENTS

| | | | |
|---|---|---|---|
| CN | 1909948 | A | 2/2007 |
| CN | 102500109 | A | 6/2012 |

(Continued)

OTHER PUBLICATIONS

Office Action issued in Chinese Patent Application No. 202110019403.0 dated Apr. 26, 2022.

(Continued)

*Primary Examiner* — Joseph B Baldori

(74) *Attorney, Agent, or Firm* — Marshall, Gerstein & Borun LLP

(57) ABSTRACT

A transformable toy transformable so as to be coupled to a model toy and a toy set including the model toy and the transformable toy are provided. The transformable toy includes a transformable body that is transformable into a first state of being independent from the model toy and a second state of partially covering the model toy and being releasably coupled to the model toy. The transformable body incudes a frame portion and a transformation portion. The frame portion partially covers the model toy in the second state of the transformable body. The transformation portion is coupled to the frame portion so as to be rotatable about a corresponding rotation axis. The transformation portion is rotated about the corresponding rotation axis with respect to the frame portion for transformation of the transformable body from one of the first and second states to the other.

13 Claims, 54 Drawing Sheets

(56) References Cited

U.S. PATENT DOCUMENTS

| | | | | |
|---|---|---|---|---|
| 7,722,426 | B2 * | 5/2010 | Campbell | A63H 33/003 446/4 |
| 7,722,429 | B2 * | 5/2010 | Campbell | A63H 17/00 446/376 |
| 8,337,271 | B2 * | 12/2012 | Campbell | A63H 33/003 446/376 |
| 8,784,153 | B2 | 7/2014 | Sugimoto et al. | |
| 9,370,725 | B2 * | 6/2016 | Choi | A63F 1/04 |
| 9,415,322 | B2 * | 8/2016 | Kanauchi | A63H 33/003 |
| 9,573,072 | B2 * | 2/2017 | Cai | A63H 17/004 |
| 10,307,684 | B2 * | 6/2019 | Choi | A63H 17/02 |
| 10,773,177 | B2 * | 9/2020 | Ishida | A63H 3/04 |
| 2012/0142247 | A1 | 6/2012 | Hara et al. | |
| 2015/0035257 | A1 | 2/2015 | Zaid et al. | |
| 2015/0196850 | A1 * | 7/2015 | Kobayashi | A63H 33/003 446/376 |
| 2015/0352457 | A1 | 12/2015 | Kanauchi | |
| 2018/0133612 | A1 | 5/2018 | Choi | |
| 2021/0205724 | A1 * | 7/2021 | Kim | A63H 3/52 |
| 2021/0205725 | A1 * | 7/2021 | Kim | A63H 3/50 |

FOREIGN PATENT DOCUMENTS

| | | | |
|---|---|---|---|
| CN | 106457053 | A | 2/2017 |
| JP | 2005-224253 | A | 8/2005 |
| JP | 2010-131367 | A | 6/2010 |
| JP | 3192453 | U | 8/2014 |
| JP | 2018-514334 | A | 6/2018 |
| KR | 101880988 | B1 | 7/2018 |

OTHER PUBLICATIONS

Office Action issued in Japanese Patent Application No. 2021-002041 dated Nov. 30, 2021.

* cited by examiner

TOY SET

CROSS-REFERENCE TO RELATED APPLICATION

This application claims the benefit of Korean Patent Application No. 10-2020-0002733, filed on Jan. 8, 2020, in the Korean Intellectual Property Office, the disclosure of which is incorporated herein in its entirety by reference.

TECHNICAL FIELD

The present disclosure relates to a transformable toy whose form is transformable, and to a toy set including such a transformable toy.

BACKGROUND

A transformable toy whose form can be transformed is known in the art. Such a transformable toy may be composed of a plurality of manipulatable members. As a user manipulates a plurality of members of a conventional transformable toy, the transformable toy can be transformed from one form to another form. For example, a transformable robot toy is known as a conventional transformable toy. However, the conventional transformable toy has a limitation in that the convention transformable toy is configured so as to change its shape under restriction of only the transformation of the transformable toy itself.

SUMMARY

Embodiments of the present disclosure provide a user with an opportunity of differentiated and creative experiences through a novel transformation form which is different from a limited transformation form of a conventional transformable toy itself. Embodiments of the present disclosure provide a transformable toy which is not only transformable in itself, but also can give a user a variety of fun through the combination of the transformable toy with a model toy.

One aspect of the embodiments disclosed herein relates to a transformable toy which is transformable in itself and can be combined with a model toy. A transformable toy according to one embodiment includes a transformable body. The transformable body is configured to be transformable into a first state where the transformable body is independent from a model toy and a second state where the transformable body partially covers the model toy and is releasably coupled to the model toy. The transformable body includes a frame portion and at least one transformation portion. The frame portion is configured to partially cover a portion of the model toy in the second state of the transformable body. The at least one transformation portion is coupled to the frame portion so as to be rotatable about a corresponding rotation axis. The at least one transformation portion is configured to be rotated about the corresponding rotation axis with respect to the frame portion for transformation of the transformable body from one of the first state and the second state to the other of the first state and the second state.

In one embodiment, the at least one transformation portion includes two or more transformation portions configured to be rotated in two or more different directions with respect to the frame portion for transformation of the transformable body from one of the first state and the second state to the other of the first state and the second state.

In one embodiment, the at least one transformation portion is configured to be folded with respect to the frame portion by being rotated about the corresponding rotation axis for transformation of the transformable body from the second state to the first state.

In one embodiment, the at least one transformation portion includes at least one covering transformation portion configured to partially cover a portion of the model toy in the second state of the transformable body.

In one embodiment, the at least one transformation portion includes: a first transformation portion coupled to the frame portion so as to be rotatable about a first rotation axis passing through a portion of the frame portion in a first direction; and a second transformation portion coupled to the frame portion so as to be rotatable about a second rotation axis passing through a portion of the frame portion in a second direction opposite to the first direction.

In one embodiment, the first transformation portion may be configured to cover a portion of the model toy in the first direction in the second state, and the second transformation portion may be configured to cover another portion of the model toy in the second direction in the second state.

In one embodiment, the first transformation portion and the second transformation portion may be configured to be moved and rotated toward each other for transformation from one of the first state and the second state to the other of the first state and the second state.

In one embodiment, the at least one transformation portion further includes a third transformation portion coupled to the frame portion so as to be rotatable about a third rotation axis passing through a portion of the frame portion in a third direction orthogonal to the first direction and the second direction.

In one embodiment, the third transformation portion may be configured to cover another portion of the model toy that extends in the third direction from the portion of the model toy covered by the frame portion in the second state.

In one embodiment, the frame portion, the first transformation portion, and the second transformation portion may be configured to accommodate the third transformation portion in the first state.

In one embodiment, each of the first transformation portion and the second transformation portion may include an engaging portion that protrudes so as to restrain rotation of the third transformation portion in the first state of the transformable body.

In one embodiment, the third transformation portion may include: a link portion rotatably coupled to the frame portion; and a distal end portion rotatably or detachably coupled to the link portion and having a shape partially corresponding to an appearance of the model toy.

In one embodiment, the at least one transformation portion further includes a fourth transformation portion coupled to the frame portion so as to be rotatable about a fourth rotation axis passing through a portion of the frame portion in a fourth direction opposite to the third direction.

In one embodiment, the at least one transformation portion may include: a support portion in which the corresponding rotation axis is disposed; and a rotation portion rotatably coupled to the support portion. The support portion may be configured to cover a portion of the model toy corresponding to the support portion in the second state of the transformable body. The rotation portion may be configured to cover another portion of the model toy that extends from the portion of the model toy corresponding to the support portion in the second state.

In one embodiment, the transformable body may further include an accessory body which is removably coupled to a first position of the transformable body in the first state and is releasably coupled to a second position of the transformable body different from the first position or a predetermined position of the model toy in the second state.

Another aspect of the embodiments disclosed herein relates to a toy set. The toy set according to one embodiment includes a model toy and the transformable toy according to the aforementioned one embodiment. In one embodiment, the model toy of the toy set has a form corresponding to a shape of a dinosaur. In one embodiment, the transformable toy of the toy set has a form of a transport machine in the first state, and a form partially corresponding to the shape of a dinosaur in the second state.

BRIEF DESCRIPTION OF DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

DETAILED DESCRIPTION

Figure 1:
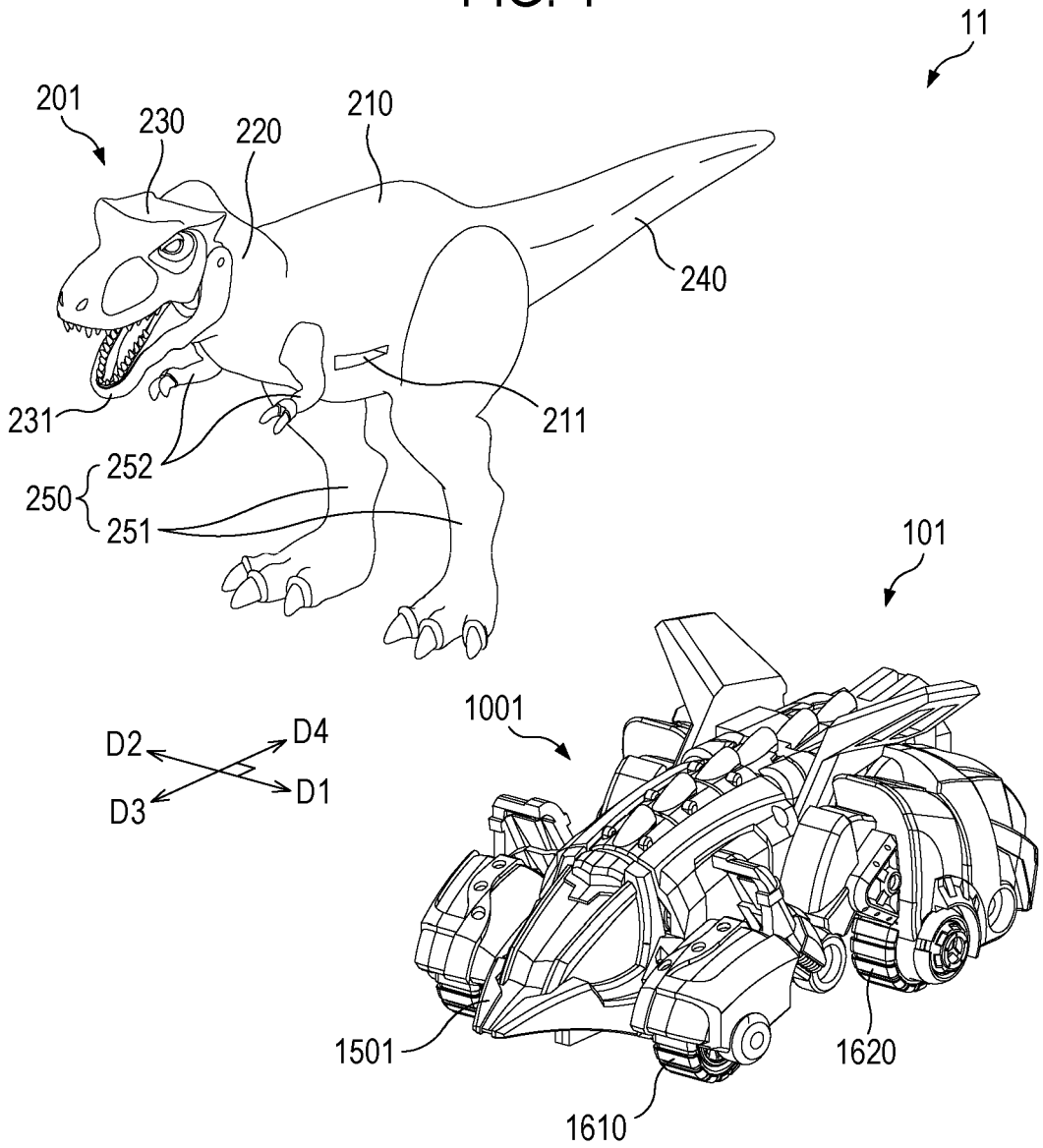
FIG. 1 is a perspective view showing a toy set according to a first embodiment of the present disclosure.

Embodiments of the present disclosure are illustrated for the purpose of explaining the technical idea of the present disclosure. The scope of the rights according to the present disclosure is not limited to the embodiments presented below or the detailed descriptions of such embodiments.

All the technical terms and scientific terms used in the present disclosure include meanings that are commonly understood by those of ordinary skill in the technical field to which the present disclosure pertains unless otherwise defined. All terms used in the present disclosure are selected for the purpose of describing the present disclosure more clearly, and are not selected to limit the scope of the rights according to the present disclosure.

The expressions such as "comprising," "including," "having," and the like used in the present disclosure are to be understood as open-ended terms having the possibility of encompassing other embodiments, unless otherwise mentioned in the phrase or sentence containing such expressions.

The singular expressions that are described in the present disclosure may encompass plural expressions unless otherwise stated, which will also be applied to the singular expressions recited in the claims.

The expressions such as "first," "second," etc. used in the present disclosure are used to separate a plurality of elements from each other, and are not intended to limit an order or importance of the elements.

In the present disclosure, the description that one element is "connected" or "coupled" to another element should be appreciated to indicate that one element may be directly connected, or coupled, to another element, and should be further understood that a novel element may be interposed between one element and another element.

As used in the present disclosure, a "first direction" means any one of a multiplicity of directions that cross a direction (inward direction) in which a frame portion to be described below looks at a model toy in a second state. As used in the present disclosure, a "second direction" is defined as a direction opposite to the first direction. One of both directions orthogonal to the inward direction and the first direction is defined as a "third direction," and the other is defined as a "fourth direction." That is, the second to fourth directions are defined with reference to the first direction. Referring to the drawings, in the embodiments of the present disclosure, the first direction D1, the second direction D2, the third direction D3, and the fourth direction D4 are illustrated as examples. However, these directions are merely intended for the understanding of the present disclosure. The second to fourth directions may change depending on which direction the first direction is set to.

In the present disclosure, the first direction D1, the second direction D2, the third direction D3, and the fourth direction D4 may be indicated as a "left direction," a "right direction," a "front direction," and a "rear direction," respectively. However, this is merely for purposes of understanding the present disclosure, and the indication of the respective directions may change.

Descriptions are made hereinafter as to the embodiments of the present disclosure with reference to the accompanying drawings. Like reference numerals in the drawings denote like or corresponding elements. Further, in the following description of the embodiments, duplicate descriptions for the same or corresponding elements may be omitted. However, even if the descriptions of the elements are omitted, such elements are not intended to be excluded in any embodiment.

The embodiments described below and the examples shown in the accompanying drawings relate to a transformable toy and a toy set including a model toy and a transformable toy. The model toy according to the present disclosure is an object that imitates a known animal, a person or animal appearing in a movie or cartoon, or a virtual person or animal. The model toy can be manufactured using a metal material, a resin material, or a wooden material. Such a model toy may be a figure in the related art. The model toy may be formed as an immovable integral body, or may be formed to have a plurality of portions connected by joints. The transformable toy according to the present disclosure is configured such that a plurality of members connected in a relatively detachable, relatively rotatable or relatively movable manner can be transformed in its form or state by a user's manipulation.

The transformable toy according to embodiments of the present disclosure includes a transformable body that is transformable in form. The transformable toy according to the embodiments may be composed of only the transformable body, or may further include an accessory body that is removably or detachably coupled to the transformable body. According to the embodiments, the accessory body may not be transformable, or may be transformed independently of the transformable body.

The transformable body of the transformable toy according to the embodiments is configured to have a first state where the transformable body is separated and independent from the model toy 201, 202, 203 or 204, and a second state where the transformable body is coupled to the model toy. The transformable toy is configured to be transformable so as to have one distinctive form (first form) in the first state and another distinctive form (second form) in the second state. The transformable toy can be reversibly transformed into the first form in the first state and the second form in the second state. Further, in the first state and the second state, the transformable toy can be reversibly transformed into an intermediate form partially corresponding to the first form or the second form. Further, the transformable body may be transformable so as to have a form that forms at least a portion of the first form in the first state and to have a form that forms at least a portion of the second form in the second state. Further, the accessory body may be coupled to a predetermined first position in the first state to constitute at least a portion of the first form, and may be coupled to a predetermined second position in the second state to constitute at least a portion of the second form.

The first form may include a form corresponding to a shape of a transport machine. For example, the first form may have a form corresponding to a shape of a transport machine such as a vehicle, an airplane, a spacecraft, a ship or a submarine. As another example, the first form may have a form corresponding to an animal shape or a human shape.

The transformable toy may have the second form corresponding to a shape of the model toy in the second state. The second form may correspond to an animal shape or a human shape. For example, the second form may have a form corresponding to a dinosaur shape. The dinosaur shape may be the shape of a land dinosaur, a water dinosaur or a flying dinosaur.

In the second state, the transformable body according to the embodiments may be releasably coupled to the model toy while covering the outer surface of the model toy according to the embodiments. Thus, the transformable toy according to the embodiments can give novel experience and interest to the user. For example, the user can have fun that the model toy is wearing a protector (e.g., an armor or an armor and helmet) which is made by the transformed transformable toy.

According to the embodiments, the transformable toy includes the transformable body configured to be transformable into the above-described first state and the above-described second state. The transformable toy 101, 102, 103 or 104 includes the transformable body 1001, 1002, 1003 or 1004 which is transformable so as to be releasably coupled to the model toy 201, 202, 203 or 204. The transformable body 1001, 1002, 1003 or 1004 may be an assembly in which members rotatable for transformation are joined by hinge joints. The transformable body 1001, 1002, 1003 or 1004 is configured to be transformable into the first state where the transformable body is independent from the model toy 201, 202, 203 or 204 and the second state where the transformable body covers the model toy 201, 202, 203 or 204 at least partially and is releasably coupled to the model toy 201, 202, 203 or 204. For example, the transformable body shown in each of FIGS. 1, 19, 34 and 50 is in the first state where the transformable body is independent from the model toy, and the transformable body shown in each of FIGS. 2, 20, 35 and 53 is in the second state, different from the first state, where the transformable body partially covers the model toy.

According to the embodiments, the transformable body of the transformable toy may include a frame portion 1100 functioning as a base portion of the transformable body and configured to partially cover the model toy in the second state of the transformable body. The frame portion 1100 may be configured to cover a portion of the model toy, for example, a back portion of a torso portion of the model toy in the second state of the transformable body. The frame portion 1100 may be a structural member that rotatably supports at least one transformation portion and functions as a base or a spine of the transformable body. The frame portion 1100 may be formed as a plate-shaped body having a surface that can be recognized as a portion of a transport machine. Alternatively, the frame portion 1100 may be formed as a bar-shaped shaft.

According to the embodiments, the transformable body of the transformable toy may include at least one transformation portion rotatably coupled to the frame portion 1100 and configured to be rotated with respect to the frame portion 1100. The at least one transformation portion may be a structural member for performing transformation into the first state and the second state of the transformable body, and may be a structural member that is coupled to the frame portion 1100 to constitute the transformable body together with the frame portion 1100.

The at least one transformation portion may be configured to partially cover a portion of the model toy in the second state of the transformable body. Further, the at least one transformation portion may include at least one covering transformation portion configured to partially cover a portion of the model toy in the second state of the transformable body. Such a covering transformation portion may be provided in the at least one transformation portion as a rotatable member or as a removable member.

According to the embodiments, the at least one transformation portion is coupled to the frame portion 1100 so as to be rotatable about a rotation axis corresponding thereto, and is configured to be rotated with respect to the frame portion 1100 about the rotation axis corresponding thereto. The aforementioned corresponding rotation axis may pass through the frame portion 1100 in any direction. Therefore, the at least one transformation portion can be manipulated for the transformation of the transformable body from one of the first and second states to the other of the first and second states, by being rotated with respect to the frame portion 1100. Alternatively, the at least one transformation portion may be configured to be unfolded with respect to the frame portion 1100 by being rotated about the rotation axis corresponding thereto for the transformation of the transformable body from the first state to the second state. Alternatively, the at least one transformation portion may be configured to be folded with respect to the frame portion 1100 by being rotated about the rotation axis corresponding thereto for the transformation of the transformable body from the second state to the first state.

According to the embodiments, the transformable body may include only one transformation portion. The one transformation portion may be configured to be folded with respect to the frame portion 1100 or to be rotated with respect to the frame portion 1100 about the rotation axis corresponding to the one transformation portion when the transformable body is transformed into the first state and the second state. Further, the one transformation portion may be configured to be engaged with the model toy.

According to the embodiments, the at least one transformation portion provided in the transformable body may include two or more transformation portions. The two or more transformation portions may be configured to be rotated in two or more different directions with respect to the frame portion 1100 for the transformation of the transformable body from one of the first and second states to the other of the first and second states. Further, the two or more transformation portions may be configured to be folded with respect to the frame portion 1100 by being rotated about the respective corresponding rotation axes for the transformation of the transformable body from the second state to the first state.

According to the embodiments, two transformation portions of the two or more transformation portions may be configured to grip the model toy (for example, to clamp the model toy or to be engaged with the model toy) in order to releasably couple the transformable body to the model toy. Other transformation portions except the two transformation portions may be configured to partially cover a portion of the model toy. Further, the two transformation portions for gripping the model toy may be configured to cover the model toy.

The rotation center of the transformation portions according to the embodiments with respect to the frame portion 1100 may be first to fourth rotation axes R1, R2, R3 and R4. The rotation axes mentioned in the present disclosure may mean a virtual axis that extends through the transformable body of the transformable toy in the first direction D1, the second direction D2, the third direction D3, the fourth direction D4, or an oblique direction between two adjacent directions. The transformable toy according to the embodiments may have an additional rotation axis in addition to the first to fourth rotation axes.

The first to fourth rotation axes may extend through the respective portions of the frame portion 1100. The positions of the first to fourth rotation axes with respect to the frame portion 1100 may be defined by the first to fourth directions D1, D2, D3 and D4. The first rotation axis R1 may pass through a portion of the frame portion 1100 in the first direction D1, and the second rotation axis R2 may pass through a portion of the frame portion 1100 in the second direction D2. The third rotation axis R3 may pass through a portion of the frame portion 1100 in the third direction D3 orthogonal to the first direction D1 or the second direction D2. The fourth rotation axis R4 may pass through a portion of the frame portion 1100 in the fourth direction D4 orthogonal to the first direction D1 or the second direction D2.

According to the embodiments, the first and second rotation axes are virtual axes extending substantially in the third and fourth directions D3 and D4, and the third and fourth rotation axes are virtual axes extending substantially in the first and second directions D1 and D2. However, the correspondence between the first to fourth rotation axes and the first to fourth directions is not limited to the aforementioned correspondence.

The transformable toy according to one embodiment may include, as the two transformation portions, a first transformation portion coupled to the frame portion 1100 so as to be rotatable about the first rotation axis and a second transformation portion coupled to the frame portion 1100 so as to be rotatable about the second rotation axis. The transformable toy according to another embodiment may include, in addition to the first and second transformation portions, a third transformation portion coupled to the frame portion 1100 so as to be rotatable about the third rotation axis. The transformable toy according to a further embodiment may include, in addition to the first to third transformation portions, a fourth transformation portion coupled to the frame portion 1100 so as to be rotatable about the fourth rotation axis.

According to the embodiments, the first and second transformation portions of the at least one transformation portion may be configured to grip the model toy. In some embodiments, in addition to the first and second transformation portions, a third transformation portion, a fourth transformation portion, or another transformation portion of the at least one transformation portion may be configured to grip the model toy. Since the transformation portion can grip the model toy in the second state of the transformable body, the transformable body in the second state can be releasably coupled to the model toy with ease.

According to the embodiments, the configuration of the transformation portion for gripping the model toy may be realized by an engaging portion provided in the transformation portion and a counter engaging portion provided in the model toy and complementarily engaged with or fitted to the engaging portion of the transformation portion. The engaging portion of the transformation portion may be formed as a male engaging portion having a shape of a protrusion or a pin or as a female engaging portion having a shape of a groove or a hole. When the engaging portion of the transformation portion is a male engaging portion, the counter engaging portion provided in the model toy may be a female engaging portion. When the engaging portion of the transformation portion is a female engaging portion, the counter engaging portion provided in the model toy may be a male engaging portion. In one embodiment, the engaging portion provided in the transformation portion may be located at a distal end of the transformation portion, and the counter engaging portion provided in the model toy may be located at a torso portion or a leg extension portion of the model toy.

In the following description, the first transformation portion, the second transformation portion, the third transformation portion, and the fourth transformation portion are described as being a left transformation portion 1201, a right transformation portion 1202, a front transformation portion 1300, and a rear transformation portion 1400, respectively. However, the present disclosure is not limited thereto. For example, the first transformation portion may be regarded as one of the right transformation portion 1202, the front transformation portion 1300 and the rear transformation portion 1400, and the third transformation portion may be regarded as one of the left transformation portion 1201, the right transformation portion 1202 and the rear transformation portion 1400.

Figure 2:
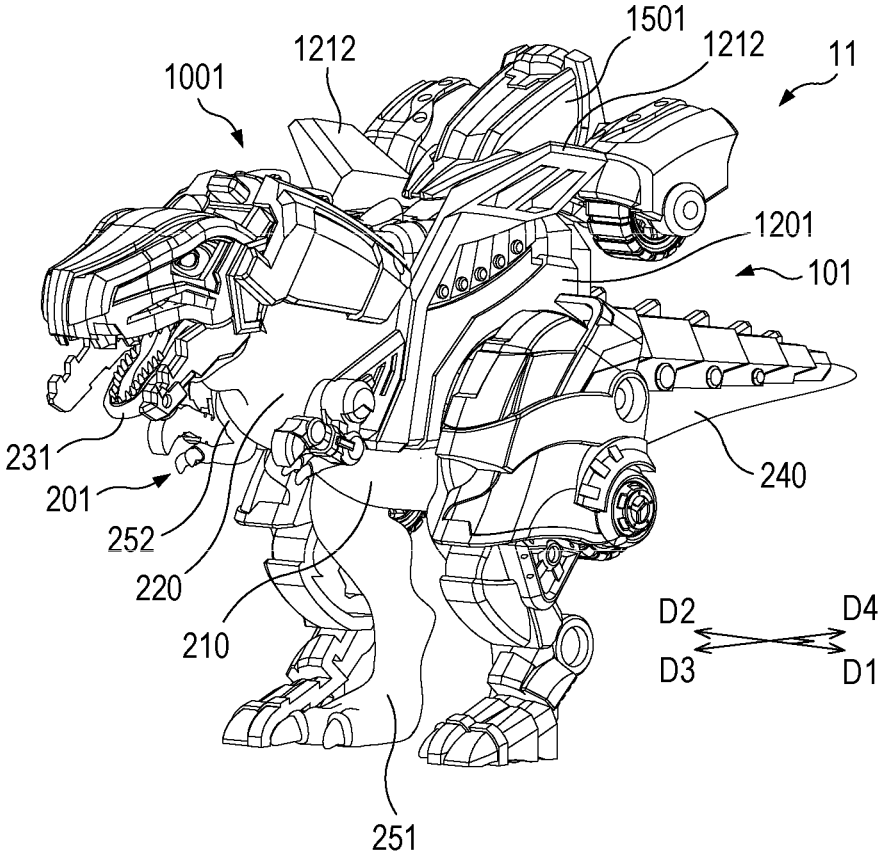
FIG. 2 is a perspective view showing a combination of a model toy and a transformable toy shown in FIG. 1.
Figure 3:
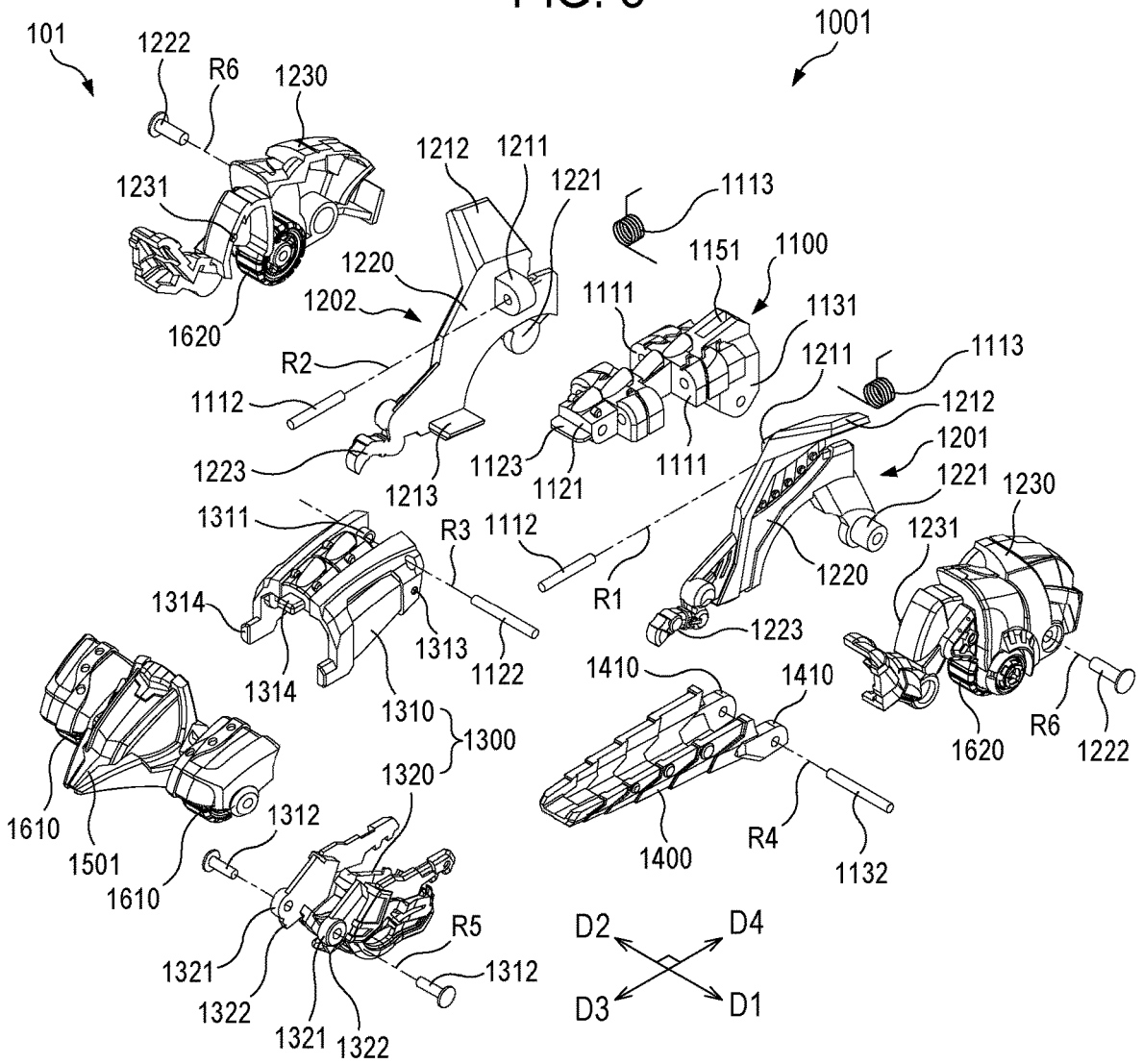
FIG. 3 is an exploded perspective view of the transformable toy shown in FIG. 1.
Figure 4:
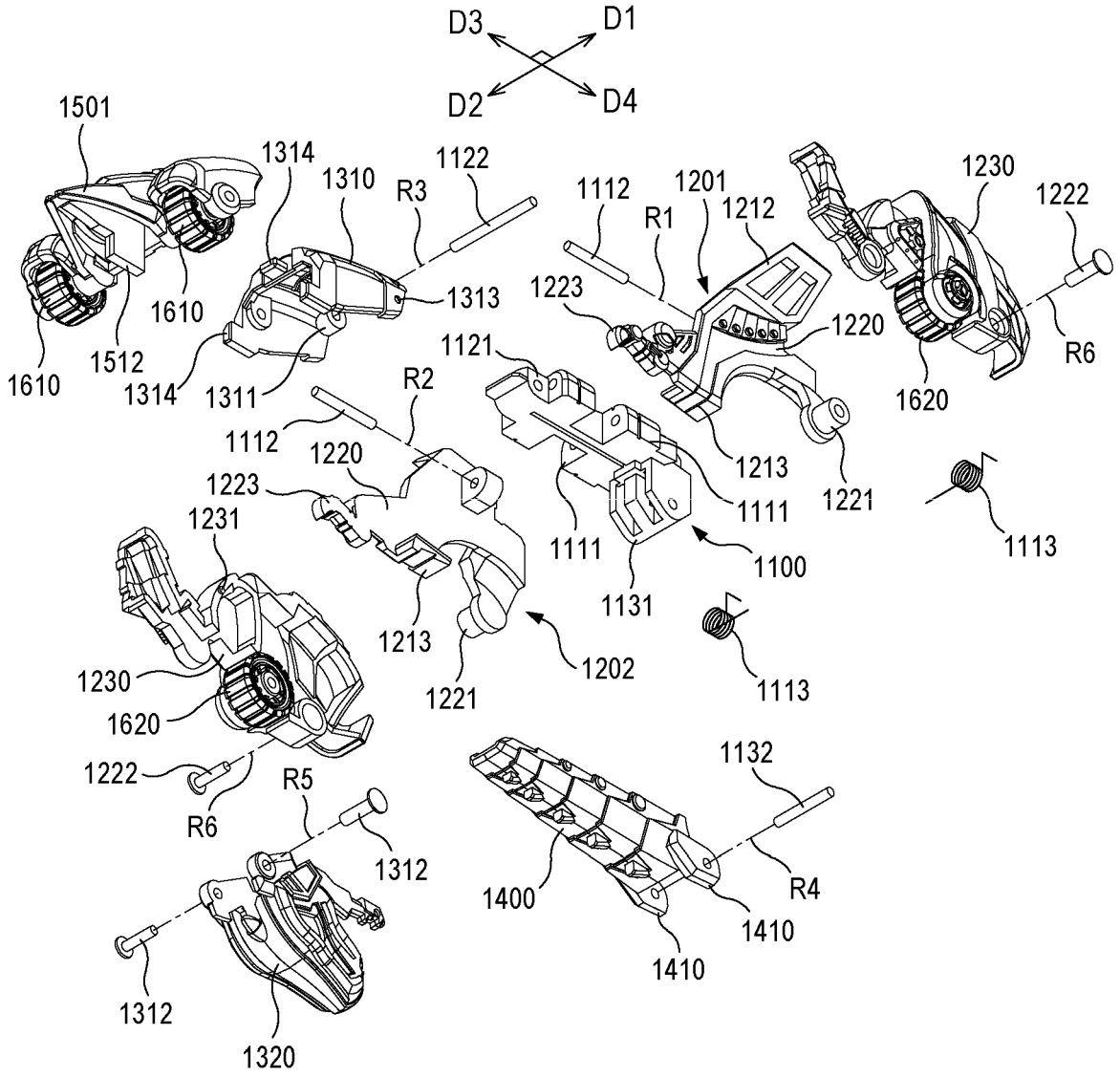
FIG. 4 is another exploded perspective view of the transformable toy shown in FIG. 1.

Hereinafter, a transformable toy 101, a model toy 201, and a toy set 11 according to a first embodiment of the present disclosure are described with reference to FIGS. 1 to 18. FIGS. 1 and 2 show a toy set and a transformable toy according to the first embodiment. FIGS. 3 and 4 are exploded perspective views of the transformable toy shown in FIG. 1. FIGS. 5 to 10 are a front lower perspective view, a rear lower perspective view, a plan view, a side view, a front view, and a rear view of the transformable toy shown in FIG. 1, respectively. FIGS. 11 to 17 show examples where the transformable toy according to the first embodiment is transformed and examples where the transformable toy is coupled to the model toy.

Referring to FIGS. 1 and 2, the toy set 11 includes the transformable toy 101 and the model toy 201. The model toy 201 may have an appearance corresponding to a shape of a land animal, for example, an appearance corresponding to a shape of a dinosaur which may be called a tyrannosaurus. FIG. 1 shows the transformable toy 101 independent from the model toy 201, and FIG. 2 shows a combination of the model toy and the transformable toy that is formed by coupling the transformable toy 101 to the model toy 201.

The model toy 201 may include: a torso portion 210; a neck extension portion 220 extending frontward from the torso portion 210; a head extension portion 230 extending frontward from the neck extension portion 220; a tail extension portion 240 extending rearward from the torso portion 210; and leg extension portions 250 extending downward from the torso portion 210. The torso portion 210 may have a shape of a torso of a tyrannosaurus. Further, the model toy 201 has, at the torso portion 210, a counter engaging portion 211 that functions for releasably coupling the transformable toy 101 and the model toy 201. The neck extension portion 220 may have a shape of a neck of a tyrannosaurus. The head extension portion 230 may have a shape of a head of a tyrannosaurus. The head extension portion 230 may have a chin portion 231 rotatably attached to the lower side thereof, and the chin portion 231 may have a shape of a lower jaw of a tyrannosaurus. The tail extension portion 240 may have a shape of a tail of a tyrannosaurus. The leg extension portions 250 include hind leg extension portions 251 that may have a shape of hind legs of the tyrannosaurus, and front leg extension portions 252 that may have a shape of front legs of the tyrannosaurus.

Referring to FIGS. 3 and 4, the transformable body 1001 includes, as the two transformation portions, a left transformation portion 1201 and a right transformation portion 1202 that are configured to be rotated in two different directions with respect to the frame portion 1100.

The left transformation portion 1201 and the right transformation portion 1202 are configured to be rotated in two different directions with respect to the frame portion 1100 for transformation of the transformable body from one of the first state shown in FIG. 1 and the second state shown in FIG. 2 to the other of the first and second states. The rotations of the left and right transformation portions 1201 and 1202 in two different directions may include rotating one of the left and right transformation portions 1201 and 1202 clockwise about its corresponding rotation axis and rotating the other of the left and right transformation portions 1201 and 1202 counterclockwise substantially simultaneously or sequentially about its corresponding rotation axis. Therefore, the left and right transformation portions 1201 and 1202 are configured to be rotated with respect to the frame portion 1100 about the respective corresponding rotation axes so as to be moved away from each other or moved toward each other.

Figure 7:
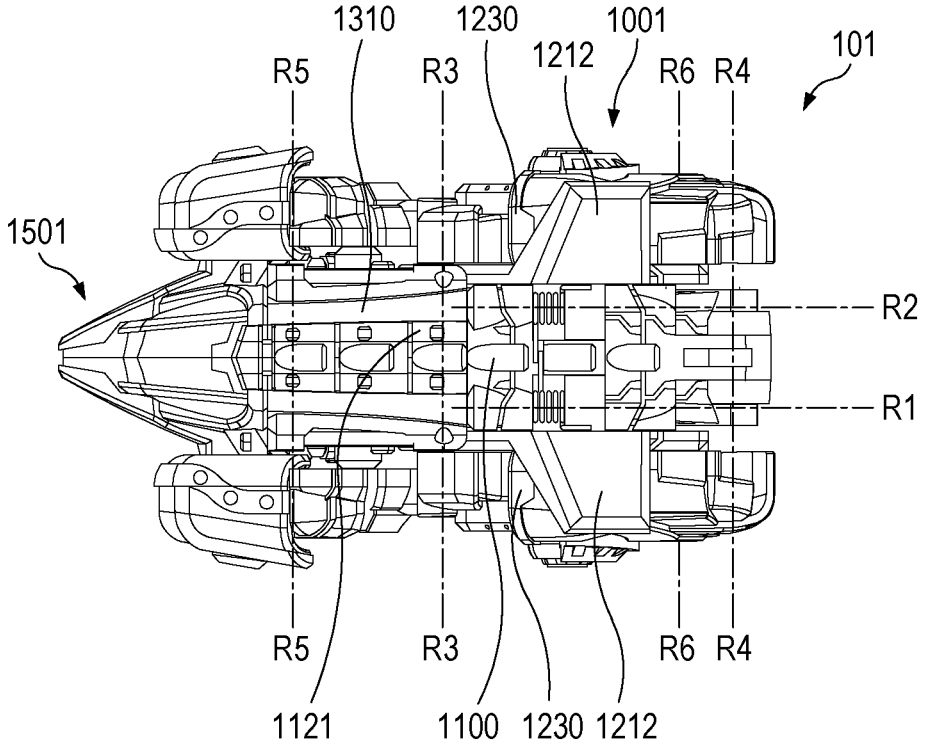
FIG. 7 is a plan view of the transformable toy shown in FIG. 1.
Figure 8:
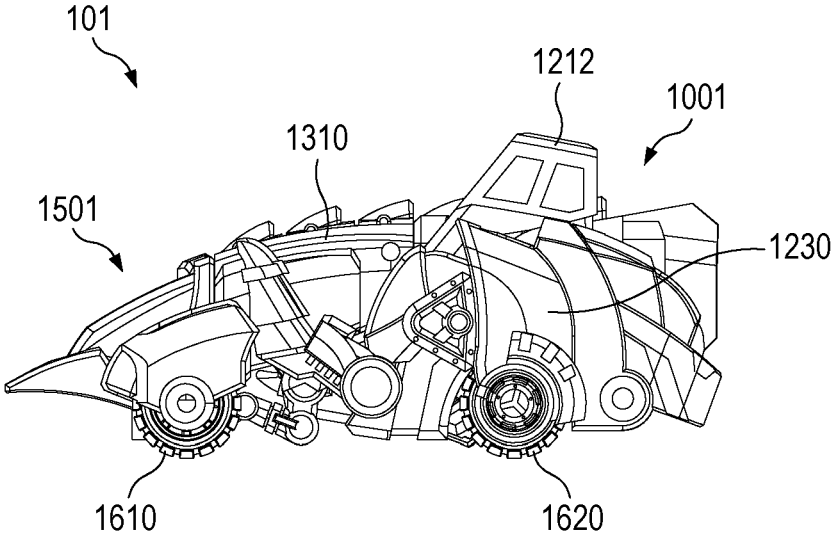
FIG. 8 is a side view of the transformable toy shown in FIG. 1.
Figure 9:
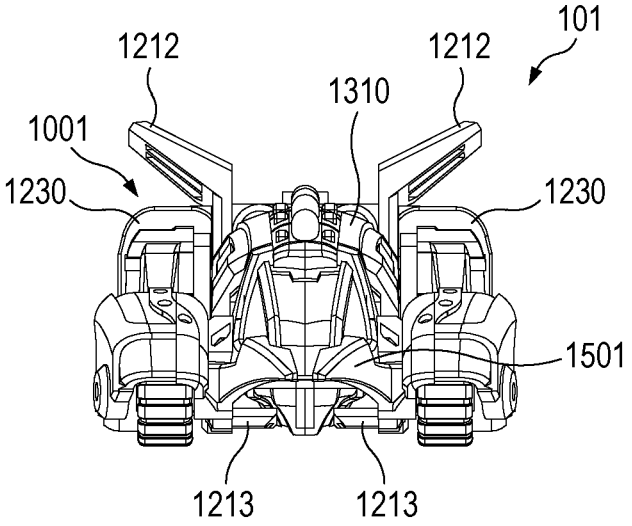
FIG. 9 is a front view of the transformable toy shown in FIG. 1.
Figure 10:
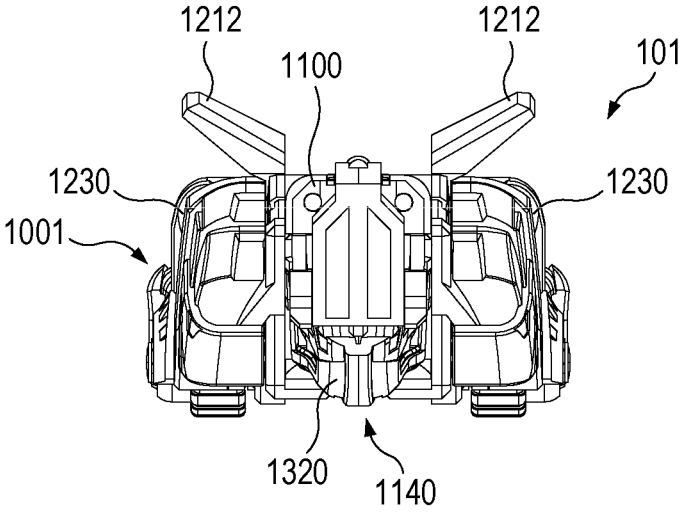
FIG. 10 is a rear view of the transformable toy shown in FIG. 1.

Regarding the rotation of the left and right transformation portions 1201 and 1202, the left transformation portion 1201 is coupled to the frame portion 1100 so as to be rotatable about the first rotation axis R1, and the right transformation portion 1202 is coupled to the frame portion 1100 so as to be rotatable about the second rotation shaft R2 (see FIG. 7). The second rotation axis R2 is spaced apart from the first rotation axis R1, and may be parallel to the first rotation axis R1. According to some embodiments, the first and second rotation axes R1 and R2 may be inclined toward each other.

The first rotation axis R1 passes through a portion of the frame portion 1100 in the first direction D1, and the second rotation axis R2 passes through a portion of the frame portion 1100 in the second direction D2 opposite to the first direction D1. As an alternative example, the first rotation axis R1 and the second rotation axis R2 may constitute one rotation axis. When the first and second rotation axes are one rotation axis, the frame portion 1100 may be configured to rotate the left and right transformation portions 1201 and 1202 in different directions about one rotation axis.

The left and right transformation portions 1201 and 1202, which are coupled to the frame portion 1100 so as to be rotated in different directions, may be configured to be unfolded with respect to the frame portion 1100 for transformation of the transformable body 1001 from the first state to the second state, or to be folded with respect to the frame portion 1100 for transformation of the transformable body 1001 from the second state to the first state. The left and right transformation portions 1201 and 1202 are rotated with respect to the frame portion 1100 in different directions while being moved away from each other. Therefore, the left and right transformation portions are unfolded with respect to the frame portion 1100 in the second state of the transformable body 1001. The left and right transformation portions 1201 and 1202 are rotated with respect to the frame portion 1100 in different directions while being moved toward each other. Therefore, the left and right transformation portions are folded with respect to the frame portion 1100 in the first state of the transformable body 1001.

The left and right transformation portions 1201 and 1202 may be configured to cover a portion of the model toy in the second state of the transformable body 1001. The left transformation portion 1201 is configured to cover a portion of the model toy in the first direction D1 (in this embodiment, a portion of a left side surface of the torso portion of the model toy) in the second state of the transformable body 1001. The right transformation portion 1202 is configured to cover another portion of the model toy in the second direction D2 (in this embodiment, a portion of a right side surface of the torso portion of the model toy) in the second state of the transformable body 1001.

Accordingly, the left and right transformation portions 1201 and 1202 can be rotated about the first and second rotation axes R1 and R2 in the transformable body 1001 so as to be moved away from each other or moved toward each other. Specifically, the left and right transformation portions 1201 and 1202 can be rotated to an insertion position where the left and right transformation portions 1201 and 1202 are moved away from each other to allow the torso portion of the model toy to be inserted between the left and right transformation portions 1201 and 1202, and a cover position where the left and right transformation portions are moved toward each other to cover the torso portion of the model toy.

The frame portion 1100 and the left and right transformation portions 1201 and 1202 are connected by first and second hinge joints, respectively. Each of the first and second hinge joints may be composed of a hinge portion 1111 provided at each lateral side of the frame portion 1100, a counter hinge portion 1211 provided at the base end of each of the left and right transformation portions 1201 and 1202, and a hinge shaft 1112 passing through the hinge portion 1111 and the counter hinge portion 1211. The hinge portion 1111 provided at the left side of the frame portion 1100 may be a portion of the frame portion 1100 in the first direction D1 through which the first rotation axis R1 passes, and the hinge portion 1111 provided at the right side of the frame portion 1100 may be a portion of the frame portion 1100 in the second direction D2 through which the second rotation axis R2 passes. The respective hinge shafts 1112 may correspond to the first rotation axis R1 and the second rotation axis R2. The hinge shaft constituting the hinge joint may be composed of a pin, a bolt, or a screw.

The frame portion 1100 of the transformable body may include at least one spring configured to bias the left and right transformation portions 1201 and 1202 toward each other, i.e., toward the cover position. By virtue of the spring, the left and right transformation portions 1201 and 1202 can be biased so as to be moved toward each other from the state of being moved away from each other. The transformable body of the transformable toy may include at least one spring disposed between the left and right transformation portions 1201 and 1202. Alternatively, the transformable body of the transformable toy may include a pair of springs disposed in the respective corresponding rotation axes of the left and right transformation portions 1201 and 1202 and configured to bias one of the left and right transformation portions 1201 and 1202 toward the other. The spring may include a torsion spring, a tension spring or a compression spring.

The frame portion 1100 of the transformable body 1001 includes torsion springs 1113 respectively disposed between the frame portion 1100 and the left and right transformation portions 1201 and 1202. The left and right transformation portions 1201 and 1202 are biased by the biasing force of the torsion springs 1113 so as to be moved toward each other. Therefore, the transformable body 1001 can be stably coupled to the model toy in the state where the left and right transformation portions 1201 and 1202 biased toward each other are coupled to the torso portion of the model toy. Further, by the biasing force of the torsion springs 1113, the rotatable transformation portions of the transformable body 1001 can be stably maintained in the first state of the transformable body 1001.

The torsion springs 1113 are disposed between the frame portion 1100 and the left and right transformation portions 1201 and 1202 such that the hinge shafts 1112 pass through the insides of the torsion springs 1113, respectively. For example, one end of each torsion spring 1113 may be engaged on the surface of the frame portion 1100, and the other end of each torsion spring 1113 may be engaged on the counter hinge portion 1211. The respective inner surfaces of the left and right transformation portions 1201 and 1202 biased by the torsion springs 1113 make contact with the respective side surfaces of the frame portion 1100, whereby the rotation of the left and right transformation portions 1201 and 1202 toward the inside of the frame portion 1100 can be restricted.

The transformable body 1001 of the transformable toy may include manipulation portions that can be manipulated by the user to rotate the left and right transformation portions 1201 and 1202 such that the left and right transformation portions 1201 and 1202 are moved away from each other. When the springs are provided in the frame portion 1100, the manipulation portions may be manipulated to rotate the left and right transformation portions 1201 and 1202 against the biasing force of the springs. The manipulation portions may be disposed in the left and right transformation portions 1201 and 1202, respectively. The left and right transformation portions 1201 and 1202 may be rotated about the respective corresponding rotation axes (e.g., the first rotation axis R1 and the second rotation axis R2) in the direction of a force applied to the manipulation portions. In some embodiments, the transformable body of the transformable toy may not include the manipulation portions, and the user may rotate the left and right transformation portions 1201 and 1202 by pinching bodies that constitute the left and right transformation portions 1201 and 1202.

The left and right transformation portions 1201 and 1202 include a manipulation portion 1212. Each manipulation portion 1212 has a shape that can be recognized as a wing, and is formed as a protrusion protruding from the base end of each of the left and right transformation portions 1201 and 1202. The manipulation portions 1212 extend from the base ends of the left and right transformation portions 1201 and 1202 in an oblique direction between the lateral side and the upper side. For example, as the user pinches the pair of manipulation portions 1212 and manipulates the pair of manipulation portions 1212 to move the pair of manipulation portions 1212 toward each other, the left and right transformation portions 1201 and 1202 are moved away from each other and are rotated to the insertion position. In the state where the left and right transformation portions 1201 and 1202 are moved away from each other by the pair of manipulation portions 1212, the torso portion of the model toy can be inserted between the left and right transformation portions 1201 and 1202. Thereafter, as the manipulation portions 1212 are released, the left and right transformation portions 1201 and 1202 are moved toward each other by the biasing force of the torsion springs 1113 and can cover the torso portion of the model toy.

Each of the left and right transformation portions 1201 and 1202 includes an engaging portion 1213 which is formed as a protrusion protruding from the distal end of the transformation portion. Each engaging portion 1213 of the left and right transformation portions 1201 and 1202 protrudes from one of the left and right transformation portions 1201 and 1202 toward the other in the state where the left and right transformation portions 1201 and 1202 are moved toward each other. Further, the model toy includes, at each of the left and right sides of the torso portion, a counter engaging portion 211 (see FIG. 1) corresponding to the engaging portion 1213. The counter engaging portions 211 are formed as a groove recessed from the side surface of the torso portion. In the second state of the transformable body 1001, the engaging portions 1213 are fitted to the counter engaging portions 211 in the first direction D1 or the second direction D2. Therefore, as the left and right transformation portions 1201 and 1202 cover and releasably grip the torso portion of the model toy, the transformable body 1001 transformed into the second state can be coupled to the model toy.

The left and right transformation portions 1201 and 1202 releasably couple the transformable body 1001 transformed into the second state to the model toy and cover the torso portion of the model toy. When the transformable body 1001 transformed into the second state is coupled to the model toy, the left and right transformation portions 1201 and 1202 cover a portion of the model toy. Therefore, the left and right transformation portions 1201 and 1202 can be recognized by the user as a portion of a kind of protector (e.g., an armor) that covers and protects the model toy.

According to the embodiments, the transformable body of the transformable toy may include a front transformation portion 1300 as the at least one transformation portion. The front transformation portion 1300 may be coupled to the frame portion 1100 so as to be rotatable about a third rotation axis. The third rotation axis passes through a portion of the frame portion 1100 in the third direction D3 orthogonal to the first direction D1 or the second direction D2. In the second state of the transformable body, the front transformation portion 1300 is configured to cover another portion of the model toy that extends in the third direction D3 from the portion of the model toy covered by the frame portion 1100.

In this embodiment, the transformable body 1001 includes the front transformation portion 1300. The front transformation portion 1300 is coupled to the frame portion 1100 so as to be rotatable about the third rotation axis R3 (see FIG. 7). The third rotation axis R3 passes through a portion of the frame portion 1100 (the front end portion of the frame portion) in the third direction D3 orthogonal to the first direction D1 and the second direction D2. In the second state of the transformable body 1001, the front transformation portion 1300 is configured to cover another portion of the model toy (e.g., the neck extension portion and the head extension portion of the model toy shown in FIG. 1) that extends in the third direction D3 from the portion of the model toy covered by the frame portion 1100 (e.g., the torso portion of the model toy shown in FIG. 1).

According to the embodiments, the transformable body of the transformable toy may include a rear transformation portion 1400 as the at least one transformation portion. The rear transformation portion 1400 may be coupled to the frame portion 1100 so as to be rotatable about a fourth rotation axis. The fourth rotation axis passes through a portion of the frame portion 1100 in the fourth direction D4 opposite to the third direction D3. The transformable toy according to one embodiment may include the front transformation portion 1300 and the rear transformation portion 1400. The transformable toy according to one embodiment may include one of the front and rear transformation portions 1300 and 1400. According to the embodiments, in the second state of the transformable body, the rear transformation portion 1400 may be configured to cover another portion of the model toy that extends in the fourth direction D4 from the portion of the model toy covered by the frame portion 1100.

In this embodiment, the transformable body 1001 includes the rear transformation portion 1400 as the at least one transformation portion. The rear transformation portion 1400 is coupled to the frame portion 1100 so as to be rotatable about the fourth rotation axis R4 (see FIG. 7). The fourth rotation axis R4 passes through a portion of the frame portion 1100 (the rear end portion of the frame portion) in the fourth direction D4. The fourth rotation axis R4 is spaced apart from the third rotation axis R3 in the fourth direction D4. In the second state of the transformable body 1001, the rear transformation portion 1400 is configured to cover another portion of the model toy (e.g., the tail extension portion of the model toy shown in FIG. 1) that extends in the fourth direction D4 from the portion of the model toy covered by the frame portion 1100 (e.g., the torso portion of the model toy shown in FIG. 1).

According to the embodiments, the front transformation portion 1300 of the transformable body may include a link portion rotatably coupled to the frame portion 1100 and a distal end portion rotatably or detachably coupled to the link portion. The distal end portion may have a shape partially corresponding to the appearance of the model toy. Further, the distal end portion may be configured to partially cover a portion of the model toy in the second state of the transformable body. That is, the distal end portion can function as a covering transformation portion that partially covers the model toy in the second state of the transformable body.

In this embodiment, the front transformation portion 1300 includes the link portion 1310 coupled to the frame portion 1100 so as to be rotatable about the third rotation axis R3, and the distal end portion 1320 coupled to the front end of the link portion 1310 (the end portion of the link portion 1310 in the third direction D3) so as to be rotatable about a fifth rotation axis R5 (see FIG. 7). The fifth rotation axis R5 may be parallel to the third rotation axis R3. The link portion 1310 of this embodiment is configured to partially cover the neck extension portion of the model toy (see FIG. 1). The distal end portion 1320 of this embodiment is configured to partially cover the head extension portion and the chin portion of the model toy (see FIG. 1), and may have, for example, a shape that can be recognized as a helmet by the user.

The frame portion 1100 and the link portion 1310 are connected by a third hinge joint. The third hinge joint may be composed of a hinge portion 1121 provided at the front end of the frame portion 1100, a counter hinge portion 1311 provided at the rear end of the link portion 1310, and a hinge shaft 1122 passing through the hinge portion 1121 and the counter hinge portion 1311. The hinge portion 1121 of the frame portion 1100 may be a portion of the frame portion 1100 in the third direction D3 through which the third rotation axis R3 passes. The link portion 1310 can be rotated upward and downward with respect to the frame portion 1100. A stopper portion 1123 protrudes from a front end of the hinge portion 1121, and can restrict the downward rotation of the link portion 1310. Further, a portion of the rear end surface of the counter hinge portion 1311 makes contact with the front end surface of the frame portion 1100, whereby the upward rotation of the link portion 1310 can be restricted.

The link portion 1310 and the distal end portion 1320 are connected by a fifth hinge joint. The fifth hinge joint may be composed of a hinge portion 1321 provided at a base end of the distal end portion 1320, and a hinge shaft 1312 passing through a front end portion of the link portion 1310 and the hinge portion 1321. The distal end portion 1320 has a width narrower than that of the link portion 1310, and can be rotated into an inner space of the link portion 1310 in the first state of the transformable body 1001. A stopper portion 1322 protrudes from the hinge portion 1321. The stopper portion 1322 makes contact with the front end edge of the link portion 1310, whereby the upward rotation of the distal end portion 1320 can be restricted.

The frame portion 1100 and the rear transformation portion 1400 are connected by a fourth hinge joint. The fourth hinge joint may be composed of a hinge portion 1131 provided at the rear end of the frame portion 1100, a counter hinge portion 1410 provided at a base end of the rear transformation portion 1400, and a hinge shaft 1132 passing through the hinge portion 1131 and the counter hinge portion 1410. The hinge portion 1131 of the frame portion 1100 may be a portion of the frame portion 1100 in the fourth direction D4 through which the fourth rotation axis R4 passes. The rear transformation portion 1400 can be rotated frontward and rearward with respect to the frame portion 1100. The base end of the rear transformation portion 1400 adjacent to the counter hinge portion 1410 makes contact with the hinge portion 1131, whereby the upward rotation and rearward rotation of the rear transformation portion 1400 can be restricted. The rear transformation portion 1400 can be folded into the frame portion 1100 so as to make contact with the lower surface of the frame portion 1100 in the first state of the transformable body 1001.

According to the embodiments, the at least one transformation portion of the transformable body may include a support portion and a rotation portion rotatably coupled to the support portion. The support portion of the transformation portion has a predetermined shape and may constitute a main body of the transformation portion. The support portion can function as a support which rotatably supports the rotation portion and supports the frame portion 1100 and the model toy with respect to the rotation center of the transformation portion. The support portion may be configured to have a component that constitutes the hinge joint between the transformation portion and the frame portion. Thus, the rotation axis corresponding to the at least one transformation portion may be disposed in the support portion. The support portion may have a shape of a bar, a flat plate or a curved plate. Further, the support portion may be configured to cover a portion of the model toy corresponding to the support portion in the second state of the transformable body. The rotation portion may be configured to be rotated about a rotation axis different from the rotation axis of the transformation portion in the state where the rotation portion is supported by the support portion in the transformation portion rotated about its corresponding rotation axis. The rotation portion may be configured to cover another portion of the model toy that extends from the portion of the model toy corresponding to the support portion in the second state of the transformable body. That is, the rotation portion can function as a covering transformation portion configured to partially cover a portion of the model toy.

According to the embodiments, each of the left and right transformation portions 1201 and 1202 may include the support portion 1220 and the rotation portion rotatably coupled to the support portion 1220. The support portion 1220 of the transformation portion has a predetermined shape and may constitute a main body of the transformation portion. The support portion 1220 may function as a support which is provided with the engaging portion 1213 of the transformation portion and rotatably supports the rotation portion 1230 and supports the frame portion 1100 and the model toy with respect to the rotation centers of the left and right transformation portions 1201 and 1202. The support portion 1220 may be configured to have a component that constitutes the hinge joint between each of the left and right transformation portions 1201 and 1202 and the frame portion 1100. Therefore, the corresponding rotation axis serving as the rotation center of the left and right transformation portions 1201 and 1202 is disposed in the support portion 1220. The support portion 1220 may have a bar shape while connecting the engaging portion 1213 and the hinge joint. Alternatively, the support portion 1220 may have a shape of a flat plate or a curved plate while connecting the engaging portion 1213 and the hinge joint. In one embodiment, the rotation portion may be configured to be positioned at a position substantially parallel to the ground in the first state of the transformable body, and to be positioned at an upright position where the rotation portion is substantially perpendicular to the ground in the second state of the transformable body. In another embodiment, the rotation portion may be configured to be folded in the first state of the transformable body and to be unfolded in the left direction or the right direction when the transformable body is transformed from the first state to the second state.

In this embodiment, each of the left and right transformation portions 1201 and 1202 includes the support portion 1220 and the rotation portion 1230. The support portion 1220 is configured to cover the portion of the model toy corresponding to the support portion 1220 (the torso portion of the model toy shown in FIG. 1) in the second state of the transformable body 1001. The counter hinge portions 1211 are provided in the respective support portions 1220. Therefore, the respective corresponding rotation axes (i.e., the first rotation axis R1 and the second rotation axis R2) of the left and right transformation portions 1201 and 1202 are disposed in the support portions 1220.

The rotation portion 1230 is coupled to the support portion 1220 so as to be rotatable about a sixth rotation axis R6 (see FIG. 7). The rotation portion 1230 is configured to cover another portion of the model toy (the hind leg extension portion shown in FIG. 1) that extends from the portion of the model toy corresponding to the support portion 1220 in the second state of the transformable body 1001 (the torso portion of the model toy shown in FIG. 1). A distal end portion of the rotation portion 1230 may be formed to correspond to a shape of a foot of the hind leg extension portion of the model toy. In the first state of the transformable body 1001, the sixth rotation axis R6 may be parallel to the fifth rotation axis R5. The rotation portion 1230 may be positioned at a traveling position where the rotation portion 1230 is substantially parallel to the ground in the first state of the transformable body 1001, and may be positioned at an upright position where the rotation portion is substantially perpendicular to the ground in the second state of the transformable body 1001.

The support portion 1220 and the rotation portion 1230 are connected by a sixth hinge joint which may be composed of a hinge portion 1221 protruding downward and laterally from a rear end of the support portion 1220, and a hinge shaft 1222 coupled to the hinge portion 1221 through the rotation portion 1230 in the vicinity of a base end of the rotation portion 1230. A stopper portion may be provided in the hinge portion 1221, and an arc-shaped groove into which the stopper portion is inserted may be provided in an inner surface of the rotation portion 1230. The stopper portion of the hinge portion 1221 makes contact with the groove of the rotation portion 1230, whereby the rotation portion 1230 can be restricted at the upright position.

A fitting protrusion 1231 protruding inward is formed at an edge of the rotation portion 1230. The link portion 1310 of the front transformation portion 1300 has, at its lateral surface, a fitting hole 1313 to which the fitting protrusion 1231 is fitted. In the first state of the transformable body 1001, the fitting protrusion 1231 is fitted into the fitting hole 1313, whereby the rotation portion 1230 can be maintained at the traveling position parallel to the ground. Further, the support portion 1220 has a protruding portion 1223 protruding frontward, and the protruding portion 1223 is formed to partially cover the front leg extension portion 252 of the model toy (see FIG. 1).

According to the embodiments, the frame portion 1100 and the left and right transformation portions 1201 and 1202 may be configured to accommodate at least one of the front transformation portion 1300 and the rear transformation portion 1400 in the first state of the transformable body. When the transformable body is transformed from the second state to the first state, the front transformation portion 1300 and/or the rear transformation portion 1400 of the transformable body can be at least partially accommodated in a space defined by the frame portion and the left and right transformation portions 1201 and 1202. Therefore, the transformable body can be configured more compactly in the first state. Further, according to the embodiments, when the left and right transformation portions 1201 and 1202 include the above-described engaging portions 1213, the left and right transformation portions 1201 and 1202 may be configured to grip the front transformation portion 1300 and/or the rear transformation portion 1400 accommodated by the frame portion 1100 and the left and right transformation portions 1201 and 1202 in the first state of the transformable body. The engaging portions 1213 may protrude so as to restrain the rotation of the front transformation portion 1300 and/or the rear transformation portion 1400 accommodated in the first state of the transformable body. Therefore, the transformable body can be stably maintained in the first state.

Figure 5:
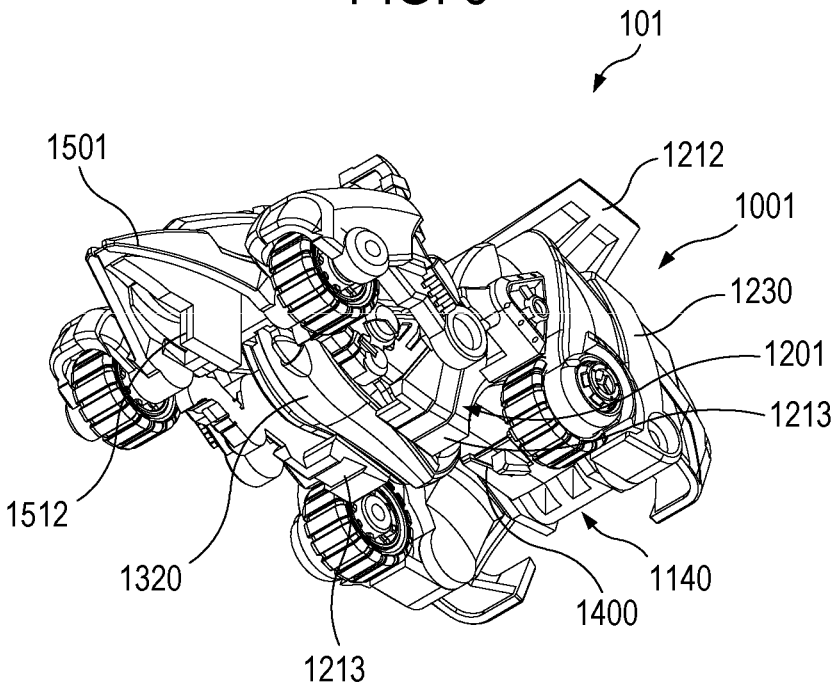
FIG. 5 is a front lower perspective view of the transformable toy shown in FIG. 1.
Figure 6:
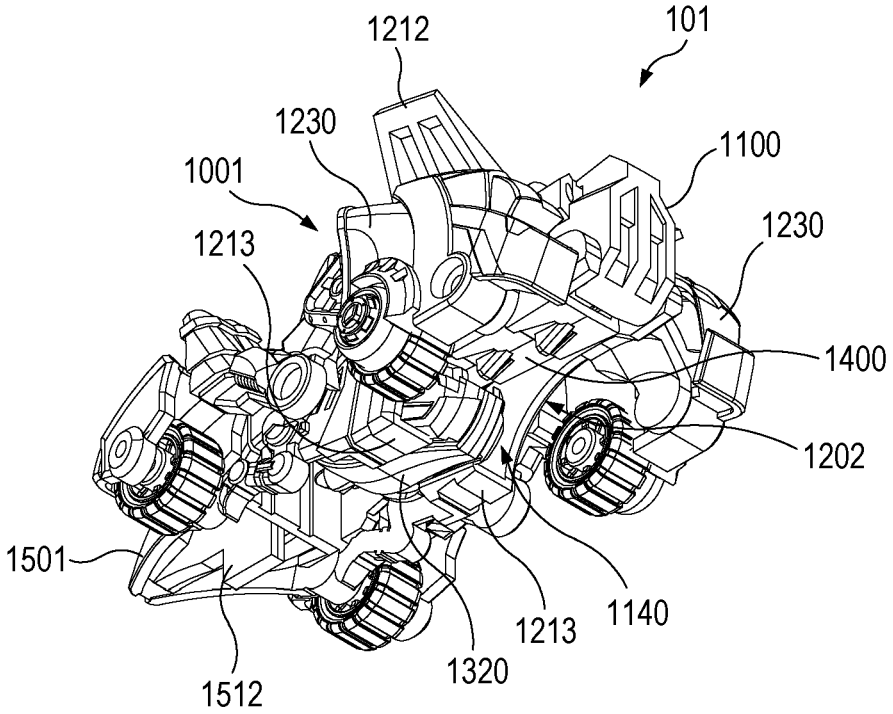
FIG. 6 is a rear lower perspective view of the transformable toy shown in FIG. 1.

As shown in FIGS. 5 and 6, in the first state of the transformable body 1001, the frame portion 1100 has an accommodation portion 1140 defined by the lower surface of the frame portion 1100 and the inner surfaces of the left and right transformation portions 1201 and 1202. When the transformable body is transformed from the second state to the first state, the rear transformation portion 1400 can be rotated into the accommodation portion 1140. Further, the distal end portion 1320 of the front transformation portion 1300 can be rotated into the accommodation portion 1140 while covering the rear transformation portion 1400. Further, in the state where the rear transformation portion 1400 and the distal end portion 1320 of the front transformation portion 1300 are accommodated in the accommodation portion 1140, the engaging portions 1213 protruding from the support portions 1220 of the left and right transformation portions 1201 and 1202 are located below the distal end portion 1320 and can grip the distal end portion 1320. Since the left and right transformation portions 1201 and 1202 are biased toward the inside of the frame portion by the biasing force of the torsion springs, the engaging portions 1213 can prevent the front transformation portion 1300 and the rear transformation portion 1400 from being rotated from the accommodation portion 1140, and the transformable body 1001 can be maintained stably in the first state.

According to the embodiments, the transformable toy may further include an accessory body removably coupled to the transformable body. The accessory body may have a shape corresponding to a portion of the model toy. The accessory body may have a shape corresponding to a portion of a transport machine. The accessory body may be removably coupled to a first position of the transformable body in the first state of the transformable body. In one embodiment, the accessory body may be releasably coupled to the transformable body at a second position different from the first position in the second state of the transformable body. In another embodiment, the accessory body may be releasably coupled to a predetermined position of the model toy in the second state of the transformable body. In a further embodiment, the accessory body may be configured to be transformed independently of the transformable body.

Figure 11:
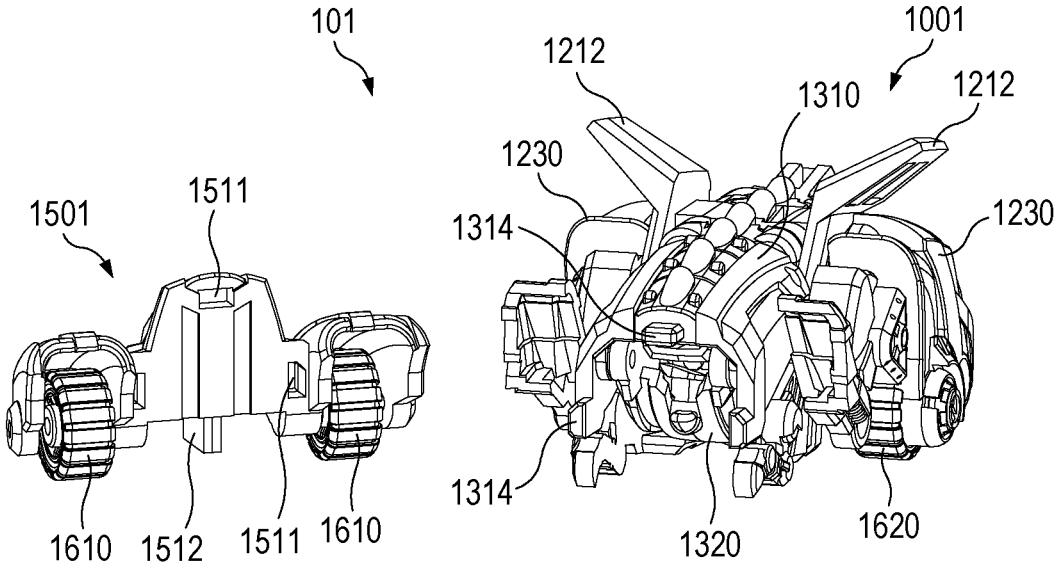
FIG. 11 is a perspective view showing a transformable body and an accessory body separated from each other in the transformable toy according to the first embodiment.

Referring to FIGS. 3 and 4, the transformable toy 101 includes an accessory body 1501 removably coupled to the transformable body 1001. The accessory body 1501 may be removably coupled to the first position of the transformable body 1001 (e.g., a portion of the transformable body in the third direction D3) in the first state of the transformable body 1001. The accessory body 1501 may be releasably coupled to the transformable body 1001 at the second position different from the first position (e.g., a portion of the transformable body in the fourth direction D4) in the second state of the transformable body 1001. The accessory body 1501 is removably coupled to the front end of the transformable body 1001 in the first state of the transformable body 1001. For example, the accessory body 1501 may have a shape of a front part of a vehicle including front wheels. Further, a portion of an upper surface of the accessory body 1501 may have a shape like a canopy covering a cockpit The accessory body 1501 is removably coupled to the front transformation portion 1300. Referring to FIGS. 3 and 11, the link portion 1310 has a plurality of fitting protrusions 1314 protruding frontward from a front edge, and the accessory body 1501 has fitting holes 1511 into which the respective fitting protrusions 1314 are fitted respectively. In the first state of the transformable body 1001, the fitting protrusions 1314 are fitted into the fitting holes 1511, whereby the accessory body 1501 can be removably coupled to the link portion 1310 of the front transformation portion. Further, as shown in FIGS. 3 and 4, the frame portion 1100 has a fitting hole 1151 in the upper surface in the vicinity of the rear end, and the accessory body 1501 has a fitting protrusion 1512 protruding downward. In the second state of the transformable body 1001, the accessory body 1501 can be releasably coupled to the upper surface in the vicinity of the rear end of the frame portion 1100 through the fitting between the fitting protrusion 1512 and the fitting hole 1151.

The transformable body 1001 takes a shape different from the appearance of the model toy 201 in the first state. The second state of the transformable body 1001 of this embodiment has a form corresponding to a shape of a vehicle (see FIG. 1). For the vehicle form of the transformable body 1001, the transformable body 1001 includes a plurality of wheels for movement on the ground in the first state. In this embodiment, the transformable body 1001 includes front wheels 1610 rotatably coupled to the accessory body 1501 and rear wheels 1620 rotatably coupled to the respective rear edges of the rotation portions 1230 of the left and right transformation portions 1201 and 1202. If the transformable body 1001 is transformed from the second state to the first state, the front wheels 1610 and the rear wheels 1620 can be placed on the ground. In the first state of the transformable body 1001, the rotation portions 1230 are rotated to the traveling position parallel to the ground, and the accessory body 1501 is coupled to the front transformation portion 1300. Therefore, the front wheels 1610 and the rear wheels 1620 can be placed on the ground.

A transformation example of the transformable toy according to this embodiment and a coupling example of the transformable toy and the model toy are described with reference to FIGS. 11 to 18.

Referring to FIG. 11, in the first state of the transformable body 1001, the accessory body 1501 is separated from the transformable body 1001. The accessory body 1501 is kept in waiting to be coupled to the transformable body 1001 in the second state of the transformable body 1001.

Figure 12:
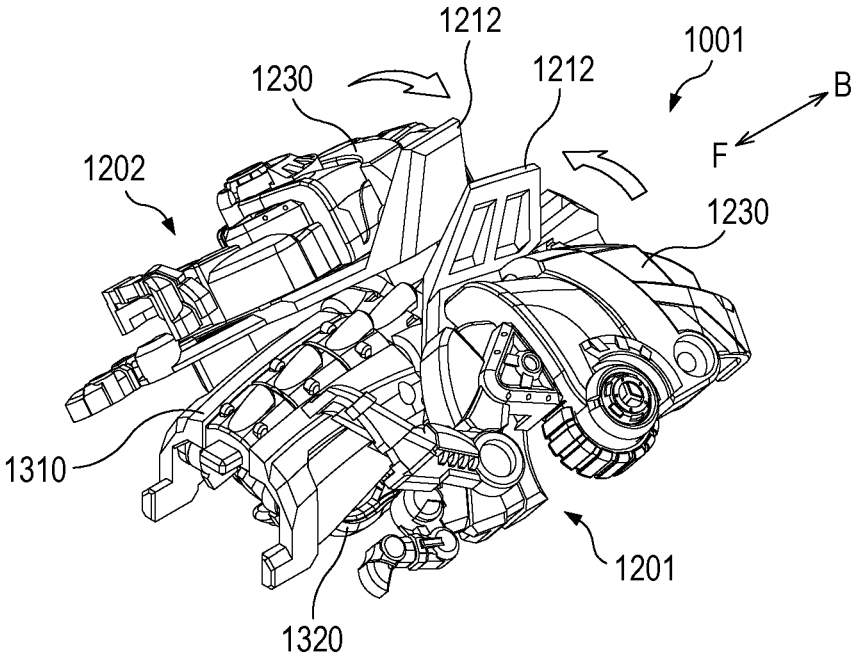
FIG. 12 is a perspective view showing a first example where the transformable body of the transformable toy according to the first embodiment is transformed.

Next, referring to FIG. 12, if an external force is applied to the manipulation portions 1212 in a direction in which the manipulation portions 1212 are moved toward each other, the left and right transformation portions 1201 and 1202 are rotated to the insertion position in two different directions (i.e., clockwise and counterclockwise with respect to the frame portion 1100) and are moved away from each other. Therefore, the distal end portion 1320 gripped by the left and right transformation portions 1201 and 1202 is released from the left and right transformation portions 1201 and 1202.

Figure 13:
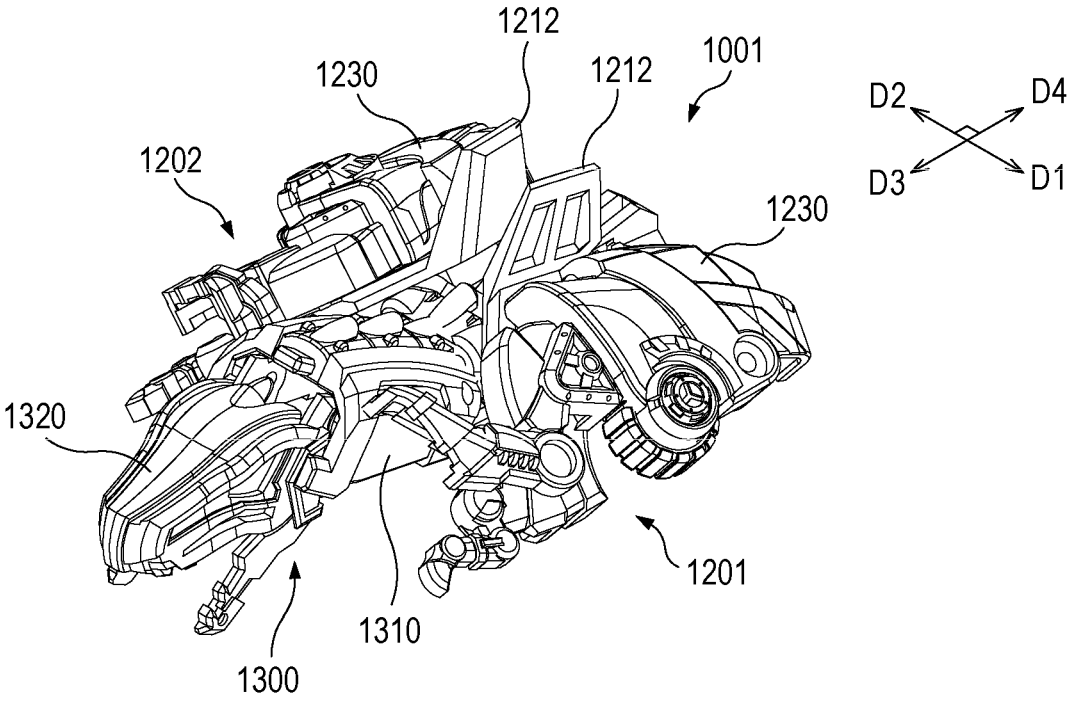
FIG. 13 is a perspective view showing a second example where the transformable body of the transformable toy according to the first embodiment is transformed.
Figure 14:
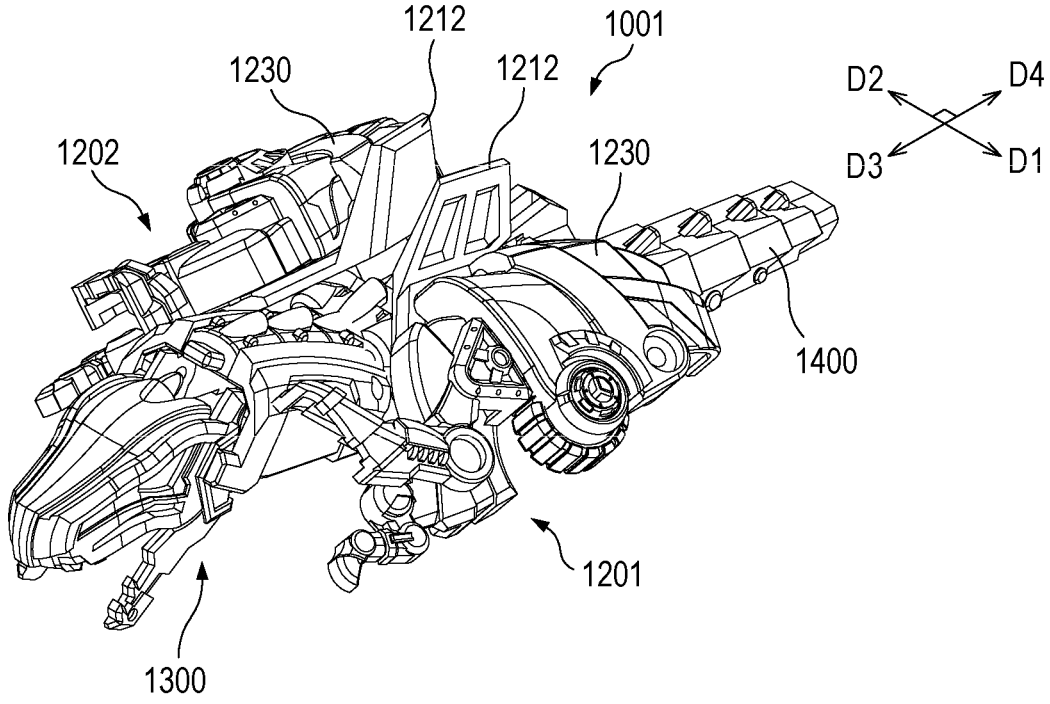
FIG. 14 is a perspective view showing a third example where the transformable body of the transformable toy according to the first embodiment is transformed.
Figure 15:
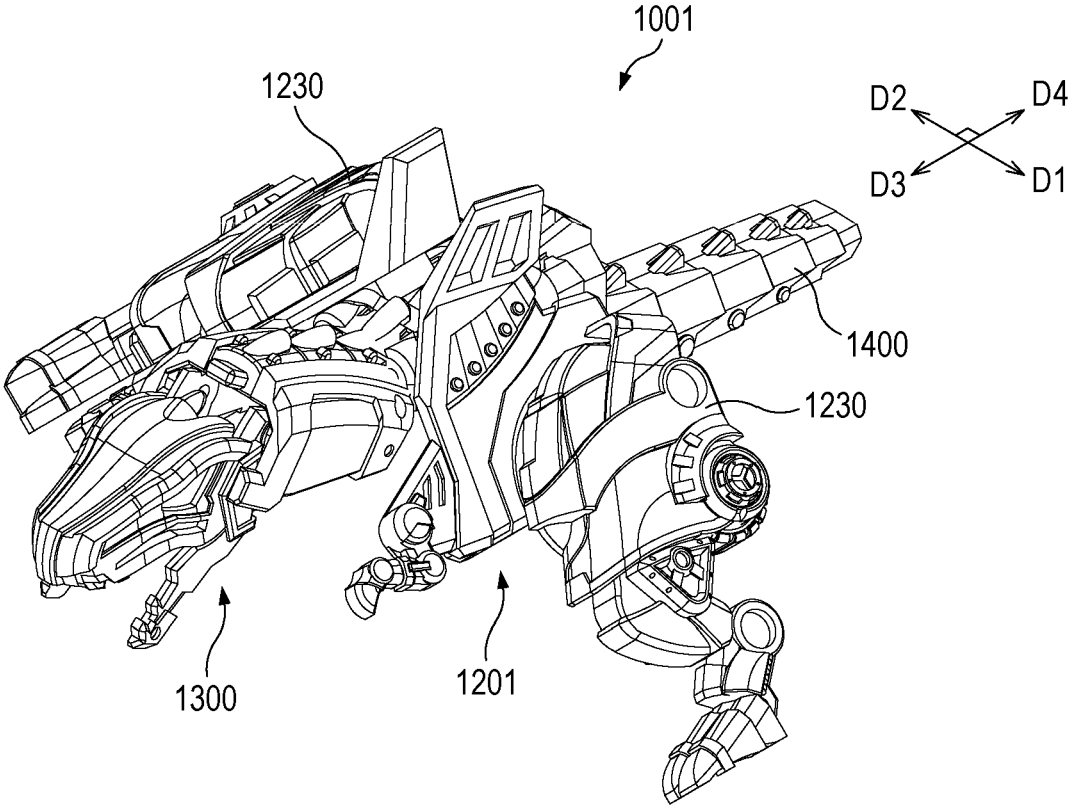
FIG. 15 is a perspective view showing a fourth example where the transformable body of the transformable toy according to the first embodiment is transformed.

Next, referring to FIG. 13, the distal end portion 1320 is rotated in the front direction, and the link portion 1310 is rotated upward. Therefore, the front transformation portion 1300 is rotated into the second state of the transformable body. Next, referring to FIG. 14, the rear transformation portion 1400 is rotated in the rear direction into the second state of the transformable body. Next, referring to FIG. 15, the rotation portions 1230 of the left and right transformation portions 1201 and 1202 are rotated from the traveling position and are positioned at the upright position. Therefore, the transformable body 1001 comes into the state where the left and right transformation portions 1201 and 1202 are moved away from each other and the front transformation portion 1300, the rear transformation portion 1400, and the rotation portions 1230 are unfolded.

Figure 16:
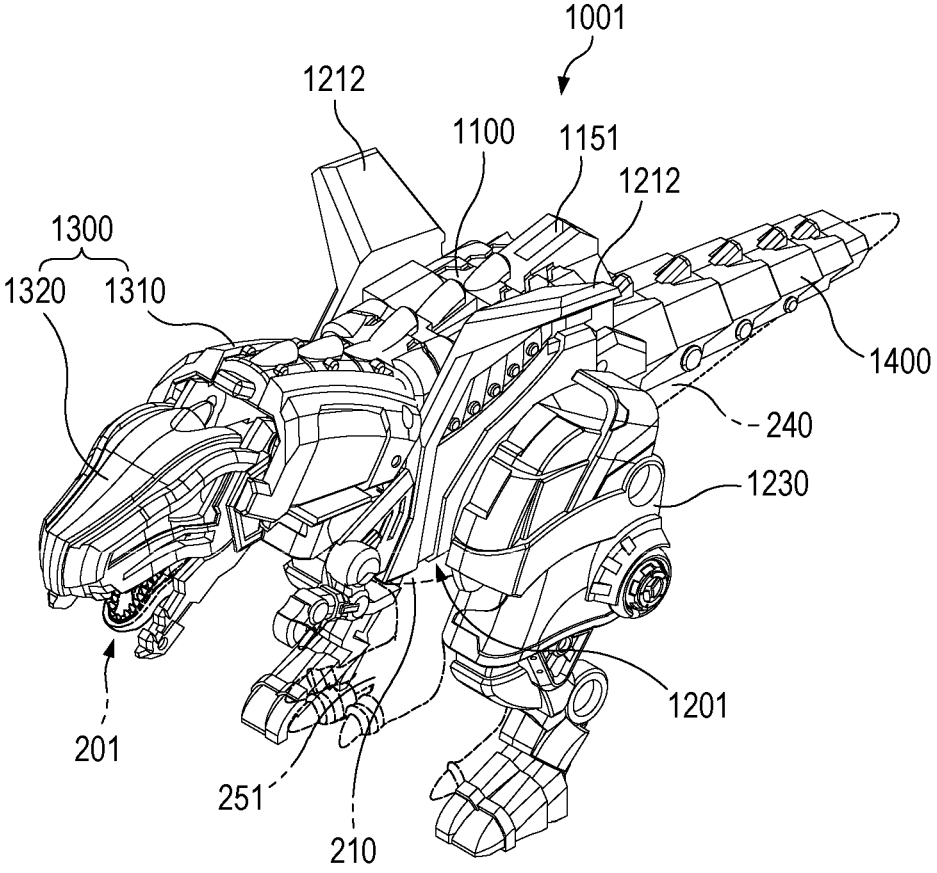
FIG. 16 is a perspective view showing a combination formed by coupling the transformable body of the transformable toy according to the first embodiment to a model toy.
Figure 17:
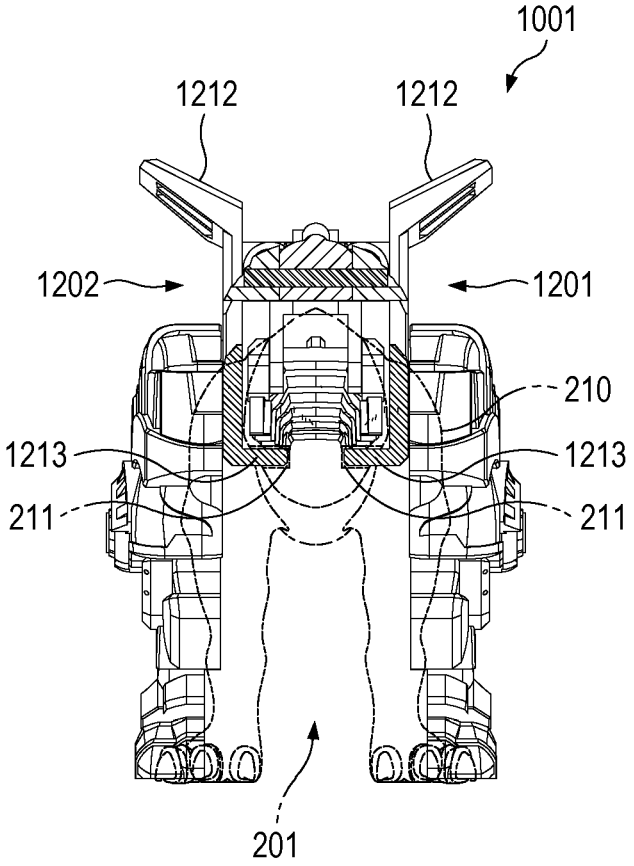
FIG. 17 is a cross-sectional view of the combination of the transformable body of the transformable toy and the model toy shown in FIG. 16.

Next, referring to FIGS. 16 and 17, the user inserts the torso portion 210 of the model toy 201 between the left and right transformation portions 1201 and 1202, which are moved away from each other to the insertion position by the manipulation portions 1212 (i.e., between the engaging portions moved away from each other). As the user releases the manipulation portions 1212, the left and right transformation portions 1201 and 1202 are rotated to the cover position by the biasing force of the torsion springs so as to be moved toward each other. Thus, the transformable body 1001 may be temporarily fixed to the model toy 201. Thereafter, the transformable body 1001 and the model toy 201 may be moved relatively such that the engaging portions 1213 of the left and right transformation portions 1201 and 1202 are engaged with the counter engaging portions 211 of the torso portion 210. If the user performs the coupling between the engaging portions 1213 of the left and right transformation portions 1201 and 1202 and the counter engaging portions 211 of the torso portion 210 at once, it is not necessary to perform the relative movement between the transformable body 1001 and the model toy 201. When the engaging portions 1213 of the left and right transformation portions 1201 and 1202 are engaged with the counter engaging portions 211, mounting of the transformable body 1001 transformed to the second state on the model toy 201 can be completed, and the transformable body 1001 comes into the second state where the transformable body is releasably coupled to the model toy 201 and covers the model toy 201. In the state where the left and right transformation portions 1201 and 1202 grip the torso portion 210, the frame portion 1100 and the left and right transformation portions 1201 and 1202 cover the torso portion 210 of the model toy, the front transformation portion 1300 covers the head extension portion of the model toy, the rear transformation portion 1400 covers the tail extension portion of the model toy, and the rotation portions 1230 cover the hind leg extension portions of the model toy.

Figure 18:
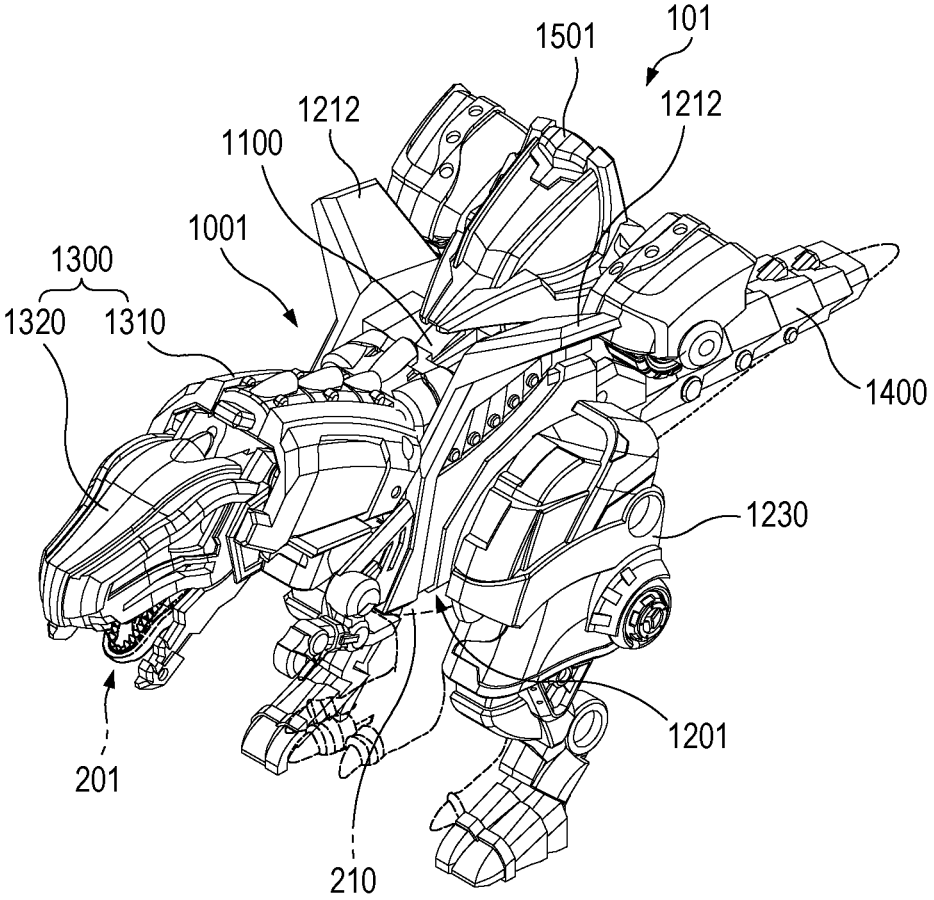
FIG. 18 is a perspective view showing that the accessory body shown in FIG. 11 is coupled to the combination shown in FIG. 17.

Next, as shown in FIG. 18, in the state where the transformable body 1001 is mounted on the model toy 201, the accessory body 1501 can be coupled to the upper surface in the vicinity of the rear end of the frame portion 1100.

The procedures in which the transformable body 1001 is transformed from the second state to the first state may be reversed from the above-described procedures. If the transformable body 1001 is transformed from the second state to the first state, the transformable body 1001 takes the form of the vehicle shown in FIG. 1. From the vehicle-shaped form of the transformable body 1001, the user can have fun that the transformable toy before being combined with the model toy takes a vehicle form different from the model toy and can travel.

When the transformable body 1001 is reversibly transformed into the first state and the second state, the user can easily rotate the left and right transformation portions 1201 and 1202 so as to move them away from each other through a motion of pinching the manipulation portions 1212. That is, the left and right transformation portions 1201 and 1202 are transformed into the second state so as to cover the model toy or transformed into the first state independent from the model, by being rotated in two different directions in the state where the model toy is interposed between the left and right transformation portions. Accordingly, the transformable body 1001 can be transformed with a simple structure and a simple manipulation manner so as to be mounted on the model toy 201 or detached from the model toy 201.

As shown in FIGS. 2 and 18, in the second form of the transformable toy and the second state where the transformable body 1001 covers the model toy 201, the user can recognize, from the combination of the model toy 201 and the transformable toy 101, that the model toy 201 is wearing a kind of protector (e.g., an armor and helmet) by the frame portion 1100, the left and right transformation portions 1201 and 1202, the rotation portions 1230 of the left and right transformation portions 1201 and 1202, the front transformation portion 1300, and the rear transformation portion 1400. From the combination of the transformable toy 101 and the model toy 201, the user can have novel fun completely different from the fun provided by the separated form of the transformable toy and the model toy, i.e., fun that the transformable toy having the form of the vehicle is transformed so as to become the armor and helmet of the model toy and the model toy is wearing the armor and helmet made by the transformable toy. The first state and the second state of the transformable body 1001 are two distinctive states of the transformable body 1001. The intermediate form, which the transformable body 1001 takes while being reversibly transformed into the first state and the second state, can partially correspond to the shape of the model toy 201. Accordingly, the user can have additional fun from the transformable toy 101 in such an intermediate form.

Figure 19:
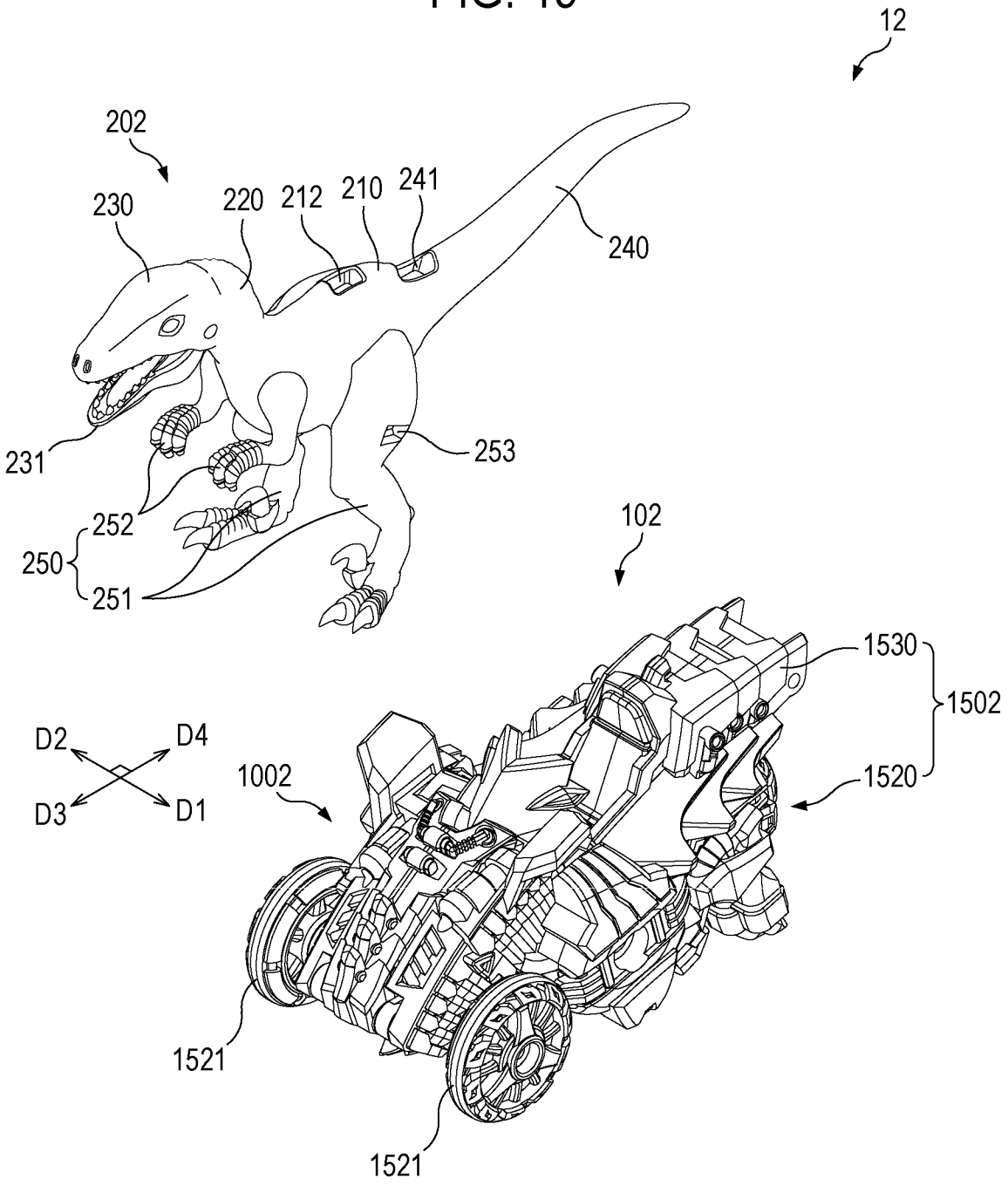
FIG. 19 is a perspective view showing a toy set according to a second embodiment of the present disclosure.
Figure 20:
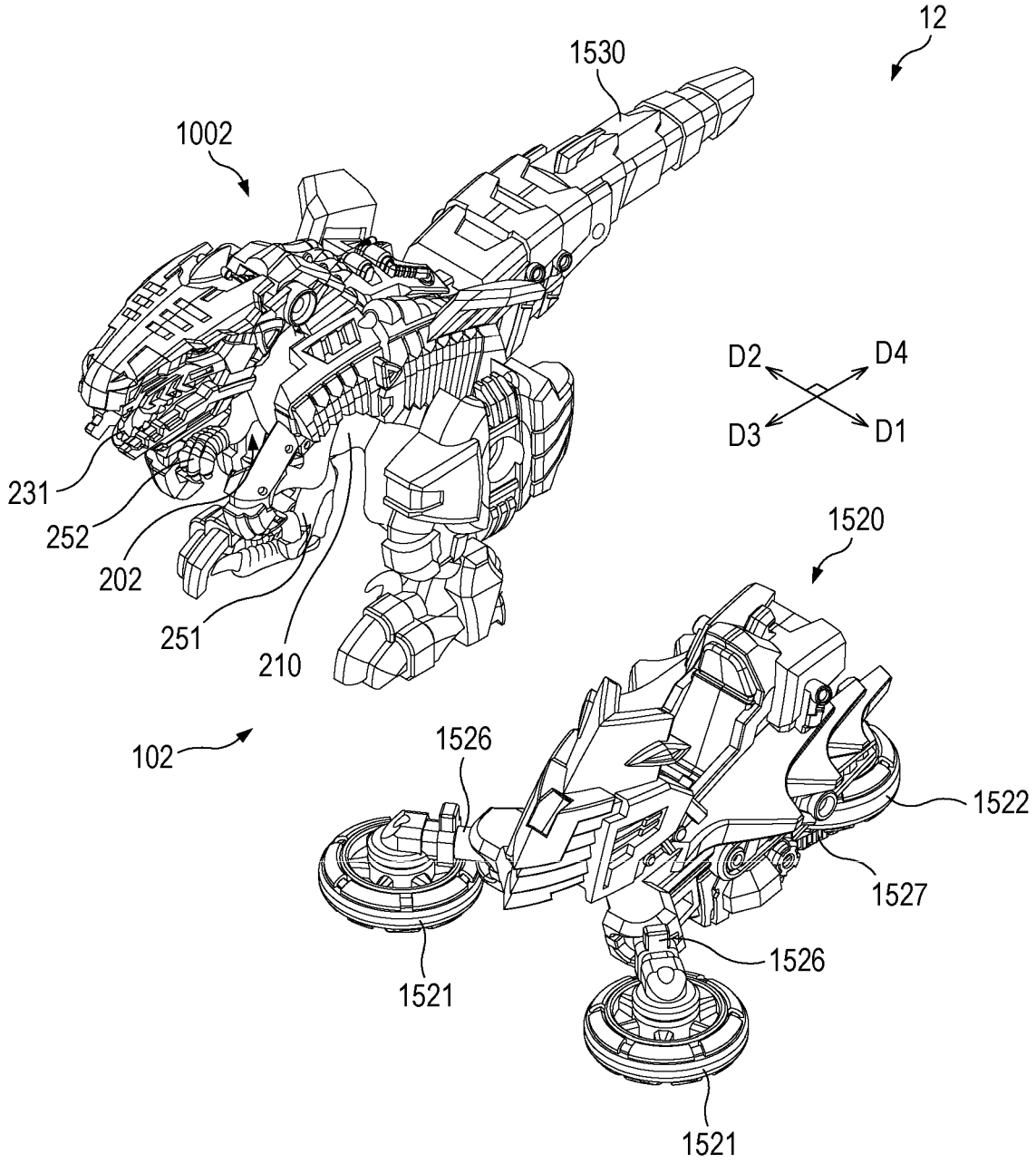
FIG. 20 is a perspective view showing a combination of a model toy and a transformable toy shown in FIG. 19 and a transformed accessory body.
Figure 21:
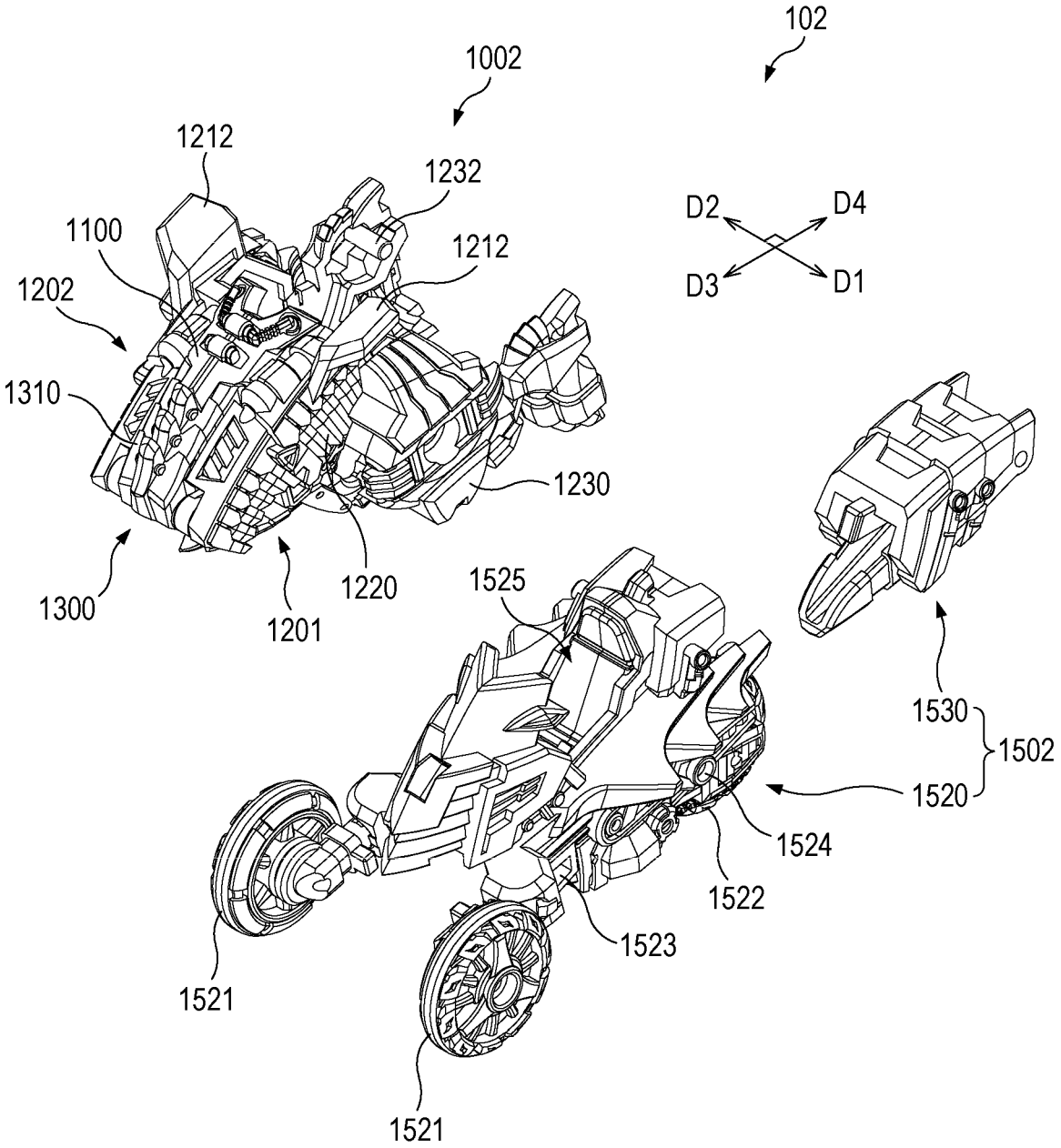
FIG. 21 is a perspective view showing a transformable body and an accessory body of the transformable toy according to the second embodiment.
Figure 22:
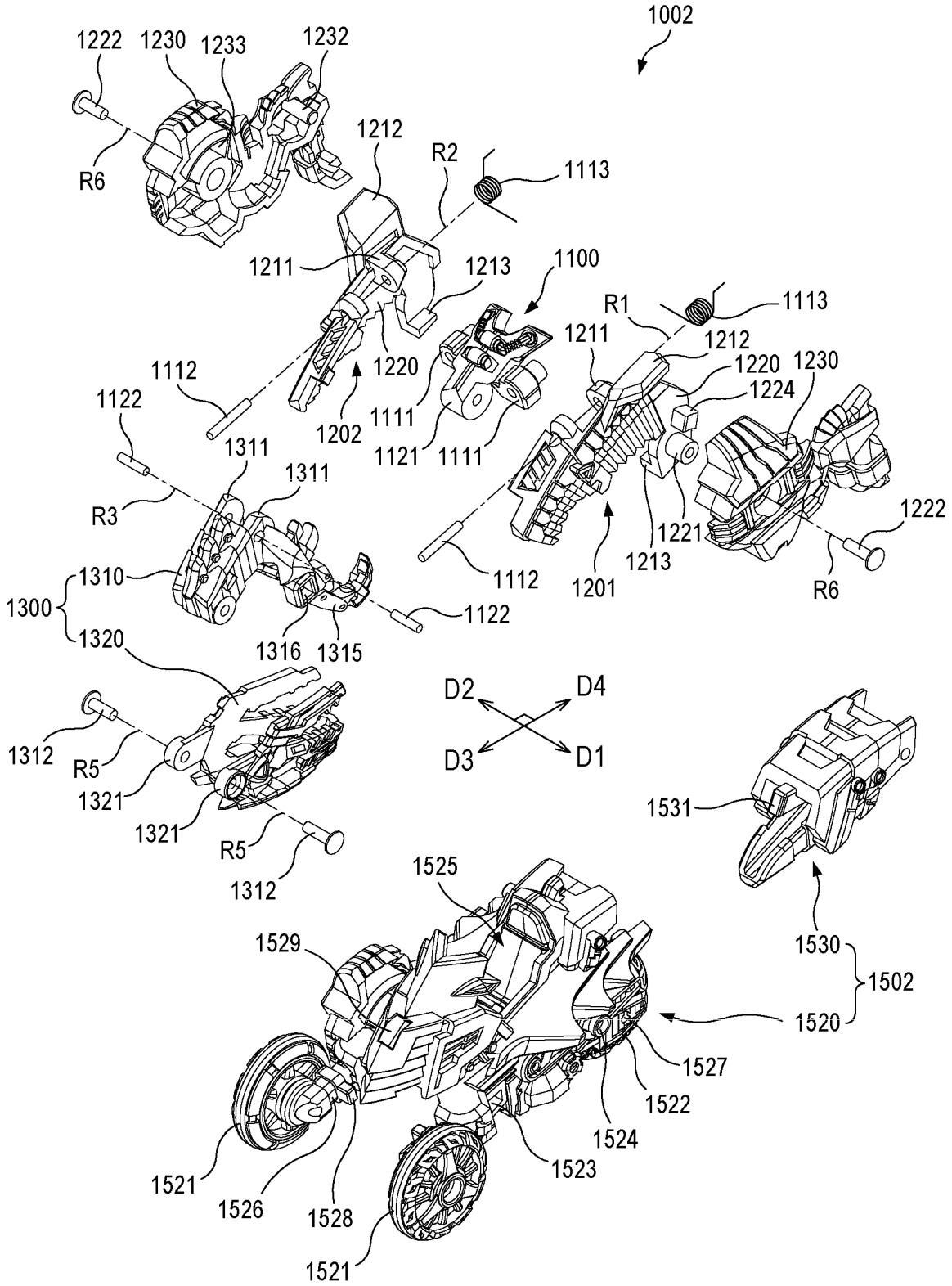
FIG. 22 is an exploded perspective view of the transformable toy shown in FIG. 19.
Figure 23:
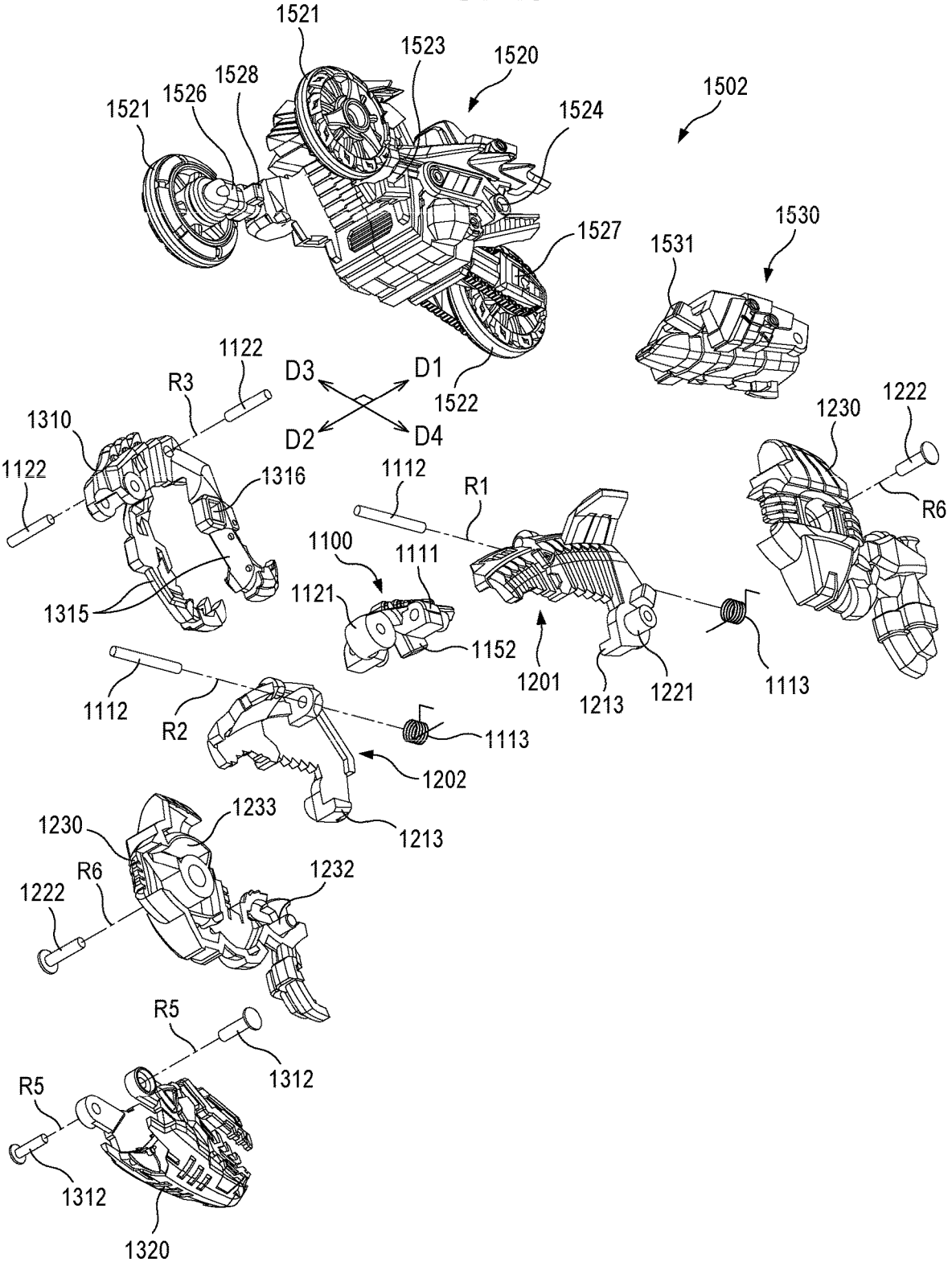
FIG. 23 is another exploded perspective view of the transformable toy shown in FIG. 19.

Hereinafter, a transformable toy 102, a model toy 202, and a toy set 12 according to a second embodiment of the present disclosure are described with reference to FIGS. 19 to 33. FIGS. 19 and 20 show the toy set and the transformable toy according to the second embodiment. FIG. 21 shows a transformable body and an accessory body of the transformable toy according to the second embodiment. FIGS. 22 and 23 are exploded perspective views of the transformable toy shown in FIG. 19. FIGS. 24 to 28 are a plan view, a side view, a front view, a rear view, and a bottom view of the transformable toy shown in FIG. 21, respectively. FIGS. 29 to 33 show examples where the transformable toy according to the second embodiment is transformed and examples where the transformable toy according to the second embodiment is coupled to the model toy.

In the following descriptions related to the second embodiment, components of the second embodiment equivalent or corresponding to those of the foregoing first embodiment are denoted by like reference numerals, and descriptions thereof may be omitted. The components of the second embodiment whose description is omitted can be understood by referring to the description of the first embodiment.

Referring to FIG. 19, the toy set 12 according to the second embodiment includes the transformable toy 102 and the model toy 202. The model toy 202 has an appearance corresponding to a shape of a land animal, for example, an appearance corresponding to a shape of a dinosaur which may be called a raptor.

The model toy 202 has a shape similar to the model toy of the foregoing first embodiment. The model toy 202 has a counter engaging portion 253 formed as a fitting groove in an outward surface of each hind leg extension portion 251. The counter engaging portion 253 functions for releasably coupling the model toy 202 and the transformable toy 102.

Further, a fitting hole 212 is formed in the upper surface of a torso portion 210, and a fitting hole 241 is formed in the upper surface of a tail extension portion 240. The fitting hole 212 and the fitting hole 241 function for coupling a portion of the transformable toy 102 and the model toy 202.

The transformable toy 102 shown in FIG. 19 is independent from the model toy 202. The transformable toy 102 is transformable so as to cover the model toy 202, and is releasably coupled to the model toy 202 in the transformed state. The transformable toy 102 includes a transformable body 1002 configured to be transformed so as to be releasably coupled to the model toy 202, and an accessory body 1502 removably coupled to the transformable body 1002 and configured to partially cover the model toy 202.

Referring to FIG. 20, both the transformable body 1002 of the transformable toy 102 and a portion of the accessory body 1502 of the transformable toy 102 are coupled to the model toy 203, thereby making a combination of the transformable toy and the model toy. Accordingly, the transformable body 1002 is configured to be transformed into a first state where the transformable body is independent from the model toy 202 (the state of the transformable body shown in FIG. 19) and a second state where the transformable body at least partially covers the model toy 202 and is releasably coupled to the model toy 202 (the state of the transformable body shown in FIG. 20). In this embodiment, as shown in FIG. 19, the transformable body 1002 is coupled to the accessory body 1502 in the first state. The transformable body 1002 and the accessory body 1502 coupled to each other have a form corresponding to a vehicle shape, for example, a shape that can be recognized as a motorbike.

Referring to FIGS. 21 to 23, the transformable body 1002 includes a frame portion 1100 that functions as a base or a spine of the transformable body 1002. The frame portion 1100 is configured to cover a portion of the model toy (a back portion of the torso portion of the model toy shown in FIG. 19) in the second state of the transformable body 1002. The frame portion 1100 has, at its lower surface, a fitting protrusion 1152 protruding downward. When the transformable body 1002 in the second state is coupled to the model toy, the fitting protrusion 1152 is fitted into the fitting hole 212 (see FIG. 19) formed in the torso portion of the model toy, whereby the frame portion 1100 can be fixed to the torso portion of the model toy.

Further, the transformable body 1002 includes at least one transformation portion rotatably coupled to the frame portion 1100 and configured to be rotated with respect to the frame portion 1100. The at least one transformation portion of the transformable body 1002 is a structural member for performing transformation of the transformable body into the first state and the second state, and is a structural member coupled to the frame portion 1100 to constitute the transformable body 1002 together with the frame portion 1100. The transformable body 1002 includes, as the at least one transformation portion, left and right transformation portions 1201 and 1202 and a front transformation portion 1300. The left and right transformation portions 1201 and 1202 and the front transformation portion 1300 according to this embodiment are configured to partially cover a portion of the model toy in the second state of the transformable body 1002. The left and right transformation portions 1201 and 1202 and the front transformation portion 1300 are coupled to the frame portion 1100 so as to be rotatable about their respective corresponding rotation axes. Further, for transformation of the transformable body 1002 from one of the first and second states to the other of the first and second states, the left and right transformation portions 1201 and 1202 and the front transformation portion 1300 are configured to be rotated about the respective corresponding rotation axes with respect to the frame portion 1100 or to be rotated in two or more different directions. In addition, for the transformation of the transformable body 1002 from the second state of the transformable body 1002 to the first state, the left and right transformation portions 1201 and 1202 and the front transformation portion 1300 are configured to be folded with respect to the frame portion 1100 about their respective corresponding rotation axes. Therefore, the left and right transformation portions 1201 and 1202 and the front transformation portion 1300 can be manipulated for transformation of the transformable body from one of the first and second states into the other of the first and second states, by being rotated with respect to the frame portion 1100 or being folded with respect to the frame portion 1100.

Referring to FIGS. 21 to 23, the transformable body 1002 includes, as two transformation portions constituting the at least one transformation portion, a left transformation portion 1201 and a right transformation portion 1202 that are configured to be rotated in two different directions with respect to the frame portion 1100.

The left transformation portion 1201 and the right transformation portion 1202 are configured to be rotated in two different directions with respect to the frame portion 1100 (i.e., clockwise and counterclockwise with respect to the frame portion 1100) for transformation of the transformable body from one of the first state shown in FIG. 19 and the second state shown in FIG. 20 to the other of the states. Therefore, the left and right transformation portions 1201 and 1202 are configured to be rotated with respect to the frame portion 1100 about the respective corresponding rotation axes (i.e., the first rotation axis R1 and the second rotation axis R2) so as to be moved away from or moved toward each other. Regarding the rotation of the left and right transformation portions 1201 and 1202, the left transformation portion 1201 is coupled to the frame portion 1100 so as to be rotatable about the first rotation axis R1 (see FIG. 24), and the right transformation portion 1202 is coupled to the frame portion 1100 so as to be rotatable about the second rotation axis R2 (see FIG. 24). The second rotation axis R2 is spaced apart from the first rotation axis R1 and may be parallel to the first rotation axis R1 or inclined toward the first rotation axis R1.

The first rotation axis R1 passes through a portion of the frame portion 1100 in the first direction D1, and the second rotation axis R2 passes through a portion of the frame portion 1100 in the second direction D2 opposite to the first direction D1. As an alternative example, the first rotation axis R1 and the second rotation axis R2 may constitute one rotation axis, and the frame portion 1100 may be configured to rotate the left and right transformation portions 1201 and 1202 about one rotation axis in different directions.

The left and right transformation portions 1201 and 1202 are configured to be unfolded with respect to the frame portion 1100 in the second state of the transformable body 1002 and to be folded with respect to the frame portion 1100 in the first state of the transformable body 1002. The left and right transformation portions 1201 and 1202 are unfolded with respect to the frame portion 1100 in the second state of the transformable body 1002 by being rotated in different directions while being moved away from each other with respect to the frame portion 1100. The left and right transformation portions 1201 and 1202 are folded with respect to the frame portion 1100 in the first state of the transformable body 1002 by being rotated in different directions while being moved toward each other with respect to the frame portion 1100.

The left and right transformation portions 1201 and 1202 are configured to cover a portion of the model toy in the second state of the transformable body 1002. The left transformation portion 1201 is configured to cover a portion of the model toy in the first direction D1 (a left side surface of the torso portion and a portion of a left side surface of the hind leg extension portion in the model toy shown in FIG. 19) in the second state of the transformable body 1002. The right transformation portion 1202 is configured to cover another portion of the model toy in the second direction D2 (a right side surface of the torso portion and a portion of a right side surface of the hind leg extension portion in the model toy shown in FIG. 19) in the second state of the transformable body 1002.

Accordingly, the left and right transformation portions 1201 and 1202 can be rotated about the first and second rotation axes R1 and R2, respectively, in the transformable body 1002 so as to be moved away from or toward each other. Specifically, the left and right transformation portions 1201 and 1202 can be rotated to an insertion position where the left and right transformation portions are moved away from each other to allow the torso portion and the hind leg extension portion of the model toy to be inserted between the left and right transformation portions 1201 and 1202, and a cover position where the left and right transformation portions are moved toward each other to cover the torso portion and the hind leg extension portion of the model toy.

The frame portion 1100 and the left and right transformation portions 1201 and 1202 are respectively connected by the above-described first and second hinge joints. The hinge portion 1111 provided at the left side of the frame portion 1100 becomes the portion of the frame portion 1100 in the first direction D1 through which the first rotation axis R1 passes. The hinge portion 1111 provided at the right side of the frame portion 1100 becomes the portion of the frame portion 1100 in the second direction D2 through which the second rotation axis R2 passes. The respective hinge shafts 1112 correspond to the first rotation axis R1 and the second rotation axis R2.

The frame portion 1100 of the transformable body 1002 includes torsion springs 1113 disposed between the frame portion 1100 and each of the left and right transformation portions 1201 and 1202 so as to bias the left and right transformation portions 1201 and 1202 toward the cover position. The left and right transformation portions 1201 and 1202 are biased by the biasing force of the torsion springs 1113 so as to be moved toward each other. Accordingly, the transformable body 1002 can be stably coupled to the model toy in the state where the left and right transformation portions 1201 and 1202 biased toward each other are coupled to the hind leg extension portions of the model toy. Further, by the biasing force of the torsion springs 1113, the rotatable transformation portions of the transformable body 1002 can be stably maintained in the first state of the transformable body 1002. As an alternative example, the transformable body 1002 may include at least one spring disposed between the left and right transformation portions 1201 and 1202.

The torsion springs 1113 are disposed in the respective corresponding rotation axes of the left and right transformation portions 1201 and 1202 to bias one of the left and right transformation portions 1201 and 1202 toward the other. The torsion springs 1113 are disposed between the frame portion 1100 and the left and right transformation portions 1201 and 1202 such that the hinge shafts 1112 pass through the insides of the torsion springs 1113, respectively. For example, one end of each of the torsion springs 1113 may be engaged on the surface of the frame portion 1100, and the other end of each of the torsion springs 1113 may be engaged on the counter hinge portion 1211. The inner surfaces of the left and right transformation portions 1201 and 1202 biased by the torsion springs 1113 make contact with the respective side surfaces of the frame portion 1100, whereby the rotation of the left and right transformation portions 1201 and 1202 toward the inside of the frame portion 1100 can be restricted.

The left and right transformation portions 1201 and 1202 include a manipulation portion 1212. Each the manipulation portion 1212 has a shape that can be recognized as a wing, and is formed as a protrusion protruding from the base end of each of the left and right transformation portions 1201 and 1202. The manipulation portions 1212 extend from the base ends of the left and right transformation portions 1201 and 1202 in an oblique direction between the first direction D1 or the second direction D2 and the upward side. The manipulation portions 1212 may be manipulated to rotate the left and right transformation portions 1201 and 1202 against the biasing force of the torsion springs 1113. The left and right transformation portions 1201 and 1202 can be rotated about the respective corresponding rotation axes (e.g., the first rotation axis R1 and the second rotation axis R2) in the direction of the force applied to the manipulation portions 1212. For example, as the user pinches the pair of manipulation portions 1212 and manipulates the pair of manipulation portions 1212 to move the pair of manipulation portions 1212 toward each other, the left and right transformation portions 1201 and 1202 are moved away from each other and are rotated to the insertion position. In the state where the left and right transformation portions 1201 and 1202 are moved away from each other by the pair of manipulation portions 1212, the torso portion and the hind leg extension portions of the model toy can be inserted between the left and right transformation portions 1201 and 1202. Thereafter, as the manipulation portions 1212 are released, the left and right transformation portions 1201 and 1202 are moved toward each other by the biasing force of the torsion springs 1113 and can cover the torso portion and the hind leg extension portions of the model toy.

In this embodiment, the left and right transformation portions 1201 and 1202 are configured to grip the model toy. With regard to the gripping of the model toy, the left and right transformation portions 1201 and 1202 include an engaging portion 1213 which protrudes from the distal end of each of the left and right transformation portions and is formed as a male engaging portion such as a protrusion or a pin. Further, the model toy includes, at each of the left and right surfaces of the hind leg extension portions, a counter engaging portion 253 (see FIG. 19) that is configured to be complementarily coupled to the engaging portion 1213. The counter engaging portions 253 are formed as a female engaging portion such as a concave groove. In the second state of the transformable body 1002, the engaging portions 1213 are fitted to the counter engaging portions 253 in the first direction D1 or the second direction D2. Therefore, the transformable body 1002 transformed into the second state can be coupled to the model toy while the left and right transformation portions 1201 and 1202 cover the torso portion of the model toy and releasably grip the hind leg extension portions of the model toy.

The left and right transformation portions 1201 and 1202 releasably couple the transformable body 1002 transformed into the second state to the model toy, and cover the torso portion of the model toy and portions of the hind leg extension portions of the model toy. If the transformable body 1002 transformed into the second state is coupled to the model toy, the left and right transformation portions 1201 and 1202 cover a portion of the model toy. Accordingly, the left and right transformation portions 1201 and 1202 can be recognized by the user as a portion of a kind of protector (an armor) that covers the model toy.

The transformable body 1002 includes, as the at least one transformation portion, a front transformation portion 1300. The front transformation portion 1300 is coupled to the frame portion 1100 so as to be rotatable about its corresponding rotation axis, i.e., the third rotation axis R3 (see FIG. 24). The third rotation axis R3 passes through a portion of the frame portion 1100 (the front end portion of the frame portion) in the third direction D3 orthogonal to the first direction D1 and the second direction D2. In the second state of the transformable body 1002, the front transformation portion 1300 is configured to cover another portion of the model toy (e.g., the neck extension portion and the head extension portion of the model toy shown in FIG. 19) that extends in the third direction D3 from the portion of the model toy covered by the frame portion 1100 (e.g., the torso portion of the model toy shown in FIG. 19).

Figure 24:
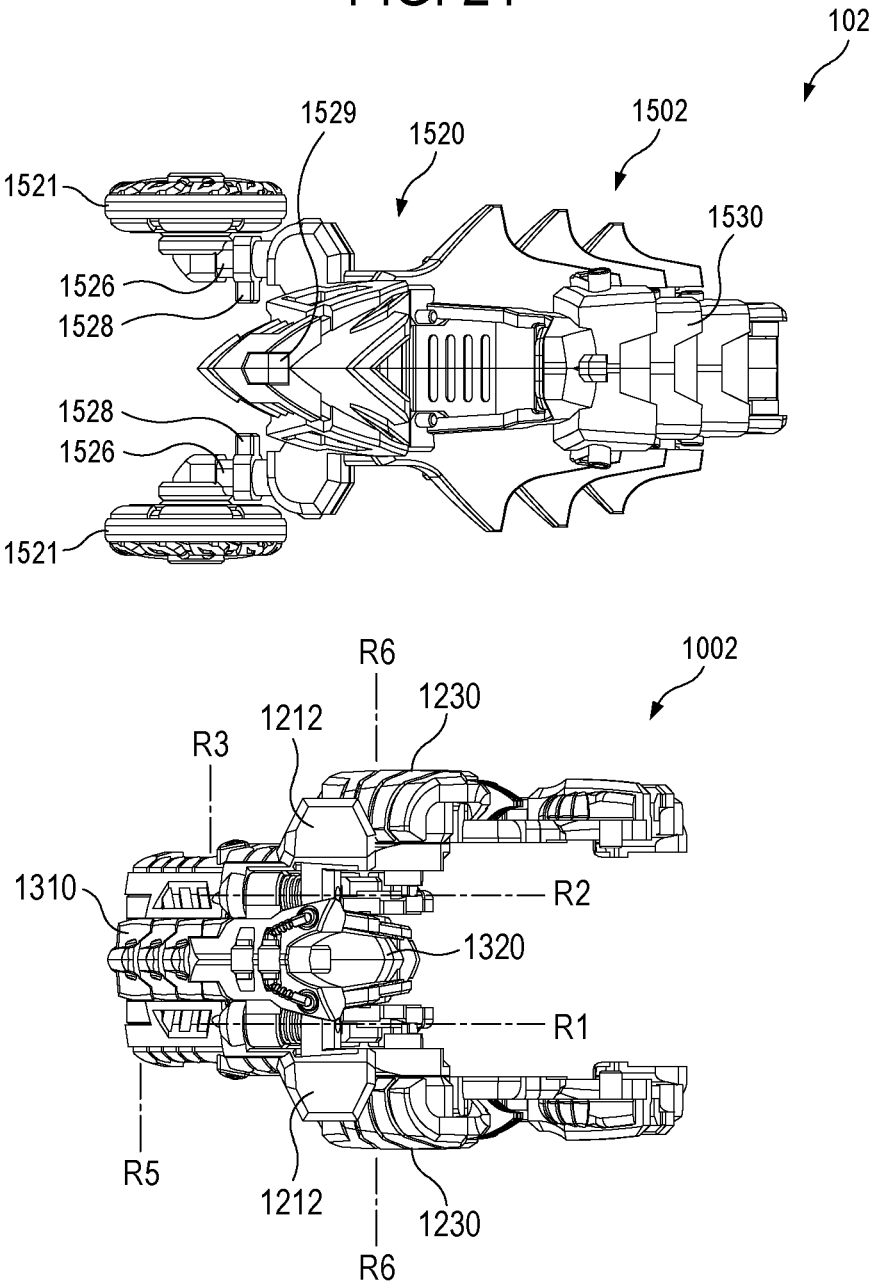
FIG. 24 is a plan view of the transformable toy shown in FIG. 21.
Figure 25:
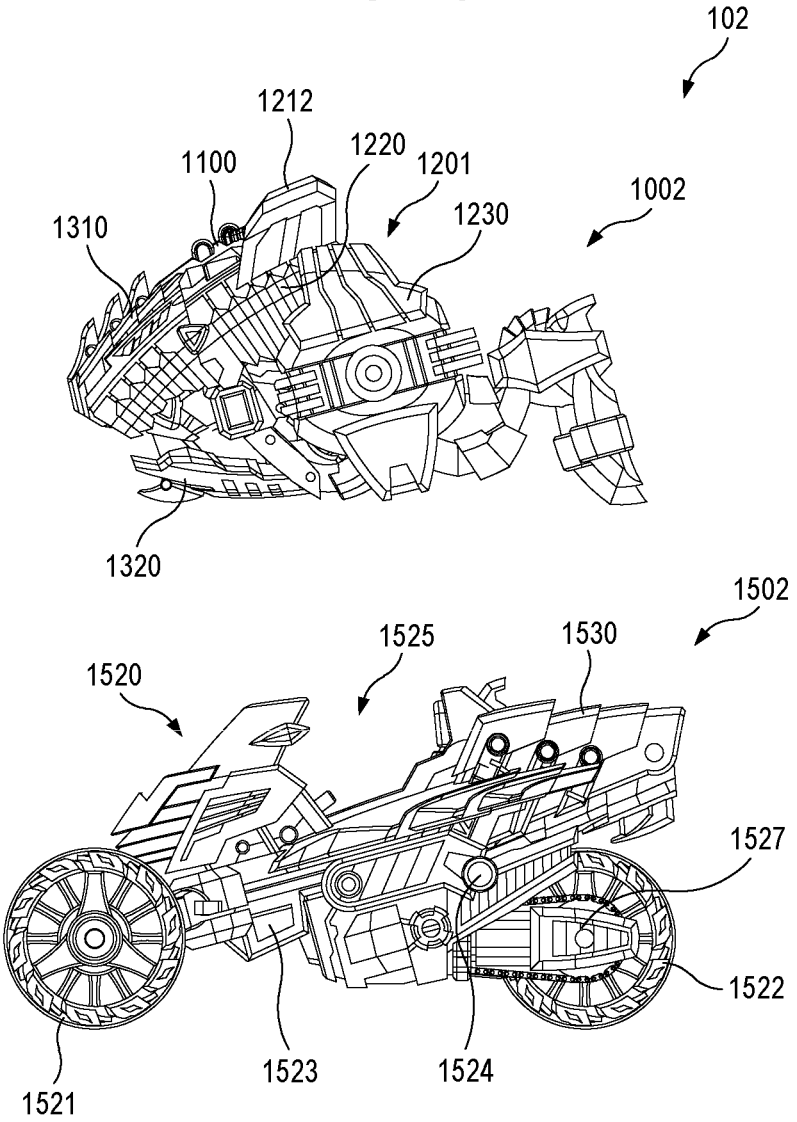
FIG. 25 is a side view of the transformable toy shown in FIG. 21.
Figure 26:
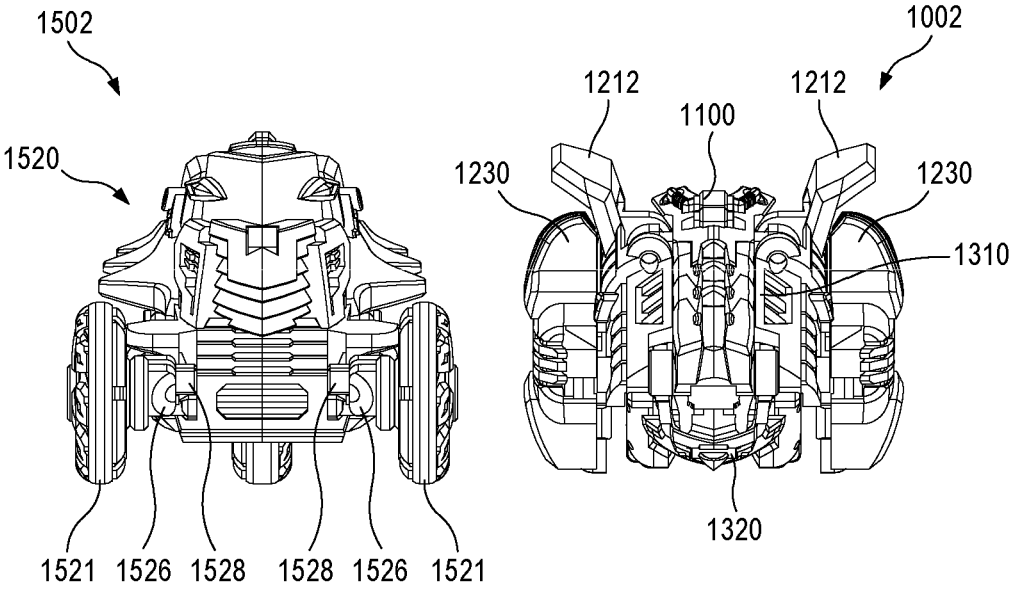
FIG. 26 is a front view of the transformable toy shown in FIG. 21.

In this embodiment, the front transformation portion 1300 includes a link portion 1310 coupled to the frame portion 1100 so as to be rotatable about the third rotation axis R3, and a distal end portion 1320 coupled to the front end of the link portion 1310 so as to be rotatable about a fifth rotation axis R5 (see FIG. 24). The link portion 1310 is configured to partially cover the neck extension portion of the model toy (see FIG. 19). The distal end portion 1320 is configured to partially cover the head extension portion and the chin portion of the model toy (see FIG. 19), and has a shape that can be recognized by the user as a helmet form covering the head extension portion.

The frame portion 1100 and the link portion 1310 are connected by the above-described third hinge joint that may be composed of a hinge portion 1121 provided at the front end of the frame portion 1100, a counter hinge portion 1311 provided at the rear end of the link portion 1310, and a hinge shaft 1122 passing through the hinge portion 1121 and the counter hinge portion 1311. The link portion 1310 can be rotated upward and downward with respect to the frame portion 1100. The rear end surface of the link portion 1310 in the vicinity of the counter hinge portion 1311 makes contact with the front end surface of the frame portion 1100, whereby the downward rotation of the link portion 1310 can be restricted. A portion of the rear end surface of the counter hinge portion 1311 makes contact with the upper surface in the vicinity of the front end of the frame portion 1100, whereby the upward rotation of the link portion 1310 can be restricted.

The link portion 1310 has a pair of extension portions 1315 extending downward at the rear end thereof. Each extension portion 1315 is configured to partially cover the front leg extension portion of the model toy (see FIG. 19), and can make contact with the front surface of each of the left and right transformation portions 1201 and 1202 at an upper surface of a portion thereof. A fitting hole 1316 is formed in each of the pair of extension portions 1315. When the accessory body 1502 and the transformable body 1002 are coupled in the first state of the transformable body 1002, a portion of the accessory body 1502 is fitted into the fitting hole 1316.

The distal end portion 1320 can be rotated and then inserted between the pair of extension portions 1315 in the first state of the transformable body 1002. The link portion 1310 and the distal end portion 1320 are connected by the above-described fifth hinge joint that may be composed of a hinge portion 1321 provided at the rear end of the distal end portion 1320, and a hinge shaft 1312 passing through the front end portion of the link portion 1310 and the hinge portion 1321.

In this embodiment, each of the left and right transformation portions 1201 and 1202 includes a support portion 1220 and a rotation portion 1230 rotatably coupled to the support portion 1220.

The support portion 1220 has a predetermined shape and may constitute a main body of each of the left and right transformation portions 1201 and 1202. The support portion 1220 may function as a support which rotatably supports the rotation portion 1230 and supports the frame portion 1100 and the model toy with respect to the rotation centers of the left and right transformation portions 1201 and 1202. The support portion 1220 is configured to cover a portion of the lateral surface of the torso portion of the model toy in the second state of the transformable body 1002. Since the support portion 1220 is provided with the counter hinge portion 1211, the respective corresponding rotation axes (i.e., the first rotation axis R1 and the second rotation axis R2) of the left and right transformation portions 1201 and 1202 are disposed in the support portion 1220. The rotation portion 1230 is configured to partially cover the hind leg extension portion of the model toy (see FIG. 19) in the second state of the transformable body 1002. In this embodiment, in the first state of the transformable body 1002, the rotation portion 1230 can be located at a coupling position where the rotation portion is substantially parallel to the ground and is coupled to the accessory body 1502. In the second state of the transformable body 1002, the rotation portion 1230 can be located at an upright position where the rotation portion is substantially perpendicular to the ground.

Figure 27:
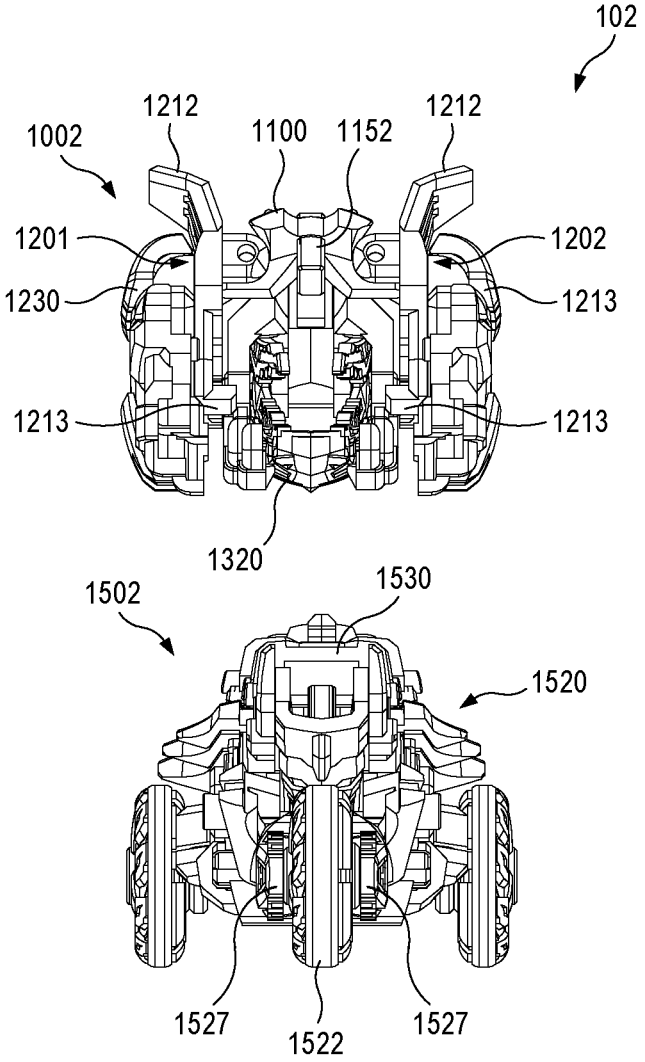
FIG. 27 is a rear view of the transformable toy shown in FIG. 21.
Figure 28:
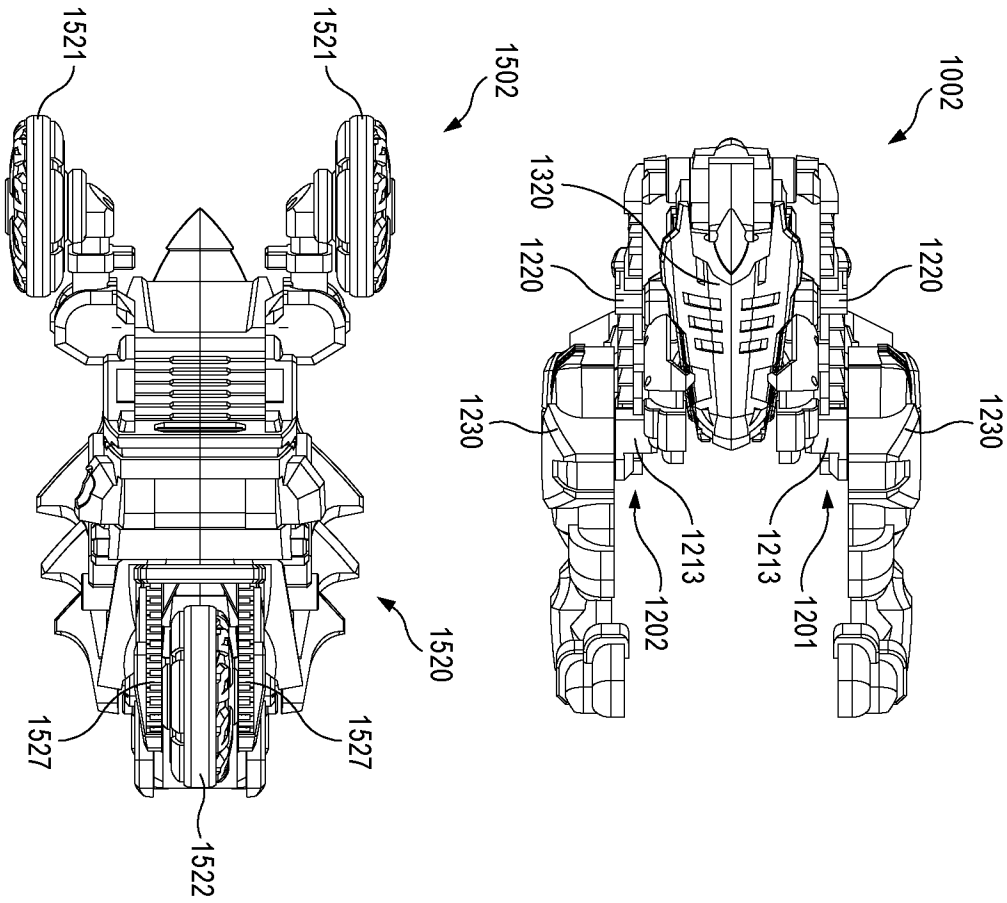
FIG. 28 is a bottom view of the transformable toy shown in FIG. 21.

The rotation portion 1230 is coupled to the support portion 1220 so as to be rotatable about a sixth rotation axis R6 (see FIG. 27). A distal end portion of the rotation portion 1230 is formed to correspond to a shape of a foot of the hind leg extension portion of the model toy. A fitting protrusion 1232 protruding inward is formed at the distal end portion of the rotation portion 1230, and the fitting protrusion 1232 is fitted to a portion of the accessory body 1502 at the coupling position of the rotation portion 1230. The support portion 1220 and the rotation portion 1230 are connected by the above-described sixth hinge joint that may be composed of a hinge portion 1221 protruding downward and laterally from the rear end of the support portion 1220, and a hinge shaft 1222 coupled to the hinge portion 1221 through the rotation portion 1230 in the vicinity of the base end of the rotation portion 1230. A stopper portion 1224 protrudes in the vicinity of the hinge portion 1221, and an arc-shaped groove 1233 into which the stopper portion 1224 is inserted is formed in the rotation portion 1230. The stopper portion 1224 makes contact with one end of the groove 1233, whereby the rotation portion 1230 can be restricted to the upright position perpendicular to the ground.

In this embodiment, the accessory body 1502 removably coupled to the transformable body 1002 includes an accessory transformable body 1520 and an accessory covering portion 1530. The accessory transformable body 1520 is removably coupled to a first position of the transformable body 1002 in the first state of the transformable body 1002 and is configured to be transformable independently of the transformable body 1002. The accessory covering portion 1530 is removably coupled to the accessory transformable body 1520. In the second state of the transformable body 1002, the accessory covering portion 1530 is releasably coupled to a portion of the model toy, specifically the tail extension portion of the model toy (see FIG. 19) and partially covers the tail extension portion.

The accessory transformable body 1520 may have a form corresponding to a shape that can be recognized by the user as a vehicle, for example, a shape that can be recognized as a motorbike. That is, the accessory transformable body 1520 has a pair of front wheels 1521 and one rear wheel 1522. Since the transformable body 1002 is coupled to the accessory transformable body 1520 in the first state, the coupled transformable body 1002 and accessory transformable body 1520 have the form corresponding to a shape of a motorbike in the first state of the transformable body 1002. The rotation portions 1230 are rotated to the coupling position in the first state of the transformable body 1002 such that the front wheels 1521 and the rear wheel 1522 can be placed on the ground in the first state of the transformable body 1002. In the first state of the transformable body 1002, the rotation portions 1230 are maintained in the state parallel to the ground. Therefore, the front wheels 1521 and the rear wheel 1522 can be placed on the ground.

The accessory transformable body 1520 has a fitting hole 1523 in each side surface thereof, and the engaging portion 1213 of each of the left and right transformation portions 1201 and 1202 is releasably fitted to the fitting hole 1523. Therefore, the accessory transformable body 1520 is configured to be engaged with the left and right transformation portions 1201 and 1202 that are moved toward each other in the first state of the transformable body 1002. That is, the left and right transformation portions 1201 and 1202 moved toward each other is configured to grip the accessory transformable body 1520 in the first state of the transformable body 1002. Further, the accessory transformable body 1520 has a fitting hole 1524 in each side surface thereof, and the fitting protrusion 1232 of the rotation portion 1230 of the transformable body 1002 is fitted to the fitting hole 1524 in the first state of the transformable body 1002.

The accessory transformable body 1520 has, at its upper side, a recess portion 1525 that can be recognized by the user as a driver's seat. Further, the accessory transformable body 1520 has a pair of front arms 1526 at its front end portion, and a pair of rear arms 1527 at its lower end portion. The pair of front arms 1526 are rotatably coupled to the front end portion of the accessory transformable body 1520 in a ball-socket coupling manner. Therefore, the pair of front arms 1526 are rotatable with respect to the accessory transformable body 1520 so as to be moved away from or moved toward each other, and are rotatable with respect to the accessory transformable body 1520 about an axis of each front arm. A fitting protrusion 1528 is formed in each front arm 1526. In the first state of the transformable body 1002, the fitting protrusion 1528 is fitted into the fitting hole 1316 of the link portion 1310.

The front wheel 1521 of the accessory transformable body 1520 is rotatably coupled to a distal end of each front arm 1526, and the rear wheel 1522 of the accessory transformable body 1520 is rotatably coupled to a distal end of each rear arm 1527. The rear arms 1527 are connected to each other, and are rotatable with respect to the accessory transformable body 1520 in the state of holding the rear wheel 1522 therebetween. As shown in FIG. 20, when the accessory transformable body 1520 is transformed such that the front wheels 1521 and the rear wheel 1522 are rotated in parallel with the ground, the accessory transformable body 1520 can give the user fun that the accessory transformable body 1520 can be transformed into a flight-capable transport machine. A fitting hole 1529 is formed in the vicinity of the front end of the accessory transformable body 1520, and the fitting protrusion 1152 of the frame portion 1100 is fitted into the fitting hole 1529. Thus, when the accessory transformable body 1520 is coupled to the transformable body in the first state of the transformable body, the frame portion 1100 of the transformable body can be fixed to the accessory transformable body 1520.

The accessory covering portion 1530 may be removably fitted to an upper rear portion of the accessory transformable body 1520. The accessory covering portion 1530 has a fitting protrusion 1531 at its front end. By fitting the fitting protrusion 1531 into the fitting hole 241 (see FIG. 19) of the tail extension portion of the model toy, the accessory covering portion 1530 can be coupled to the tail extension portion so as to cover the tail extension portion. The accessory covering portion 1530 may be composed of two members connected by a hinge joint. The two members may be fitted to the upper rear end of the accessory transformable body 1520 in the state where the two members are folded to each other.

Examples where the transformable toy according to this embodiment is transformed and examples where the transformable toy and the model toy are coupled to each other are described with reference to FIGS. 21 and 29 to 33.

As shown in FIG. 21, in the first state of the transformable body 1002, the accessory body 1502 is separated from the transformable body 1002. For example, as the left and right transformation portions 1201 and 1202 release the accessory body 1502 by the manipulation on the manipulation portions 1212, the accessory body 1502 can be separated from the transformable body 1002. The accessory transformable body 1520 of the accessory body 1502 is separated from the transformable body 1002, and the accessory covering portion 1530 is separated from the accessory transformable body 1520. The accessory covering portion 1530 separated from the accessory transformable body 1520 is kept in waiting for coupling to the tail extension portion of the model toy. Further, the accessory transformable body 1520 separated from the transformable body 1002 can be transformed into the form of a flight-capable transport machine shown in FIG. 20.

Figure 29:
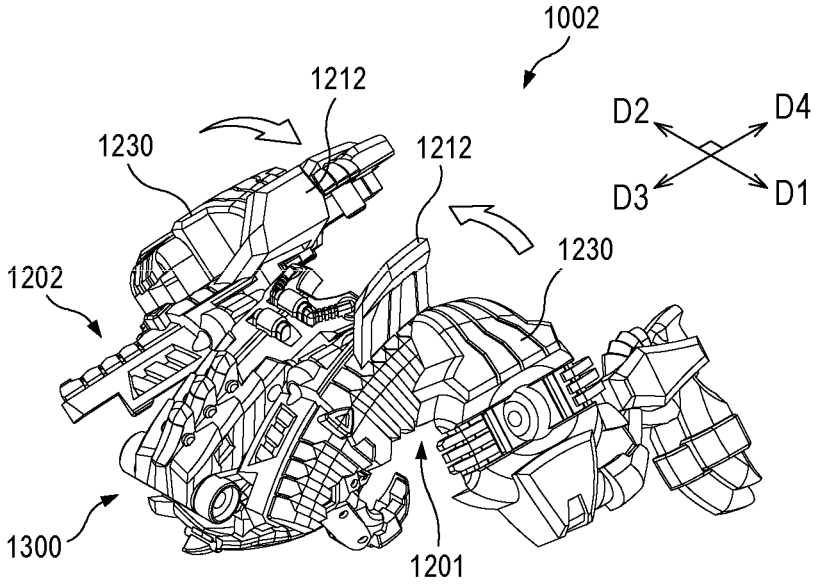
FIG. 29 is a perspective view showing a first example where the transformable body of the transformable toy according to the second embodiment is transformed.

Next, referring to FIG. 29, when an external force is applied to the manipulation portions 1212 in the direction of moving the manipulation portions 1212 toward each other in the transformable body 1002 from which the accessory body is separated (i.e., when the user performs the motion of pinching the manipulation portions 1212), the left and right transformation portions 1201 and 1202 are rotated to the insertion position in different directions and are moved away from each other.

Figure 30:
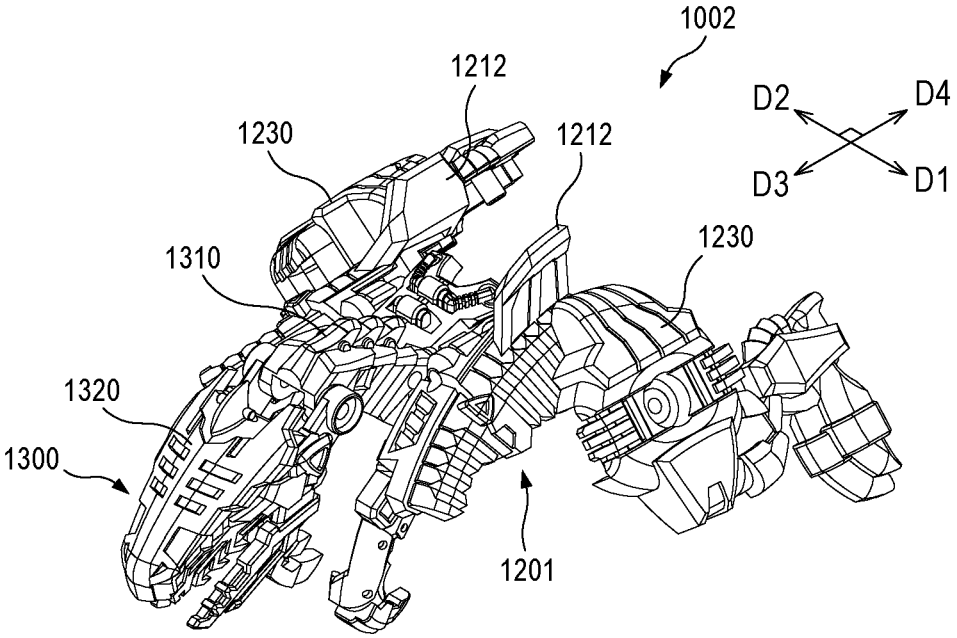
FIG. 30 is a perspective view showing a second example where the transformable body of the transformable toy according to the second embodiment is transformed.
Figure 31:
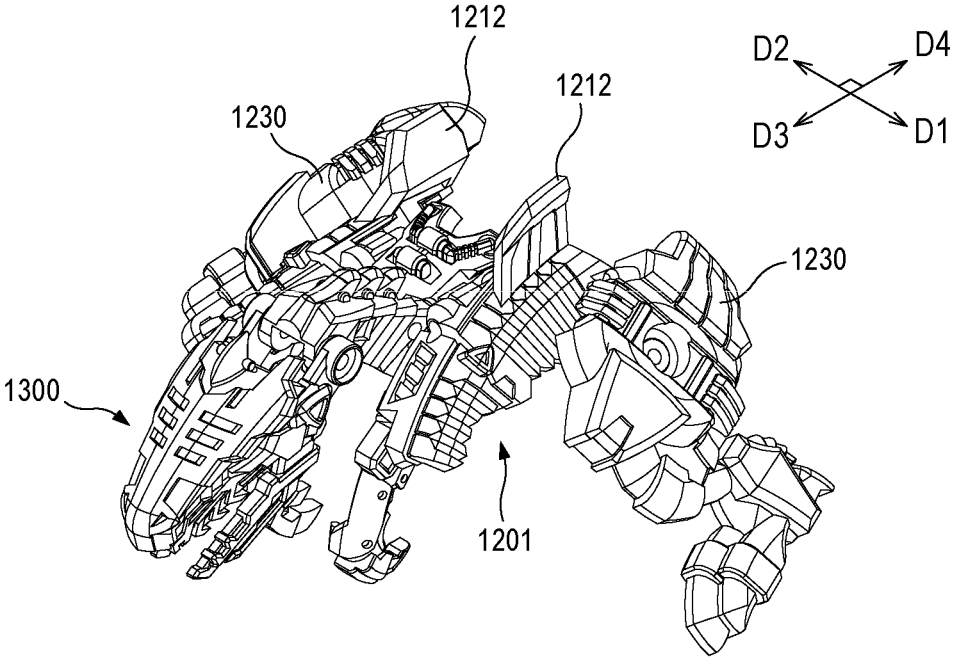
FIG. 31 is a perspective view showing a third example where the transformable body of the transformable toy according to the second embodiment is transformed.

Next, referring to FIG. 30, the distal end portion 1320 is rotated frontward, and the link portion 1310 is rotated upward. Thus, the front transformation portion 1300 is rotated to the second state of the transformable body 1002. Next, referring to FIG. 31, the rotation portion 1230 of each of the left and right transformation portions is rotated to the upright position, i.e., to the second state of the transformable body.

Figure 32:
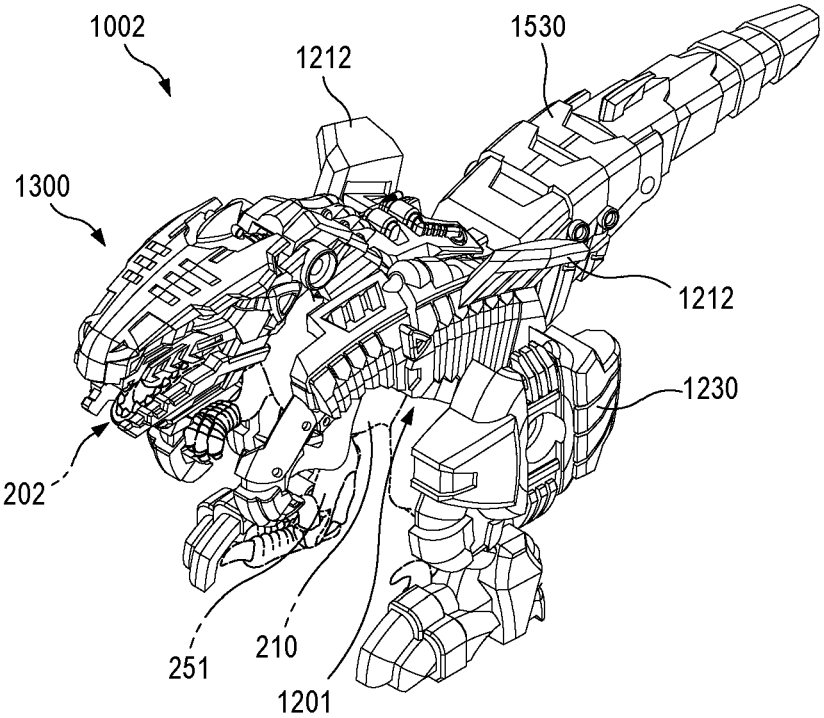
FIG. 32 is a perspective view showing a combination formed by coupling the transformable body and the accessory body of the transformable toy according to the second embodiment to a model toy.
Figure 33:
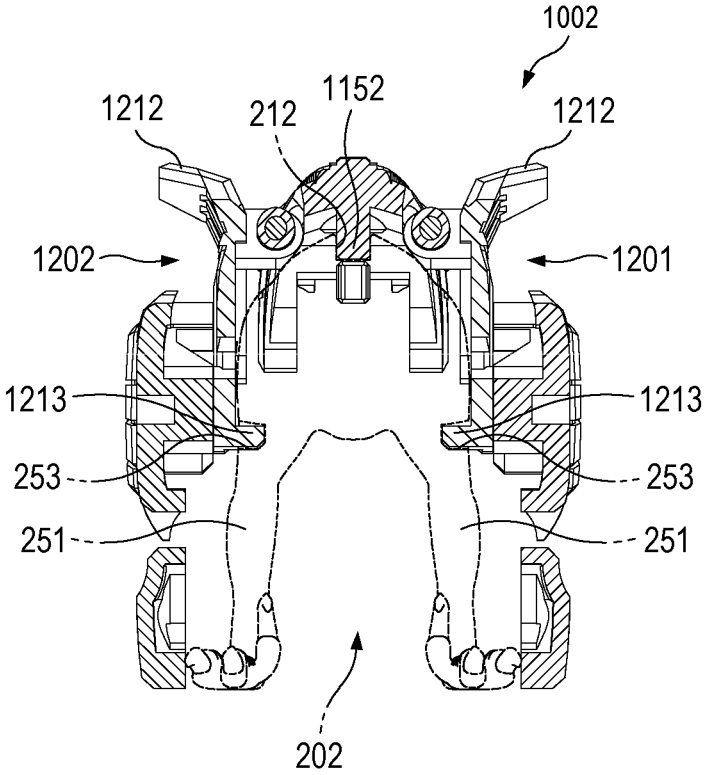
FIG. 33 is a cross-sectional view of the combination of the transformable toy and the model toy shown in FIG. 32.

Next, referring to FIGS. 32 and 33, in the state where the front transformation portion 1300 and the rotation portions 1230 are unfolded, the user inserts the torso portion and the hind leg extension portions of the model toy 202 between the left and right transformation portions 1201 and 1202 moved to the insertion position (i.e., between the engaging portions moved away from each other). As the user releases the manipulation portions 1212, the left and right transformation portions 1201 and 1202 are rotated to the cover position by the biasing force of the torsion springs so as to be moved toward each other. Therefore, the transformable body 1002 can be temporarily fixed to the model toy 202. When the engaging portions 1213 of the left and right transformation portions 1201 and 1202 are engaged with the counter engaging portions 253, the transformable body 1002 is completely mounted on the model toy 202, and the transformable body 1002 comes into the second state where the transformable body 1002 covers the model toy 202 and is releasably coupled to the model toy 202. In the state where the left and right transformation portions 1201 and 1202 grip the hind leg extension portions, the frame portion 1100 and the left and right transformation portions 1201 and 1202 cover the torso portion of the model toy, the front transformation portion 1300 covers the head extension portion of the model toy, and the rotation portions 1230 cover the hind leg extension portions of the model toy. In the state where the transformable body 1002 is mounted on the model toy 202, the accessory covering portion 1530 is unfolded from the folded state, and is coupled to the tail extension portion of the model toy 202 so as to cover the tail extension portion.

The procedures in which the transformable body 1002 is transformed from the second state to the first state may be reversed from the above-described procedures. If the transformable body 1002 is transformed from the second state to the first state and the transformable body 1002 in the first state and the accessory body 1502 are coupled to each other, the transformable toy 102 including the transformable body 1002 takes the form of a vehicle shape (a motorbike shape) shown in FIG. 19. From the motorbike-shaped form of the transformable toy 102, the user can have fun that the transformable toy before being combined with the model toy takes a vehicle form different from the model toy and can travel. Further, the user can have fun that the accessory transformable body 1520 is a separate transformable body independent from the transformable body 1002 and the accessory transformable body 1520 can be transformed into a flight-capable vehicle form.

As shown in FIGS. 20 and 32, in the second state where the transformable body 1002 covers the model toy 202, the user can recognize, from the combination of the model toy 202 and the transformable body 1002, that the model toy 202 is wearing a kind of a protector (e.g., an armor and helmet) by the frame portion 1100, the left and right transformation portions 1201 and 1202, the rotation portions 1230 of the left and right transformation portions 1201 and 1202, and the front transformation portion 1300. Accordingly, the user can have fun that the transformable toy having a vehicle form is transformed so as to become an armor and helmet for the model toy and the model toy is wearing the armor and helmet made by the transformable toy.

Figure 34:
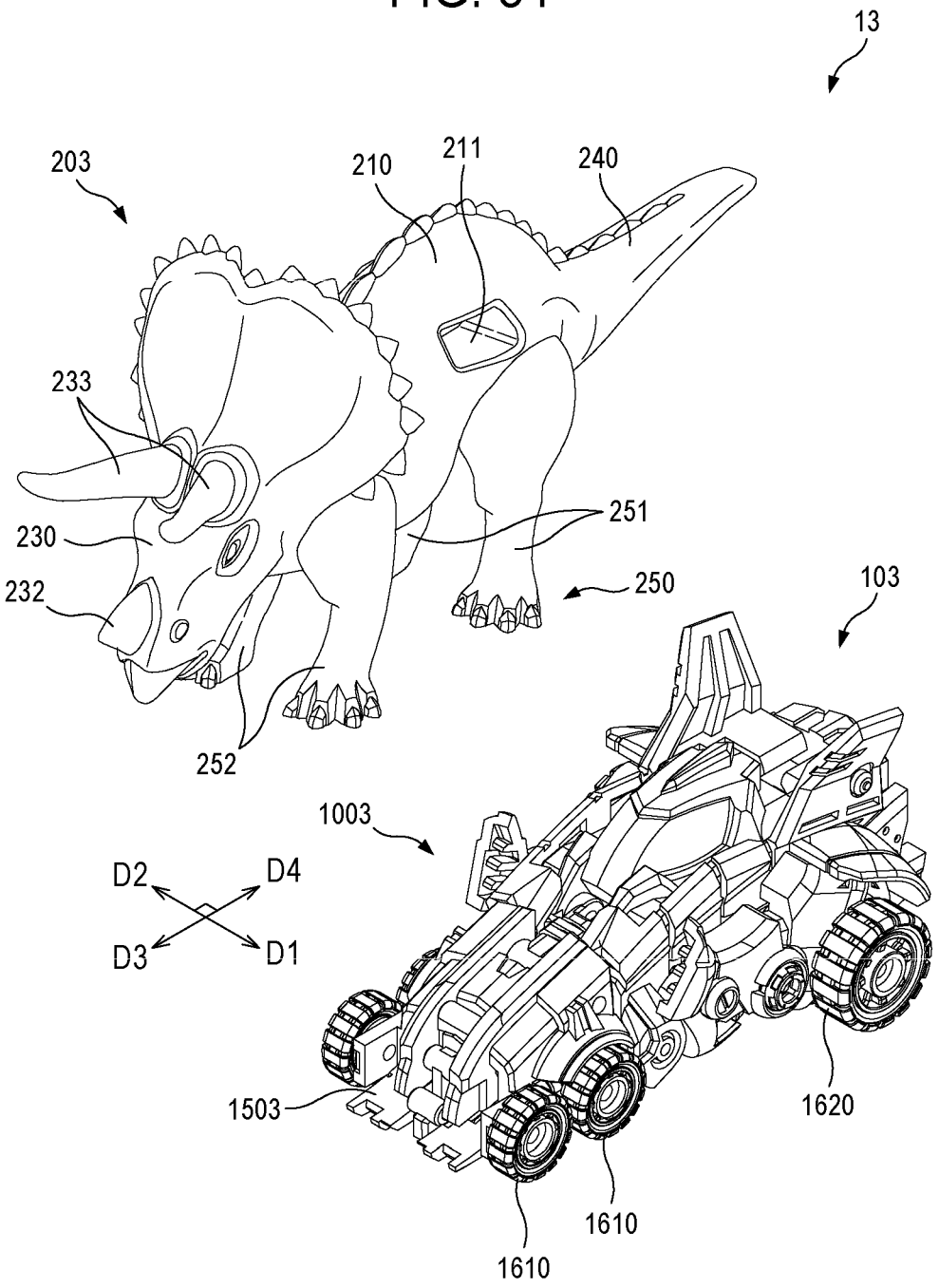
FIG. 34 is a perspective view showing a toy set according to a third embodiment of the present disclosure.
Figure 35:
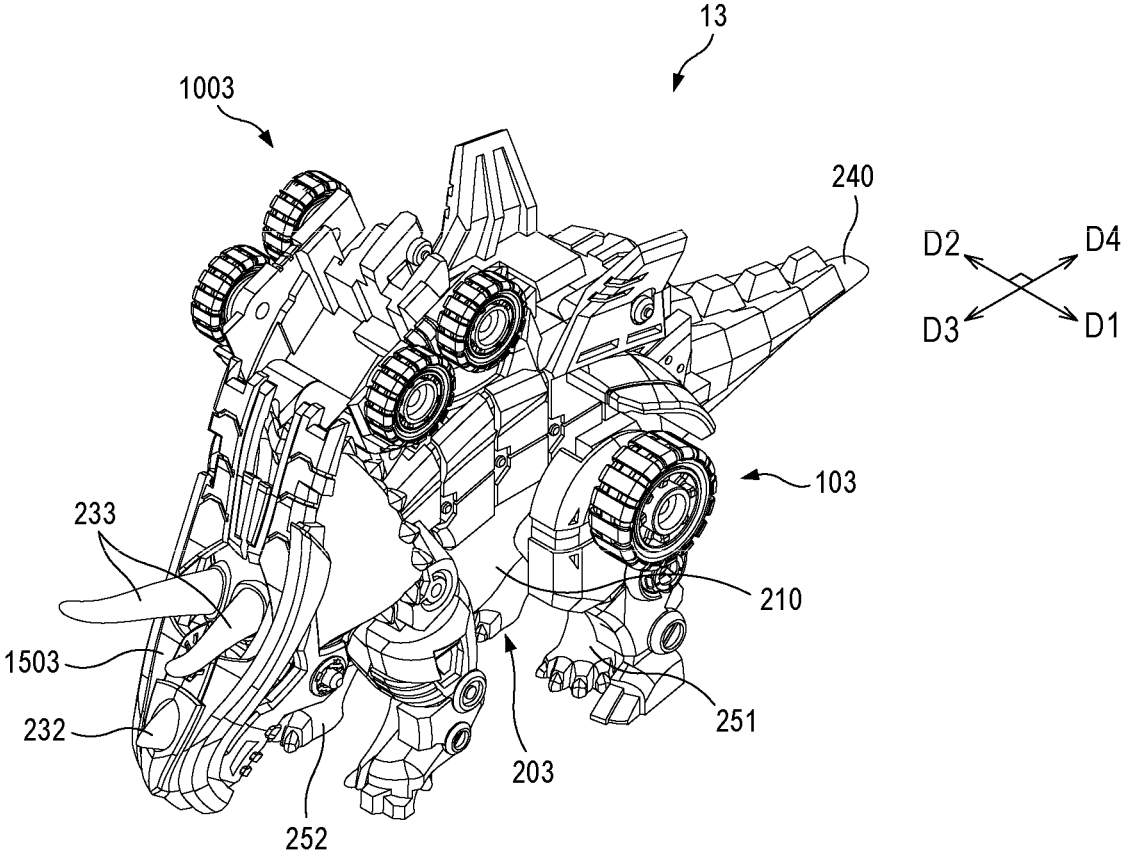
FIG. 35 is a perspective view showing a combination of a model toy and a transformable toy shown in FIG. 34.
Figure 36:
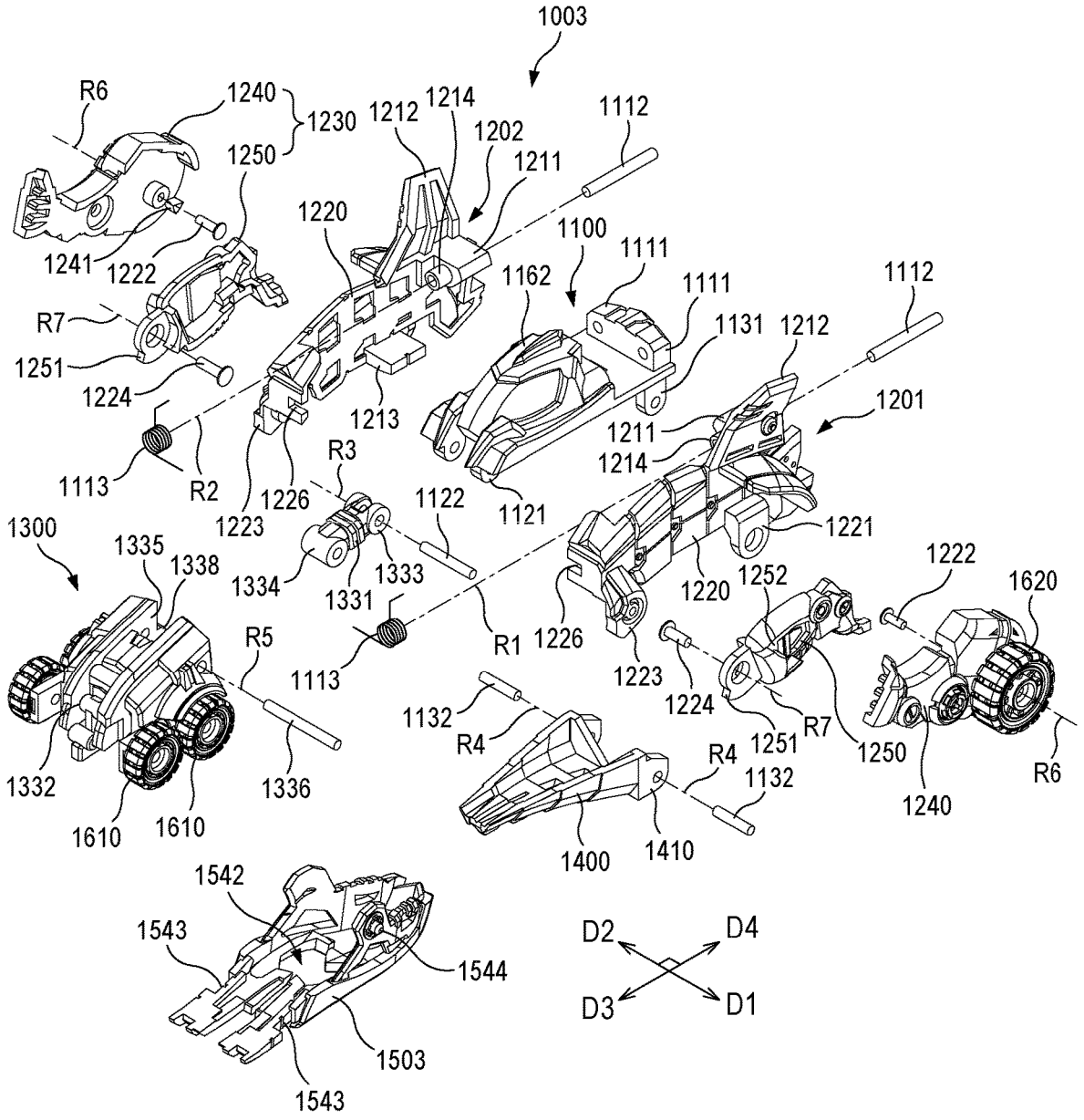
FIG. 36 is an exploded perspective view of the transformable toy according to the third embodiment shown in FIG. 34.
Figure 37:
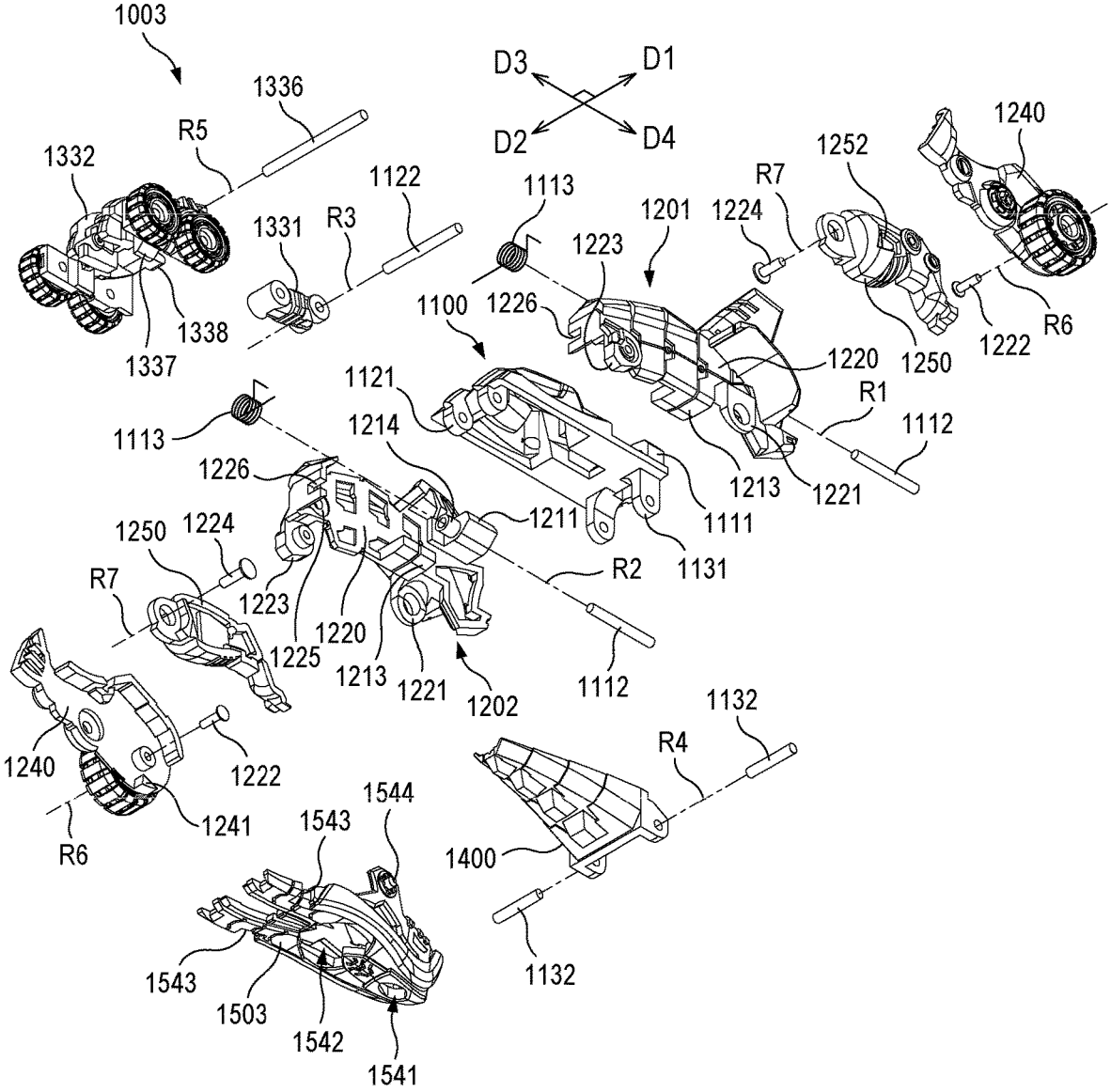
FIG. 37 is another exploded perspective view of the transformable toy according to the third embodiment shown in FIG. 34.

Hereinafter, a transformable toy 103, a model toy 203, and a toy set 13 according to a third embodiment of the present disclosure are described with reference to FIGS. 34 to 49. FIGS. 34 and 35 show a toy set and a transformable toy according to the third embodiment. FIGS. 36 and 37 are exploded perspective views of the transformable toy shown in FIG. 34. FIGS. 38 to 42 are a plan view, a side view, a front view, a rear view, and a bottom view of the transformable toy shown in FIG. 34, respectively. FIGS. 43 to 49 show examples where the transformable toy according to the third embodiment is transformed and examples where the transformable toy is coupled to a model toy.

In the following descriptions related to the third embodiment, components of the third embodiment equivalent or corresponding to those of the foregoing first embodiment are denoted by like reference numerals, and descriptions thereof may be omitted. The components of the third embodiment whose description is omitted can be understood by referring to the description of the first embodiment.

Referring to FIG. 34, the toy set 13 according to the third embodiment includes the transformable toy 103 and the model toy 203. The model toy 203 has an appearance corresponding to a shape of a land animal, for example, an appearance corresponding to a shape of a dinosaur which may be called a triceratops.

A leg extension portion 250 of the model toy 203 may have hind leg extension portions 251 and front leg extension portions 252 which extend from a torso portion 210 so as to reach the ground. The hind leg extension portions 251 may have a shape of hind legs of a triceratops, and the front leg extension portions 252 may have a shape of front legs of a triceratops. The model toy 203 may have a first protrusion 232 and a pair of second protrusions 233 which protrude from a head extension portion 230. The first protrusion 232 is provided in the vicinity of a front end of the head extension portion 230, and the second protrusions 233 are provided at an upper portion of the head extension portion 230. The first protrusion 232 may have a shape of a horn formed near the nose of a triceratops, and the second protrusions 233 may have a shape of horns formed at an upper side of the head of a triceratops. Counter engaging portions 211 are formed at the left and right sides of the torso portion 210 as a fitting groove. The counter engaging portions 211 function for releasably coupling the model toy 203 and the transformable toy 103.

The transformable toy 103 shown in FIG. 34 is independent from the model toy 203. The transformable toy 103 is transformable so as to cover the model toy 203, and is releasably coupled to the model toy 203 in its transformed state. The transformable toy 103 includes a transformable body 1003 configured to be transformed and to be releasably coupled to the model toy 203 and an accessory body 1503 removably coupled to the transformable body 1003 and configured to partially cover the model toy 203.

Referring to FIG. 35, the transformable body 1003 and the accessory body 1503 of the transformable toy 103 are coupled to the model toy 203, thereby making a combination of the transformable toy and the model toy. Therefore, the transformable body 1003 is configured to be transformed into a first state where the transformable body 1003 is independent from the model toy 203 (the state of the transformable body shown in FIG. 34) and a second state where the transformable body 1003 at least partially covers the model toy 203 and is releasably coupled to the model toy 203 (the state of the transformable body shown in FIG. 35). In this embodiment, as shown in FIG. 34, the transformable body 1003 has a form corresponding to a shape of a vehicle in the first state.

Referring to FIGS. 36 and 37, the transformable body 1003 includes a frame portion 1100 that functions as a base or a spine of the transformable body 1003. The frame portion 1100 is configured to cover a portion of the model toy (a back portion of the torso portion of the model toy shown in FIG. 34) in the second state of the transformable body 1003. In this embodiment, the frame portion 1100 has a protrusion 1162 protruding upward in the vicinity of its front end, and the protrusion 1162 may have a shape that can be recognized as a canopy covering a cockpit.

Further, the transformable body 1003 includes at least one transformation portion rotatably coupled to the frame portion 1100 and configured to be rotated with respect to the frame portion 1100. The at least one transformation portion of the transformable body 1003 is a structural member for performing transformation of the transformable body into the first state and the second state, and is a structural member coupled to the frame portion 1100 to constitute the transformable body 1003 together with the frame portion 1100. In this embodiment, the transformable body 1003 includes, as the at least one transformation portion, left and right transformation portions 1201 and 1202, a front transformation portion 1300, and a rear transformation portion 1400. The left and right transformation portions 1201 and 1202 and the rear transformation portion 1400 according to this embodiment are configured to partially cover a portion of the model toy in the second state of the transformable body 1003. The front transformation portion 1300 according to this embodiment does not cover the model toy in the second state of the transformable body 1003. The left, right, front and rear transformation portions 1201, 1202, 1300 and 1400 are coupled to the frame portion 1100 so as to be rotatable about their respective corresponding rotation axes. Further, for transformation of the transformable body 1002 from one of the first and second states of the transformable body 1003 to the other of the first and second states, the left, right, front and rear transformation portions 1201, 1202, 1300 and 1400 are configured to be rotated about the respective corresponding rotation axes with respect to the frame portion 1100 or to be rotated in two or more different directions. Further, for the transformation of the transformable body 1003 from the second state of the transformable body to the first state, the left, right, front and rear transformation portions 1201, 1202, 1300 and 1400 are configured to be folded with respect to the frame portion 1100 about their respective corresponding rotation axes. Therefore, the left, right, front and rear transformation portions 1201, 1202, 1300 and 1400 can be manipulated for transformation of the transformable body from one of the first and second states to the other of the first and second states, by being rotated with respect to the frame portion 1100 or being folded with respect to the frame portion 1100.

Referring to FIGS. 36 and 37, the transformable body 1003 includes, as the two transformation portions constituting the at least one transformation portion, a left transformation portion 1201 and a right transformation portion 1202 configured to be rotated in two different directions with respect to the frame portion 1100.

The left transformation portion 1201 and the right transformation portion 1202 are configured to be rotated in two different directions with respect to the frame portion 1100 (i.e., clockwise and counterclockwise with respect to the frame portion 1100) for transformation of the transformable body from one of the first state of the transformable body shown in FIG. 34 and the second state of the transformable body shown in FIG. 35 into the other. Therefore, the left and right transformation portions 1201 and 1202 are configured to be rotated with respect to the frame portion 1100 about the respective corresponding rotation axes (i.e., the first rotation axis R1 and the second rotation axis R2) so as to be moved away from or toward each other. Regarding the rotation of the left and right transformation portions 1201 and 1202, the left transformation portion 1201 is coupled to the frame portion 1100 so as to be rotatable about the first rotation axis R1 (see FIG. 38), and the right transformation portion 1202 is coupled to the frame portion 1100 so as to be rotatable about the second rotation axis R2 (see FIG. 38). The second rotation axis R2 is spaced apart from the first rotation axis R1 and may be parallel to the first rotation axis R1 or inclined toward the first rotation axis R1.

The first rotation axis R1 passes through a portion of the frame portion 1100 in the first direction D1, and the second rotation axis R2 passes through a portion of the frame portion 1100 in the second direction D2 opposite to the first direction D1. As an alternative example, the first rotation axis R1 and the second rotation axis R2 may constitute one rotation axis, and the frame portion 1100 may be configured to rotate the left and right transformation portions 1201 and 1202 about one rotation axis in different directions.

The left and right transformation portions 1201 and 1202 are configured to be unfolded with respect to the frame portion 1100 in the second state of the transformable body 1003 and to be folded with respect to the frame portion 1100 in the first state of the transformable body 1003. The left and right transformation portions 1201 and 1202 are unfolded with respect to the frame portion 1100 in the second state of the transformable body 1003 by being rotated in different directions while being moved away from each other with respect to the frame portion 1100. The left and right transformation portions 1201 and 1202 are folded with respect to the frame portion 1100 in the first state of the transformable body 1003 by being rotated in different directions while being moved toward each other with respect to the frame portion 1100.

The left and right transformation portions 1201 and 1202 are configured to cover a portion of the model toy in the second state of the transformable body 1003. The left transformation portion 1201 is configured to cover a portion of the model toy in the first direction D1 (a left side surface of the torso portion of the model toy shown in FIG. 34) in the second state of the transformable body 1003. The right transformation portion 1202 is configured to cover another portion of the model toy in the second direction D2 (a right side surface of the torso portion of the model toy shown in FIG. 34) in the second state of the transformable body 1003.

Accordingly, the left and right transformation portions 1201 and 1202 can be rotated about the first and second rotation axes R1 and R2 in the transformable body 1003 so as to be moved away from or toward each other. Specifically, the left and right transformation portions 1201 and 1202 may be rotated to an insertion position where the left and right transformation portions 1201 and 1202 are moved away from each other to allow the torso portion of the model toy to be inserted between the left and right transformation portions, and a cover position where the left and right transformation portions are moved toward each other to cover the torso portion of the model toy.

The frame portion 1100 and the left and right transformation portions 1201 and 1202 are connected by the above-described first and second hinge joints, respectively. The hinge portion 1111 provided at the left side of the frame portion 1100 becomes the portion of the frame portion 1100 in the first direction D1 through which the first rotation axis R1 passes, and the hinge portion 1111 provided at the right side of the frame portion 1100 becomes the portion of the frame portion 1100 in the second direction D2 through which the second rotation axis R2 passes. The respective hinge shafts 1112 correspond to the first rotation axis R1 and the second rotation axis R2.

The frame portion 1100 of the transformable body 1003 includes torsion springs 1113 disposed respectively between the frame portion 1100 and the left and right transformation portions 1201 and 1202 to bias the left and right transformation portions 1201 and 1202 toward the cover position.

The left and right transformation portions 1201 and 1202 are biased by the biasing force of the torsion springs 1113 so as to be moved toward each other. Therefore, the transformable body 1003 can be stably coupled to the model toy in the state where the left and right transformation portions 1201 and 1202 biased toward each other are coupled to the torso portion of the model toy. Further, by the biasing force of the torsion springs 1113, the rotatable transformation portions of the transformable body 1003 can be stably maintained in the first state of the transformable body 1002. As an alternative example, the transformable body 1003 may include at least one spring disposed between the left and right transformation portions 1201 and 1202.

The torsion springs 1113 are disposed in the respective corresponding rotation axes of the left and right transformation portions 1201 and 1202 to bias one of the left and right transformation portions 1201 and 1202 toward the other. The torsion springs 1113 are disposed between the frame portion 1100 and the left and right transformation portions 1201 and 1202 such that the hinge shafts 1112 pass through the insides of the torsion springs 1113 respectively. The torsion spring 1113 is fitted to a sleeve portion 1214 provided at the counter hinge portion 1211. One end of each of the torsion springs 1113 is engaged on the surface of the frame portion 1100, and the other end of each of the torsion springs 1113 is engaged on the counter hinge portion 1211. The respective inner surfaces of the left and right transformation portions 1201 and 1202 biased by the torsion springs 1113 make contact with the respective side surfaces of the frame portion 1100, whereby the rotation of the left and right transformation portions 1201 and 1202 toward the inside of the frame portion 1100 can be restricted.

The left and right transformation portions 1201 and 1202 include a manipulation portion 1212. Each manipulation portion 1212 has a shape that can be recognized as a wing, and is formed as a protrusion protruding from the base end of each of the left and right transformation portions 1201 and 1202. The manipulation portions 1212 extend from the base ends of the left and right transformation portions 1201 and 1202 in an oblique direction between the first direction D1 or the second direction D2 and the upward side. The manipulation portions 1212 can be manipulated to rotate the left and right transformation portions 1201 and 1202 against the biasing force of the torsion springs 1113. The left and right transformation portions 1201 and 1202 can be rotated about their respective corresponding rotation axes (e.g., the first rotation axis R1 and the second rotation axis R2) in the direction of the force applied to the manipulation portions 1212. For example, as the user pinches the pair of manipulation portions 1212 and manipulates the pair of manipulation portions 1212 to move the pair of manipulation portions 1212 toward each other, the left and right transformation portions 1201 and 1202 are moved away from each other and are rotated to the insertion position. In the state where the left and right transformation portions 1201 and 1202 are moved away from each other by the pair of manipulation portions 1212, the torso portion of the model toy can be inserted between the left and right transformation portions 1201 and 1202. Thereafter, as the manipulation portions 1212 are released, the left and right transformation portions 1201 and 1202 are moved toward each other by the biasing force of the torsion springs 1113 and can cover the torso portion of the model toy.

The left and right transformation portions 1201 and 1202 are configured to grip the model toy. With regard to the gripping of the model toy, each of the left and right transformation portions 1201 and 1202 includes, at its distal end, an engaging portion 1213 as the aforementioned male engaging portion. Further, the model toy includes, at each of the left and right surfaces of the torso portion, a counter engaging portion 211 (see FIG. 34) configured to be complementarily coupled to the engaging portion 1213. The counter engaging portion 211 is formed as a female engaging portion such as a concave groove or hole. In the second state of the transformable body 1003, the engaging portions 1213 are fitted to the counter engaging portions 211 in the first direction D1 or the second direction D2. Therefore, the transformable body 1003 transformed into the second state can be coupled to the model toy while the left and right transformation portions 1201 and 1202 cover the torso portion of the model toy and releasably grip the torso portion of the model toy.

The left and right transformation portions 1201 and 1202 releasably couple the transformable body 1003 transformed into the second state to the model toy, and cover a portion of the torso portion of the model toy. If the transformable body 1003 transformed into the second state is coupled to the model toy, the left and right transformation portions 1201 and 1202 cover a portion of the model toy. Therefore, the left and right transformation portions 1201 and 1202 can be recognized by the user as a portion of a kind of protector (an armor) that covers the model toy.

The transformable toy 103 includes an accessory body 1503 removably coupled to a first position of the transformable body 1003 in the first state of the transformable body 1103 and releasably coupled to a predetermined position of the model toy in the second state of the transformable body 1003.

The accessory body 1503 functions as an accessory covering portion of the aforementioned at least one covering portion. The accessory body 1503 is configured to partially cover the head extension portion of the model toy (see FIG. 34), and has, for example, a shape that can be recognized as a helmet by the user. A first opening 1541 and a second opening 1542 are formed in the accessory body 1503. In the second state of the transformable body 1003, the first protrusion 232 (see FIG. 35) of the head extension portion of the model toy is inserted into the first opening 1541. In the second state of the transformable body 1003, the second protrusions 233 (see FIG. 35) of the head extension portion of the model toy are inserted into the second opening 1542. That is, as shown in FIG. 35, the accessory body 1503 is releasably coupled to the predetermined position of the model toy, i.e., the head extension portion 230 of the model toy in the state where the first protrusion 232 is inserted into the first opening 1541 and the second protrusions 233 are inserted into the second opening 1542.

In this embodiment, the transformable body 1003 includes, as the at least one transformation portion, a front transformation portion 1300. The front transformation portion 1300 is coupled to the frame portion 1100 so as to be rotatable about its corresponding rotation axis, i.e., a third rotation axis R3 (see FIG. 38). The third rotation axis R3 passes through a portion of the frame portion 1100 (the front end portion of the frame portion) in the third direction D3 orthogonal to the first direction D1 and the second direction D2. When the transformable body 1003 is transformed from the first state into the second state, the front transformation portion 1300 is rotated toward the frame portion 1100 in the fourth direction D4. Further, the front transformation portion 1300 is configured to removably couple the accessory body 1503 to the transformable body 1003.

Figure 38:
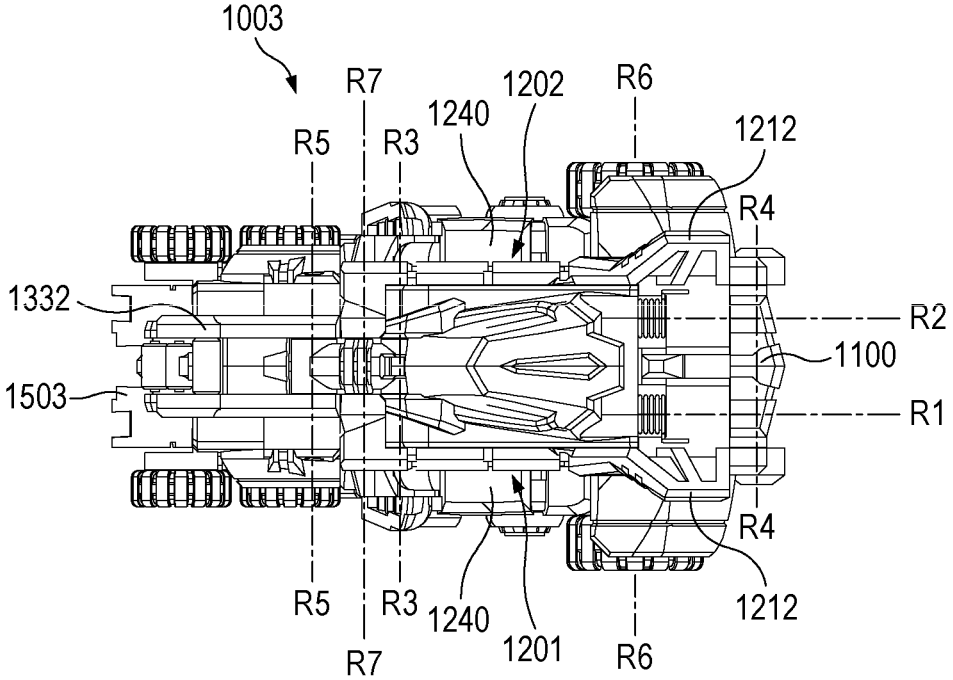
FIG. 38 is a plan view of the transformable toy shown in FIG. 34.

The front transformation portion 1300 includes a link portion 1331 coupled to the frame portion 1100 so as to be rotatable upward and downward about the third rotation axis R3 (see FIG. 38), and a distal end portion 1332 coupled to the link portion 1331 so as to be rotatable about a fifth rotation axis R5) (see FIG. 38). The accessory body 1503 may be removably coupled to the distal end portion 1332 and the left and right transformation portions 1201 and 1202 in the first state of the transformable body 1003. The link portion 1331 and the distal end portion 1332 do not cover the model toy. In the second state of the transformable body 1003, the link portion 1331 is rotated downward. In the second state of the transformable body 1003, the distal end portion 1332 can be rotated rearward such that the upper surface thereof makes contact with the upper surface of the protrusion 1162.

The link portion 1331 is connected to the frame portion 100 by a third hinge joint. The third hinge joint may be composed of a hinge portion 1121 provided at the front end of the frame portion 1100, a counter hinge portion 1333 provided at the rear end of the link portion 1331, and a hinge shaft 1122 passing through the hinge portion 1121 and the counter hinge portion 1333. The distal end portion 1332 is connected to the link portion 1331 by a fifth hinge joint. The fifth hinge joint may be composed of a hinge portion 1334 provided at the front end of the link portion 1331, a counter hinge portion 1335 provided at the rear end of the distal end portion 1332, and a hinge shaft 1336 passing through the hinge portion 1334 and the counter hinge portion 1335.

Figure 42:
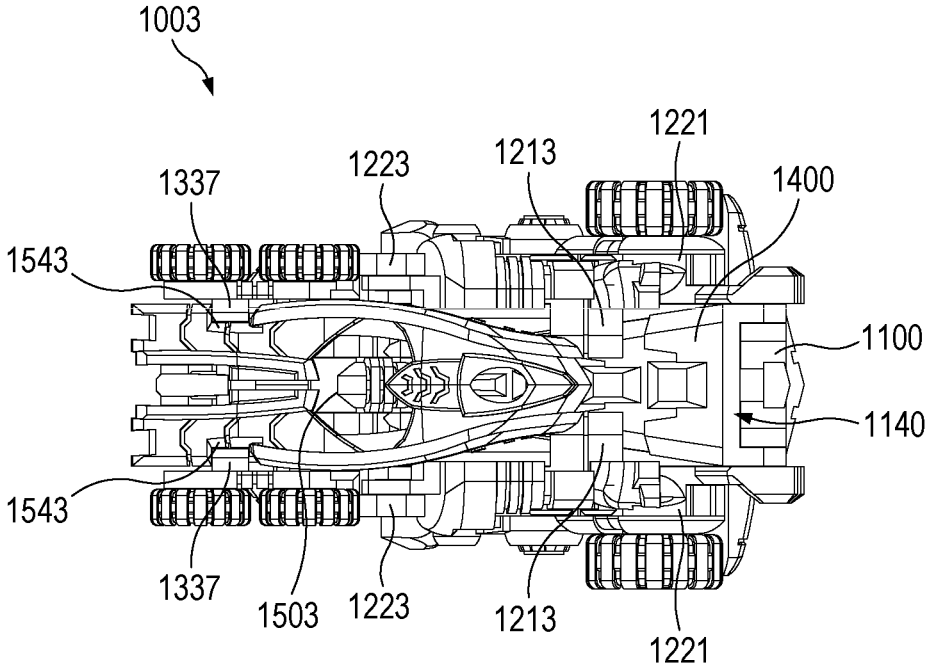
FIG. 42 is a bottom view of the transformable toy shown in FIG. 34.

A positioning protrusion 1337 protrudes from each lateral end of the distal end portion 1332. A fitting groove 1543 corresponding to the positioning protrusion 1337 is formed in each lateral end of the accessory body 1503. As shown in FIG. 42, in the first state of the transformable body 1003, the accessory body 1503 is removably coupled to the distal end portion 1332 such that the positioning protrusions 1337 are fitted to the fitting grooves 1543. In the first state of the transformable body 1003, the positioning protrusions 1337 and the fitting grooves 1543 are located such that the accessory body 1503 is not exposed from the lower portion of the transformable body 1003. Further, the accessory body 1503 has a fitting protrusion 1544 in each lateral end, and each of the left and right transformation portions 1201 and 1202 has, in the inner surface in the vicinity of its front end, a fitting hole 1225 to which the fitting protrusion 1544 is fitted. In the first state of the transformable body 1003, a portion of the accessory body 1503 is positioned within the distal end portion 1332, and the remaining portion of the accessory body 1503 is positioned between the left and right transformation portions 1201 and 1202 moved toward each other. Further, since the fitting protrusion 1544 of the accessory body is fitted to the fitting hole 1225 of each of the left and right transformation portions 1201 and 1202 in the first state of the transformable body 1003, the accessory body 1503 can be gripped by the left and right transformation portions 1201 and 1202 moved toward each other.

Further, a pair of fitting protrusions 1338 are formed in the counter hinge portion 1335 of the distal end portion 1332, and fitting grooves 1226 fitting with the fitting protrusions 1338 are formed in the respective front ends of the left and right transformation portions 1201 and 1202. If the left and right transformation portions 1201 and 1202 are moved toward each other in the first state of the transformable body 1003, the fitting protrusions 1338 are fitted into the fitting grooves 1226 in the first direction D1 or the second direction D2. Therefore, the accessory body 1503 can be engaged with the transformable body 1003 by the left and right transformation portions 1201 and 1202 moved toward each other and the distal end portion 1332 coupled thereto in the first state of the transformable body 1003. Further, the left and right transformation portions 1201 and 1202 moved toward each other in the first state of the transformable body 1003 grip the distal end portion 1332 by means of the fitting protrusions 1338 and the fitting grooves 1226, and the distal end portion 1332 is fixed through the accessory body 1503 gripped by the left and right transformation portions 1201 and 1202. Thus, the distal end portion 1332 can be fixed in the first state of the transformable body 1003.

In this embodiment, the transformable body 1003 includes, as the at least one transformation portion, a rear transformation portion 1400. The rear transformation portion 1400 is coupled to the frame portion 1100 so as to be rotatable about a fourth rotation axis R4 (see FIG. 38). In the second state of the transformable body 1003, the rear transformation portion 1400 is configured to cover another portion of the model toy (e.g., the tail extension portion of the model toy shown in FIG. 34) that extends in the fourth direction D4 from the portion of the model toy covered by the frame portion 1100 (e.g., the torso portion of the model toy shown in FIG. 34).

The frame portion 1100 and the rear transformation portion 1400 are connected by a fourth hinge joint that may be composed of a hinge portion 1131 provided at the rear end of the frame portion 1100, a counter hinge portion 1410 provided at the base end of the rear transformation portion 1400, and a hinge shaft 1132 passing through the hinge portion 1131 and the counter hinge portion 1410. The rear transformation portion 1400 can be rotated frontward and rearward with respect to the frame portion 1100. The base end of the rear transformation portion 1400 adjacent to the counter hinge portion 1410 makes contact with the hinge portion 1131, thereby restricting the rearward rotation and upward rotation of the rear transformation portion 1400. The rear transformation portion 1400 can be folded toward the frame portion 1100 so as to make contact with the lower surface of the frame portion 1100 in the first state of the transformable body 1003.

In this embodiment, each of the left and right transformation portions 1201 and 1202 includes a support portion 1220 and a rotation portion 1230 rotatably coupled to the support portion 1220.

The support portion 1220 has a predetermined shape and may constitute a main body of each of the left and right transformation portions 1201 and 1202. The support portion 1220 can function as a support which rotatably supports the rotation portion 1230 and supports the frame portion 1100 and the model toy with respect to the rotation centers of the left and right transformation portions 1201 and 1202. The support portion 1220 is configured to cover a portion of the model toy corresponding to the support portion 1220 (a portion of the side surface of the torso portion of the model toy shown in FIG. 34) in the second state of the transformable body 1003. Since the support portion 1220 is provided with the counter hinge portion 1211, the respective corresponding rotation axes (i.e., the first rotation axis R1 and the second rotation axis R2) of the left and right transformation portions 1201 and 1202 are disposed in the support portion 1220. The rotation portion 1230 is configured to cover another portion of the model toy (the leg extension portion of the model toy shown in FIG. 34) that extends from the portion of the model toy corresponding to the support portion 1220 in the second state of the transformable body 1003. The rotation portion 1230 can be positioned at a traveling position (see FIG. 39) where the rotation portion 1230 is substantially parallel to the ground in the first state of the transformable body 1003, and can be positioned at an upright position (see FIG. 35) where the rotation portion 1230 is substantially perpendicular to the ground in the second state of the transformable body 1003.

In this embodiment, the rotation portion 1230 of each of the left and right transformation portions 1201 and 1202 includes a first rotation portion 1240 and a second rotation portion 1250. The first rotation portion 1240 is disposed in the vicinity of the rear end of each of the left and right transformation portions 1201 and 1202, and is configured to partially cover the hind leg extension portion of the model toy. The second rotation portion 1250 is disposed in the vicinity of the front end of each of the left and right transformation portions 1201 and 1202, and is configured to partially cover the front leg extension portion of the model toy.

The first rotation portion 1240 is coupled to the support portion 1220 so as to be rotatable about a sixth rotation axis R6 (see FIG. 38). A distal end portion of the first rotation portion 1240 is formed so as to correspond to the shape of a foot of the hind leg extension portion of the model toy. The support portion 1220 and the first rotation portion 1240 are connected by a sixth hinge joint. The sixth hinge joint may be composed of a hinge portion 1221 protruding downward and laterally from the rear end of the support portion 1220, and a hinge shaft 1222 coupled to the hinge portion 1221 through the first rotation portion 1240 in the vicinity of the base end of the first rotation portion 1240. The first rotation portion 1240 has a stopper portion 1241 protruding from the base end thereof. The stopper portion 1241 makes contact with the rear edge of the hinge portion 1221, thereby restricting the first rotation portion 1240 to the upright position.

The second rotation portion 1250 is coupled to the support portion 1220 so as to be rotatable about a seventh rotation axis R7 (see FIG. 38). A distal end portion of the second rotation portion 1250 is formed to correspond to a shape of a foot of the front leg extension portion of the model toy. The support portion 1220 and the second rotation portion 1250 are connected by a seventh hinge joint. The seventh hinge joint may be composed of a hinge portion 1223 protruding downward and laterally from the front end of the support portion 1220, and a hinge shaft 1224 coupled to the hinge portion 1223 through the second rotation portion 1250 in the vicinity of the base end of the second rotation portion 1250. The second rotation portion 1250 is provided with a stopper portion 1251 that makes contact with the front edge of the hinge portion 1223 to restrict the second rotation portion 1250 to the upright position.

Figure 39:
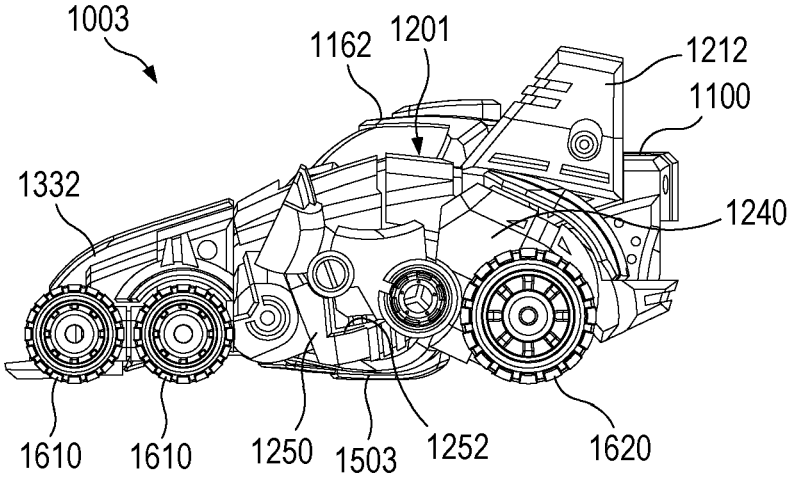
FIG. 39 is a side view of the transformable toy shown in FIG. 34.
Figure 40:
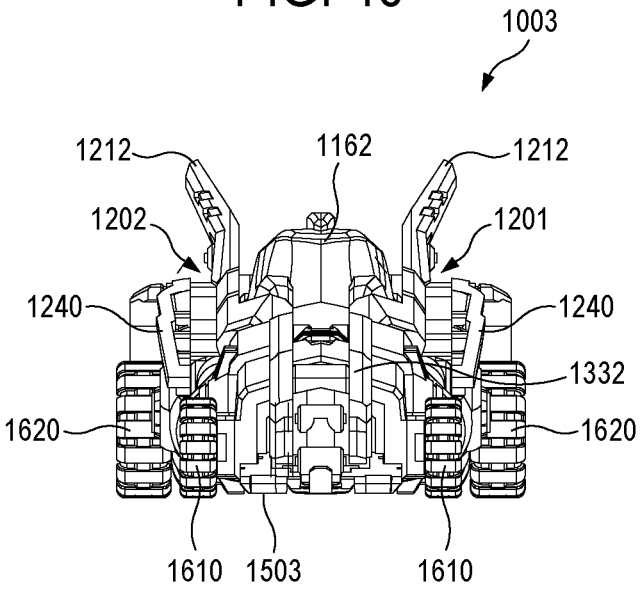
FIG. 40 is a front view of the transformable toy shown in FIG. 34.

In this embodiment, the first rotation portion 1240 and the second rotation portion 1250 are positioned so as to partially overlap each other in the first state of the transformable body 1003 and at the traveling position. In this regard, the hinge portion 1223 may be positioned further inward than the hinge portion 1221, i.e., closer to the first rotation axis R1 or the second rotation axis R2 than the hinge portion 1221. Further, a recessed portion 1252 is formed on the outer surface of the second rotation portion 1250. The recessed portion 1252 is formed so as to accommodate the distal end portion of the first rotation portion 1240 and a portion adjacent thereto. Thus, as shown in FIGS. 39 and 42, the first rotation portion 1240 and the second rotation portion 1250 may be configured to overlap each other in the lateral direction in the first state of the transformable body. Accordingly, the transformable body 1003 can have a reduced width dimension in the first state.

Figure 41:
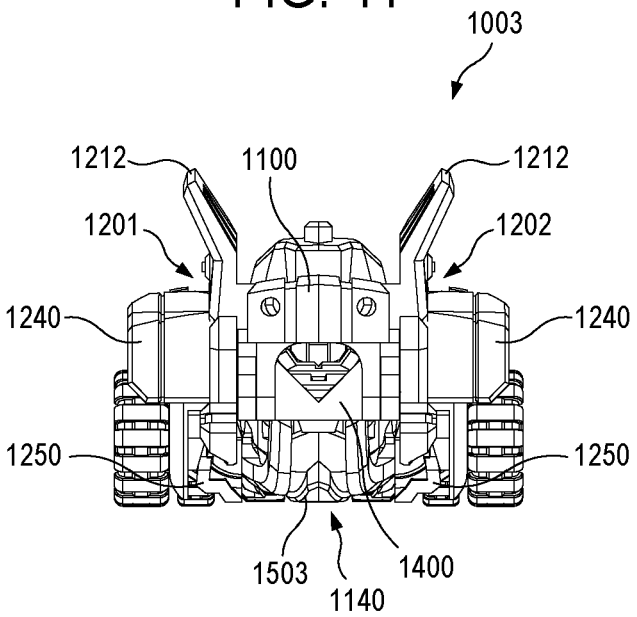
FIG. 41 is a rear view of the transformable toy shown in FIG. 34.

The frame portion 1100 and the left and right transformation portions 1201 and 1202 are configured to accommodate the rear transformation portion 1400 in the first state of the transformable body. As shown in FIGS. 41 and 42, in the first state of the transformable body 1003, the frame portion 1100 has an accommodation portion 1140 defined by the lower surface of the frame portion 1100 and the inner surfaces of the left and right transformation portions 1201 and 1202. When the transformable body is transformed from the second state to the first state, the rear transformation portion 1400 can be rotated into the accommodation portion 1140. Accordingly, the transformable body 1003 can be compactly configured in the first state. Further, in the state where the rear transformation portion 1400 is accommodated in the accommodation portion 1140, the engaging portions 1213 protruding from the support portions 1220 of the left and right transformation portions 1201 and 1202 are located below the rear transformation portion 1400 and can grip the rear transformation portion 1400. Since the left and right transformation portions 1201 and 1202 are biased toward the inside of the frame portions by the biasing force of the torsion springs 1113, the engaging portions 1213 prevent the rear transformation portion 1400 from being rotated from the accommodation portion 1140, and the transformable body 1003 can be stably maintained in the first state.

The first state of the transformable body 1003 takes a form different from the appearance of the model toy 203. The first state of the transformable body 1003 has a form corresponding to a shape of a vehicle (see FIG. 34). For the vehicle form of the transformable body 1003, the transformable body 1003 includes a plurality of wheels for movement on the ground in the first state. In this embodiment, the transformable body 1003 includes front wheels 1610 rotatably coupled to the distal end portion 1332, and rear wheels 1620 rotatably coupled to the first rotation portions 1240 of the left and right transformation portions 1201 and 1202. The transformable body 1003 can be transformed from the second state to the first state such that the front wheels 1610 and the rear wheels 1620 can be placed on the ground in the first state of the transformable body 1003. In the first state of the transformable body 1003, the first rotation portion 1240 and the second rotation portion 1250 are maintained at the traveling position parallel to the ground. Therefore, the front wheels 1610 and the rear wheels 1620 can be placed on the ground.

Examples where the transformable toy according to this embodiment is transformed and examples where the transformable toy and the model toy are coupled to each other are described with reference to FIGS. 43 to 49.

Figure 43:
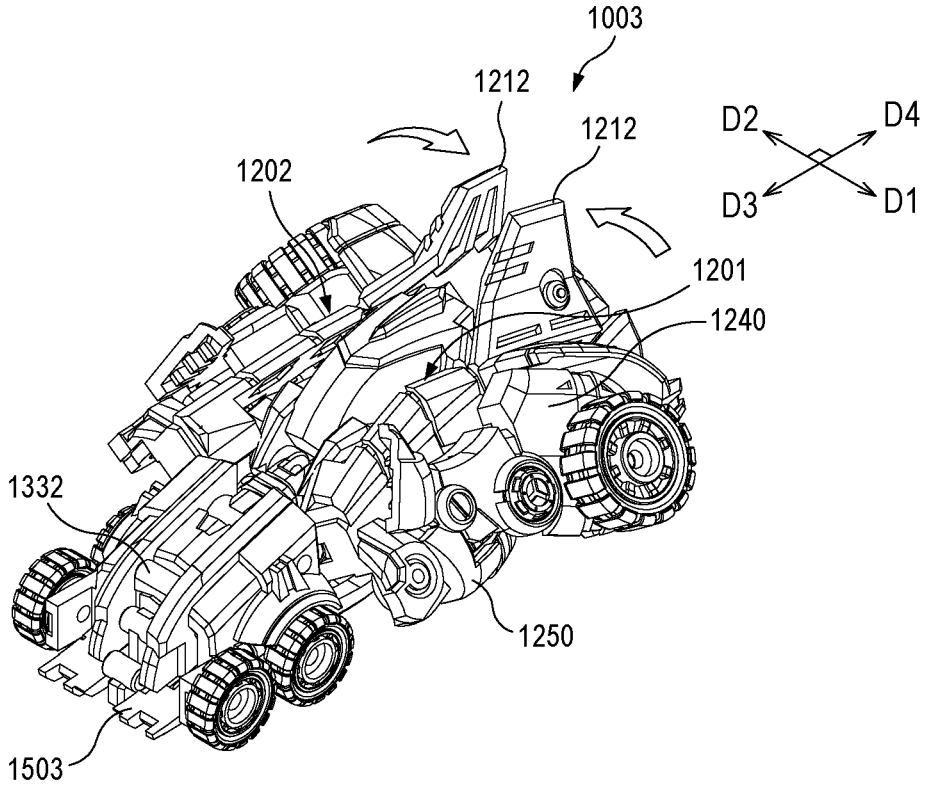
FIG. 43 is a perspective view showing a first example where the transformable body of the transformable toy according to the third embodiment is transformed.

Referring to FIG. 43, if an external force is applied to the manipulation portions 1212 in a direction in which the manipulation portions 1212 are moved toward each other in the transformable body 1003 (i.e., when the user performs the motion of pinching the manipulation portions 1212), the left and right transformation portions 1201 and 1202 are rotated to the insertion position in different directions and are moved away from each other.

Figure 44:
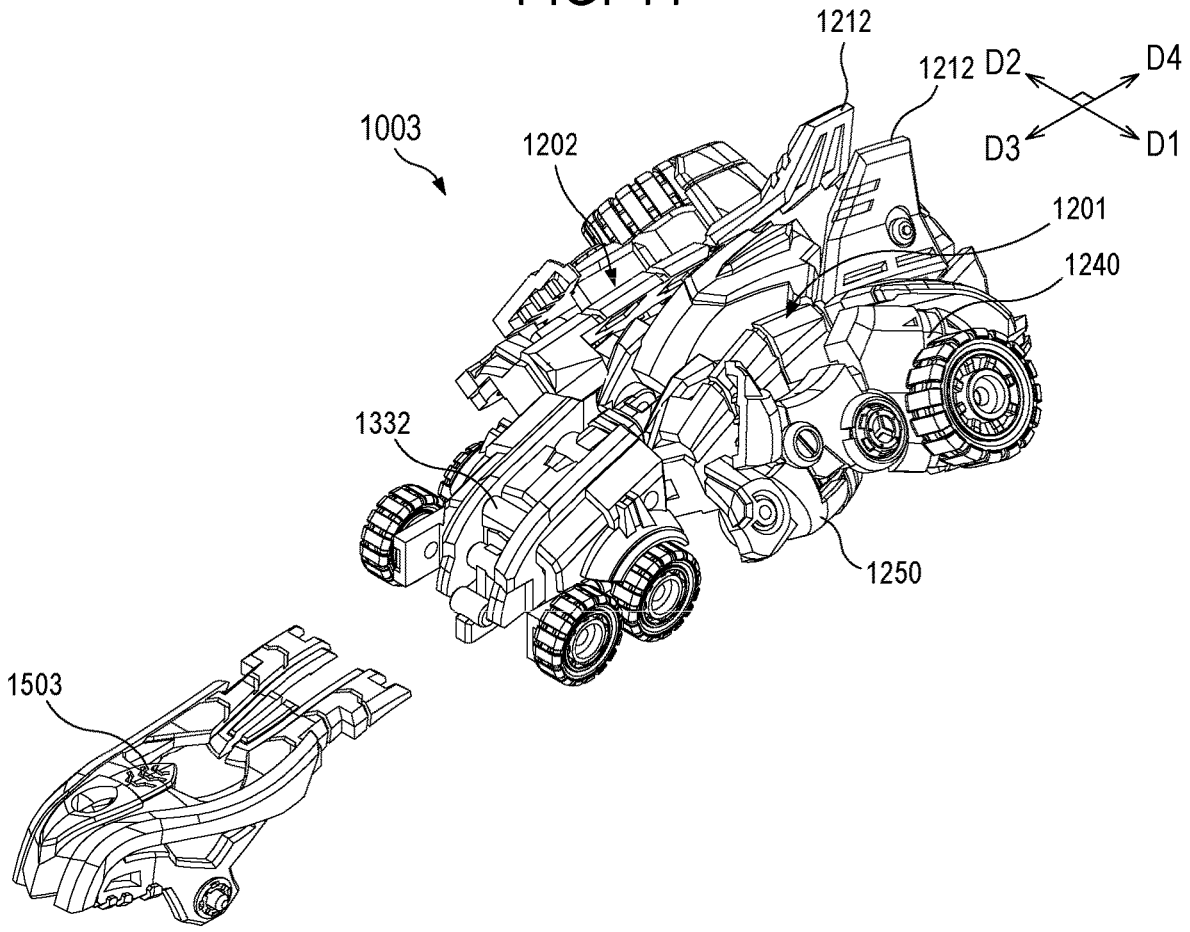
FIG. 44 is a perspective view showing a second example where the transformable body of the transformable toy according to the third embodiment is transformed.

Next, referring to FIG. 44, in the left and right transformation portions 1201 and 1202 moved away from each other, the accessory body 1503 is removed from the distal end portion 1332 and the left and right transformation portions 1201 and 1202. The accessory body 1503 is kept in waiting to cover the head extension portion of the model toy.

Figure 45:
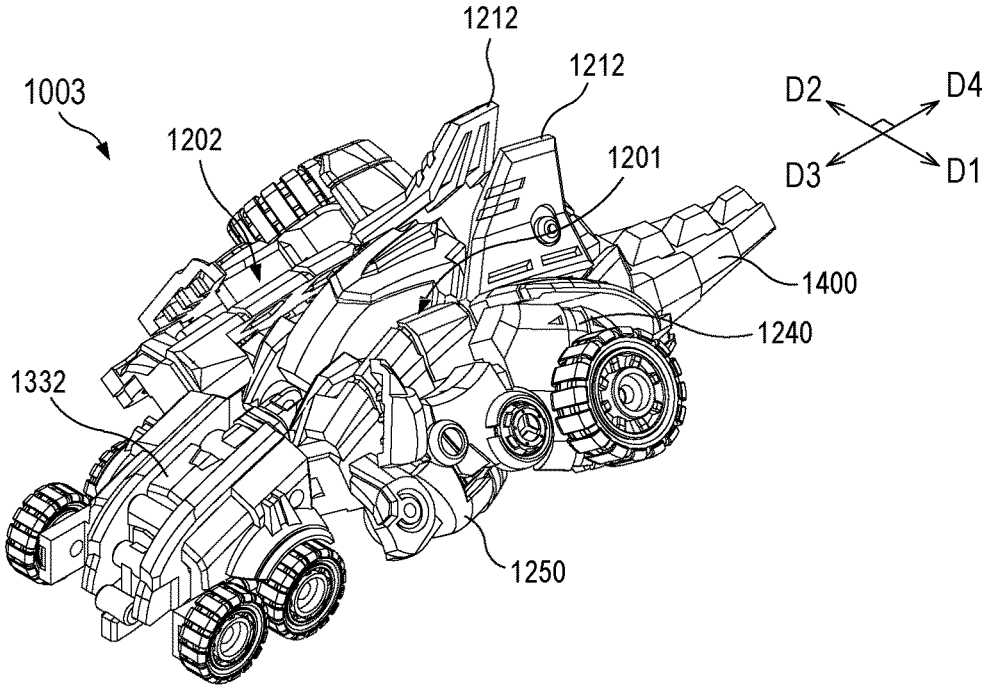
FIG. 45 is a perspective view showing a third example where the transformable body of the transformable toy according to the third embodiment is transformed.
Figure 46:
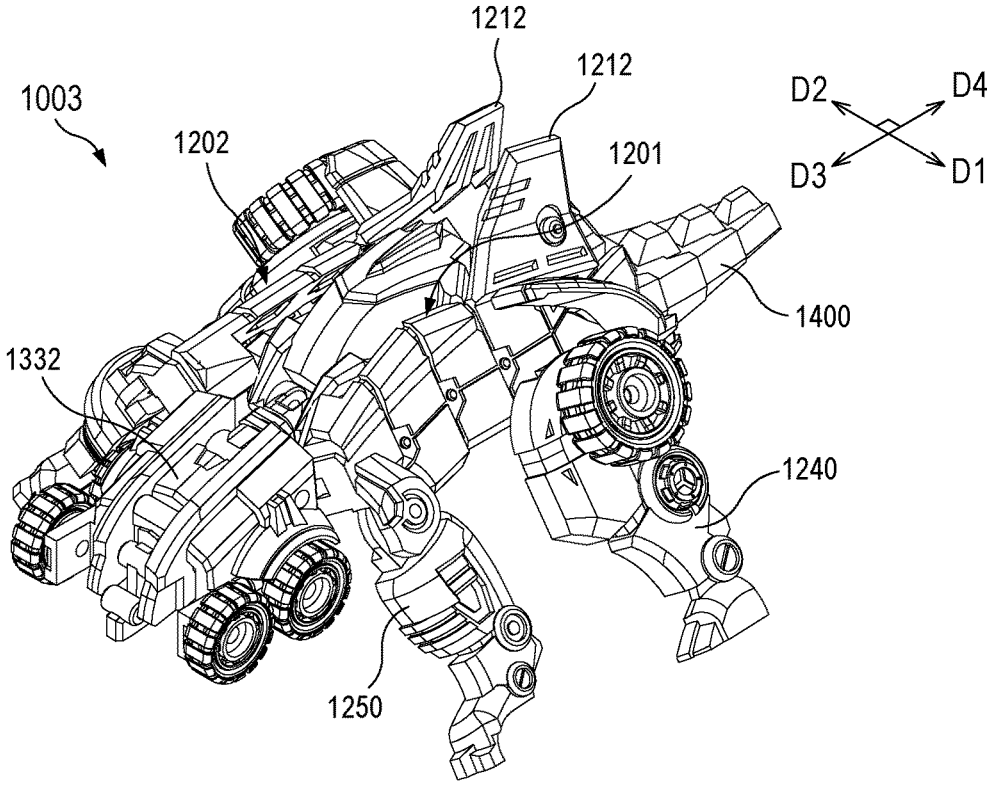
FIG. 46 is a perspective view showing a fourth example where the transformable body of the transformable toy according to the third embodiment is transformed.
Figure 47:
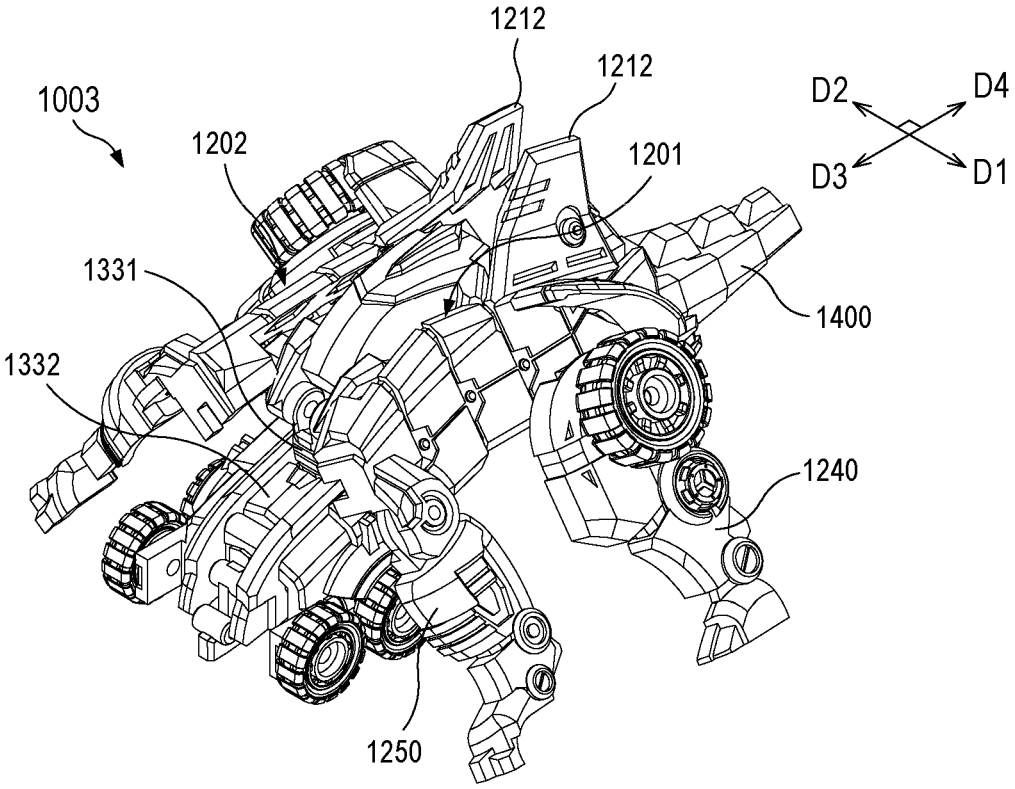
FIG. 47 is a perspective view showing a fifth example where the transformable body of the transformable toy according to the third embodiment is transformed.

Next, referring to FIG. 45, the rear transformation portion 1400 is rotated rearward from the frame portion 1100. Next, referring to FIG. 46, in each of the left and right transformation portions 1201 and 1202, the second rotation portion 1250 is rotated to the upright position, and then the first rotation portion 1240 is rotated to the upright position. Next, referring to FIG. 47, the link portion 1331 of the front transformation portion 1300 is rotated downward with respect to the frame portion 1100, and the distal end portion 1332 is positioned at a position lower than the position in the first state of the transformable body 1003. Next, the distal end portion 1332 is rotated toward the upper surface of the frame portion 1100.

Figure 48:
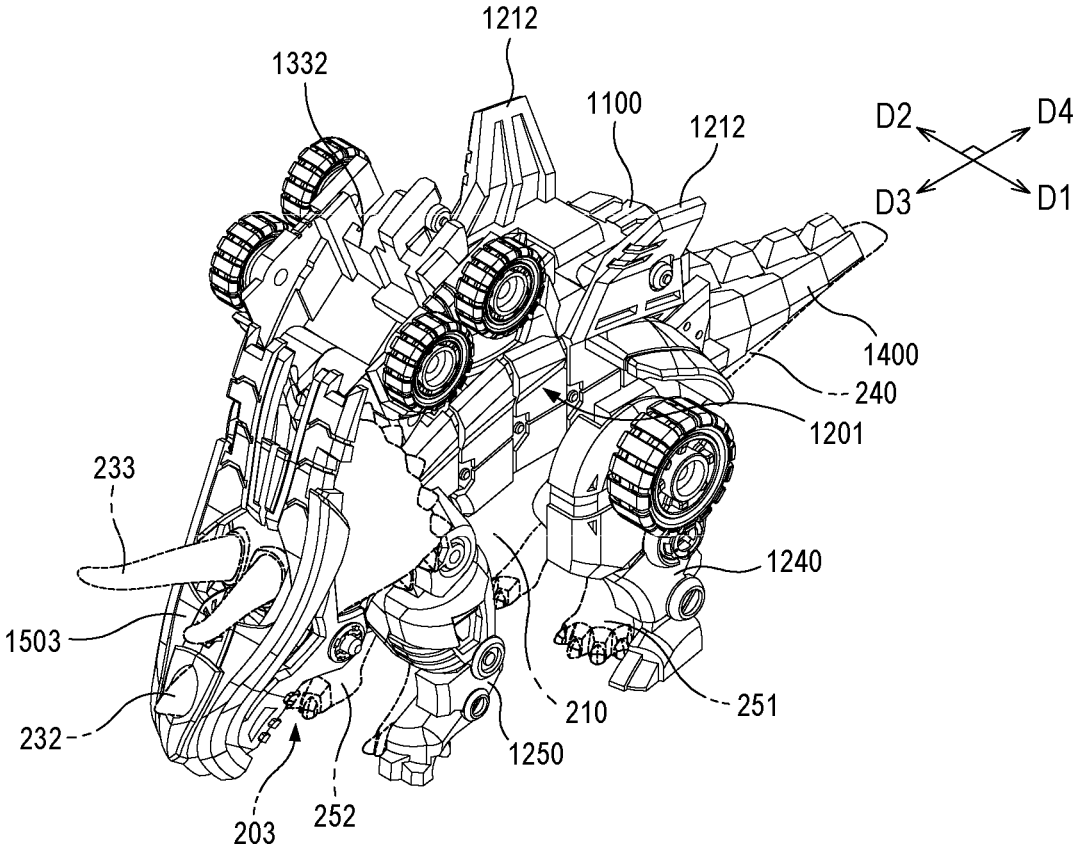
FIG. 48 is a perspective view showing a combination formed by coupling the transformable body and the accessory body of the transformable toy according to the third embodiment to the model toy.
Figure 49:
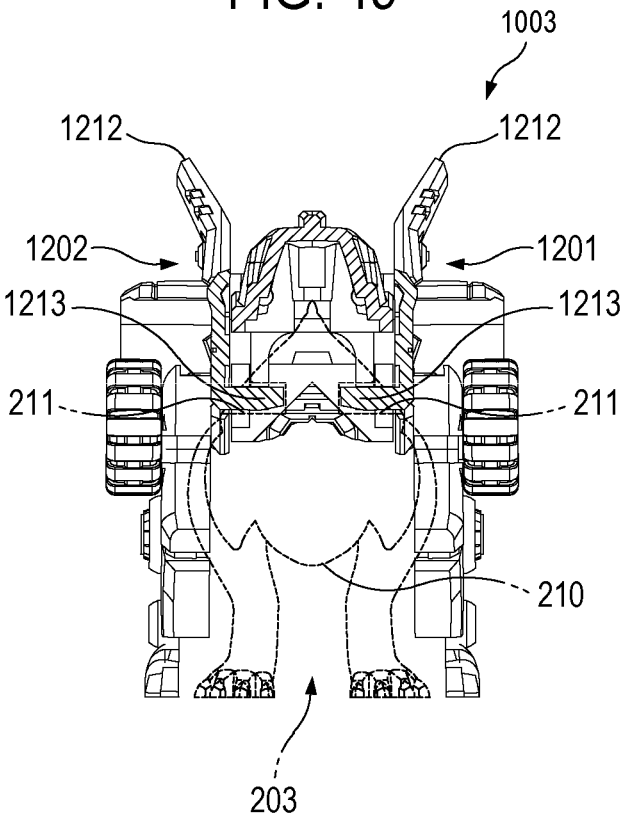
FIG. 49 is a cross-sectional view of the combination of the transformable toy and the model toy shown in FIG. 48.

Next, referring to FIGS. 48 and 49, in the state where the rear transformation portion 1400, the second rotation portions 1250, and the first rotation portions 1240 are unfolded and the distal end portion 1332 is rotated to the upper surface of the frame portion 1100, the user inserts the torso portion 210 of the model toy 203 between the left and right transformation portions 1201 and 1202 moved away from each other to the insertion position (i.e., between the engaging portions moved away from each other). As the user releases the manipulation portions 1212, the left and right transformation portions 1201 and 1202 are rotated to the cover position by the biasing force of the torsion springs such that they are moved toward each other. Therefore, the transformable body 1003 can be temporarily fixed to the model toy 203. When the engaging portions 1213 of the left and right transformation portions 1201 and 1202 are engaged with the counter engaging portions 211, mounting of the transformable body 1003 transformed into the second state on the model toy 203 can be completed, and the transformable body 1003 comes into the second state where the transformable body 1003 covers the model toy 203 and is releasably coupled to the model toy 203. In the state where the transformable body 1003 is mounted on the model toy 203, the frame portion 1100 and the left and right transformation portions 1201 and 1202 cover the torso portion of the model toy, the rear transformation portion 1400 covers the tail extension portion of the model toy, the first rotation portions 1240 cover the hind leg extension portions of the model toy, and the second rotation portions 1250 cover the front leg extension portions of the model toy. In the state where the transformable body 1003 is mounted on the model toy 203, the accessory body 1503 is coupled to the head extension portion of the model toy 203 so as to cover the head extension portion.

The procedures in which the transformable body 1003 is transformed from the second state to the first state may be reversed from the above-described procedures. If the transformable body 1003 is transformed from the second state to the first state and the accessory body 1503 is coupled to the transformable body 1003 in the first state, the transformable toy 103 including the transformable body 1003 takes the form of a vehicle shown in FIG. 34. From the vehicle-shaped form of the transformable toy 103, the user can have fun that the transformable toy before being combined with the model toy takes a vehicle form different from the model toy and can travel.

As shown in FIGS. 35 and 48, in the state where the transformable body 1003 in the second state covers the model toy 203 and the accessory body 1503 is coupled to the model toy 203, the user can recognize, from the combination body of the model toy 203 and the transformable toy 103, that the model toy 203 is wearing a kind of protector (e.g., an armor and helmet). Accordingly, the user can have fun that the transformable toy having the form of a vehicle is transformed so as to become an armor and helmet for the model toy and the model toy is wearing the armor and helmet made by the transformable toy.

Figure 50:
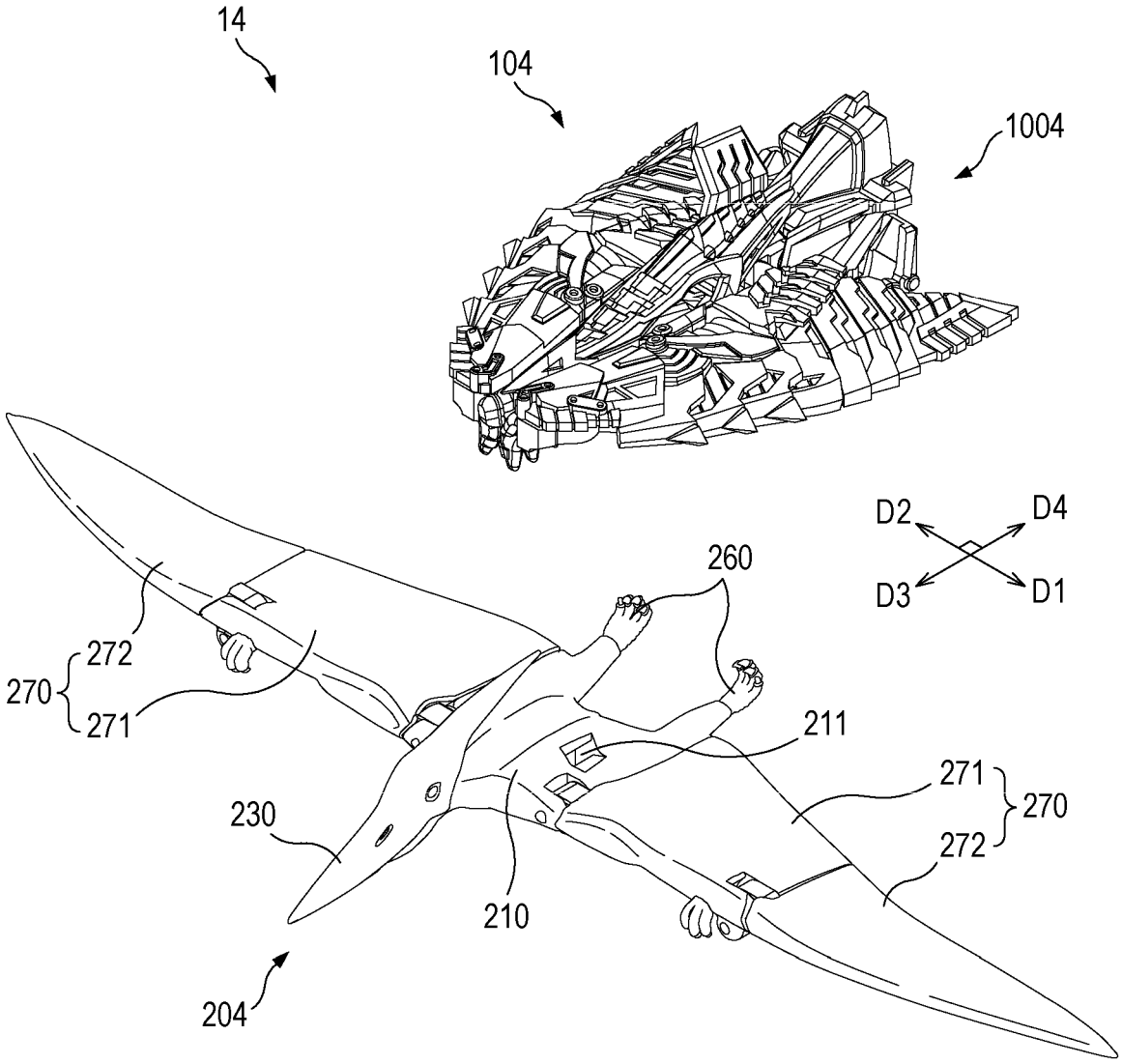
FIG. 50 is a perspective view showing a toy set according to a fourth embodiment of the present disclosure.
Figure 51:
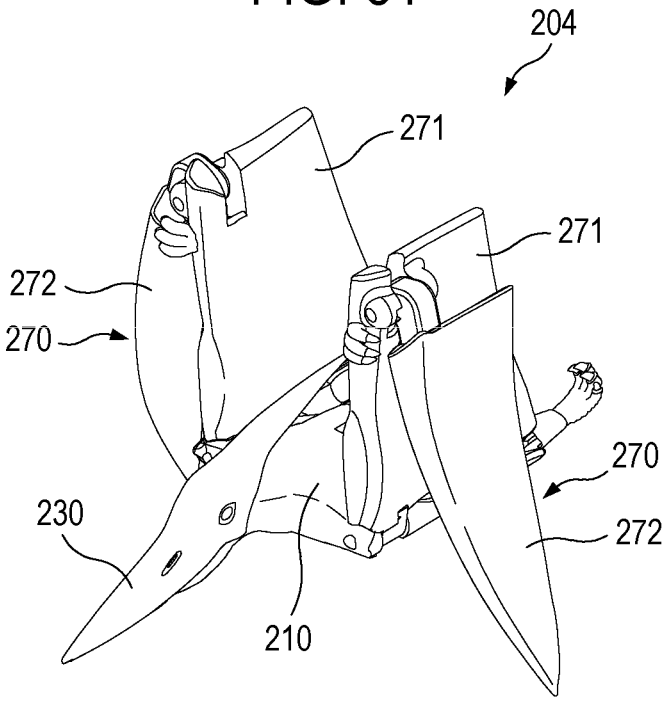
FIG. 51 is a perspective view showing a shape in which a model toy shown in FIG. 50 is transformed by manipulation.
Figure 52:
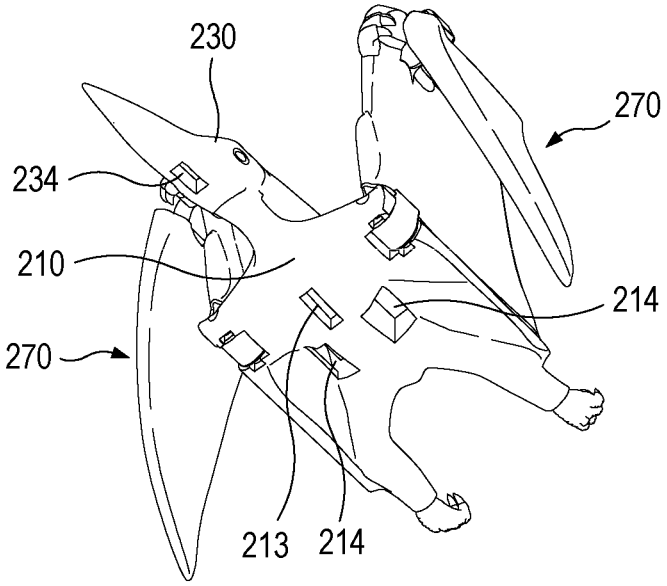
FIG. 52 is a lower perspective view of the model toy shown in FIG. 51.
Figure 53:
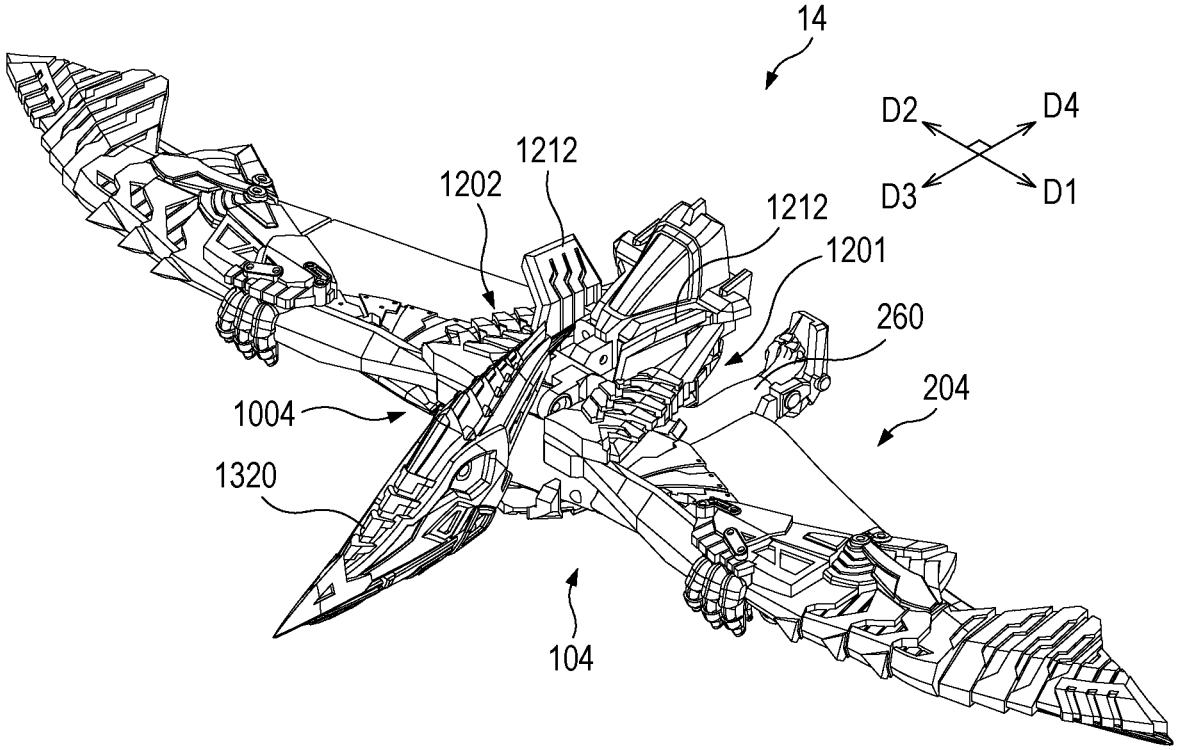
FIG. 53 is a perspective view showing a combination of the model toy and the transformable toy shown in FIG. 50.
Figure 54:
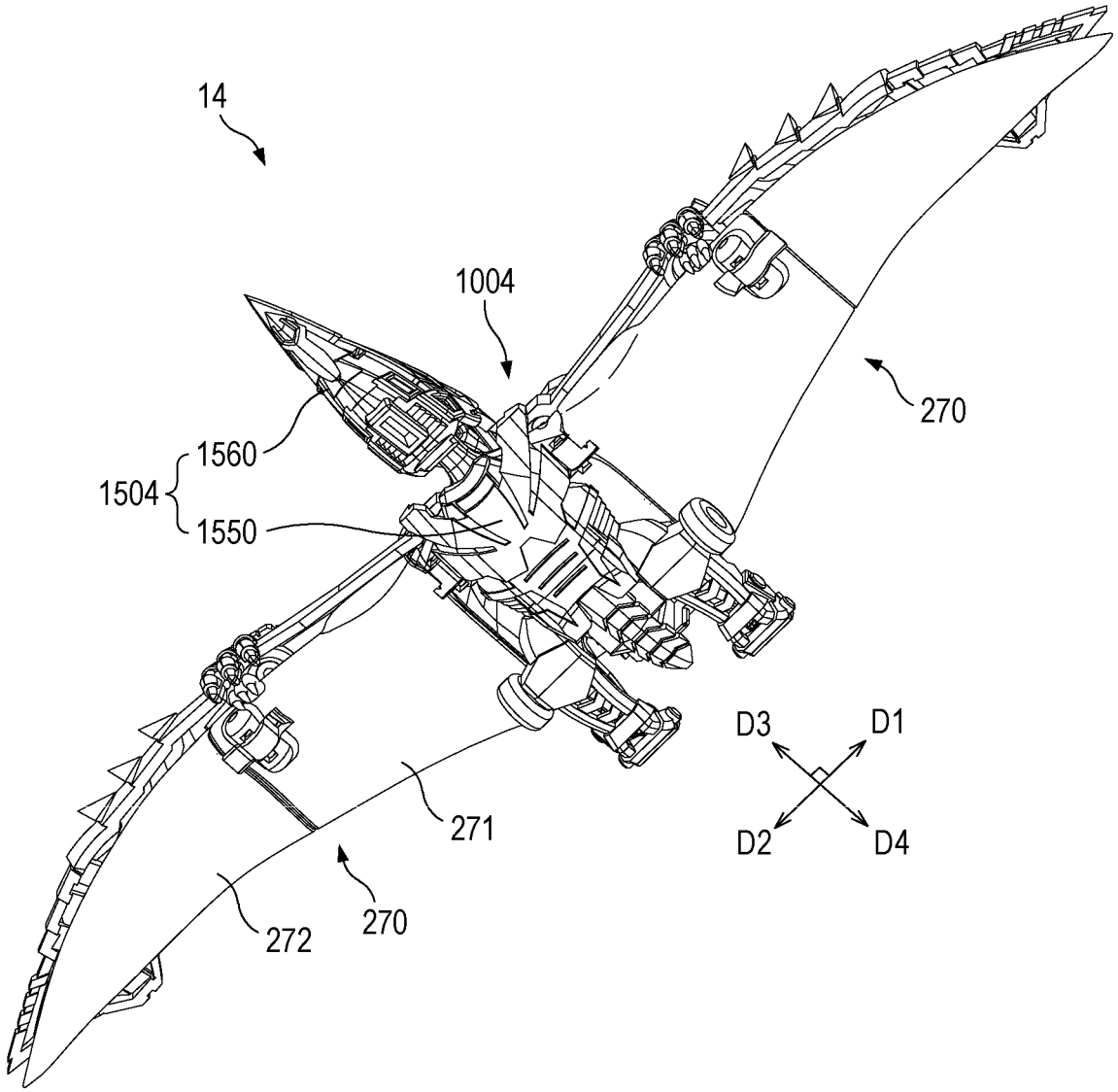
FIG. 54 is a lower perspective view showing the combination of the model toy and the transformable toy shown in FIG. 50.
Figure 55:
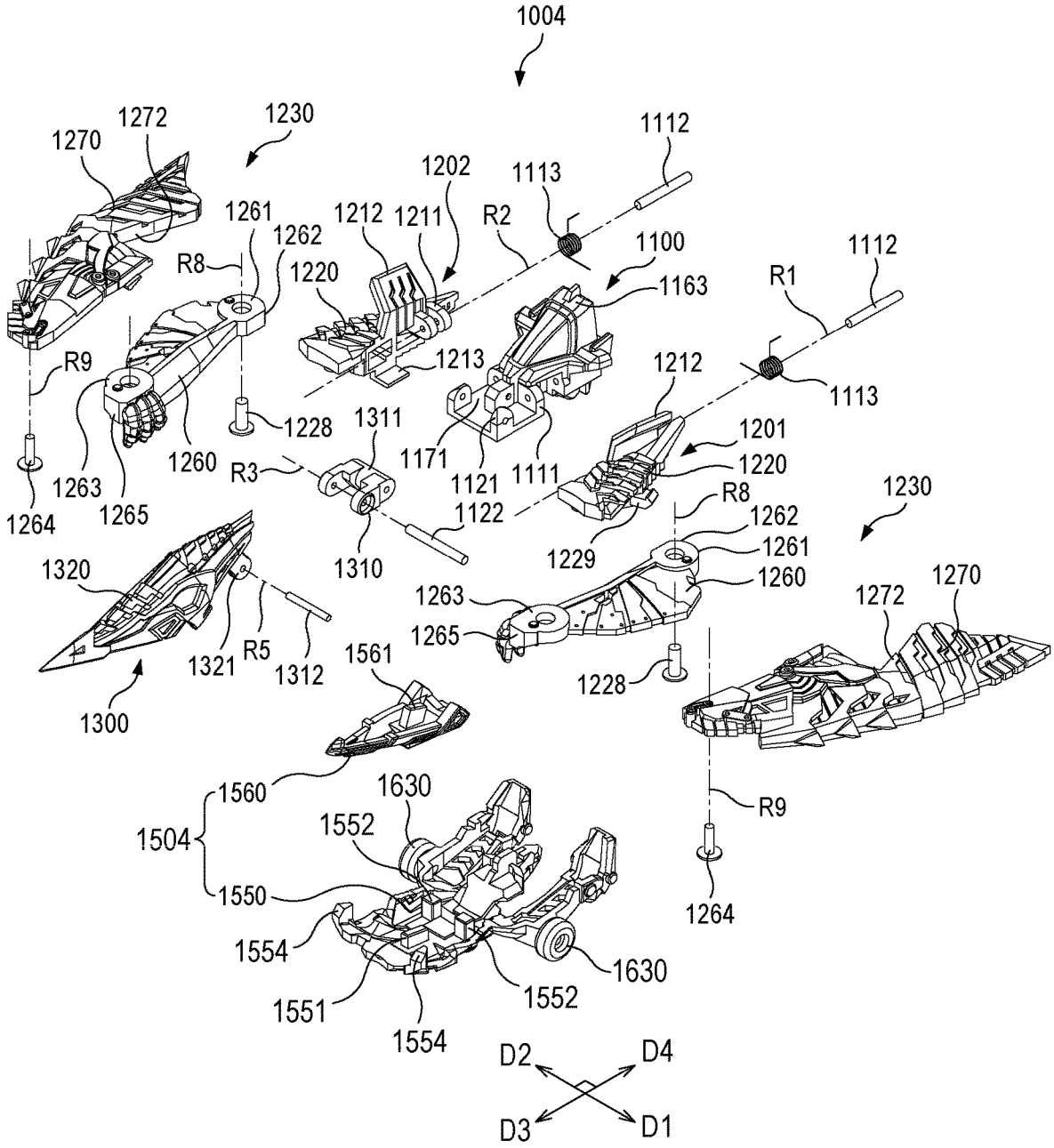
FIG. 55 is an exploded perspective view of the transformable toy shown in FIG. 50.
Figure 56:
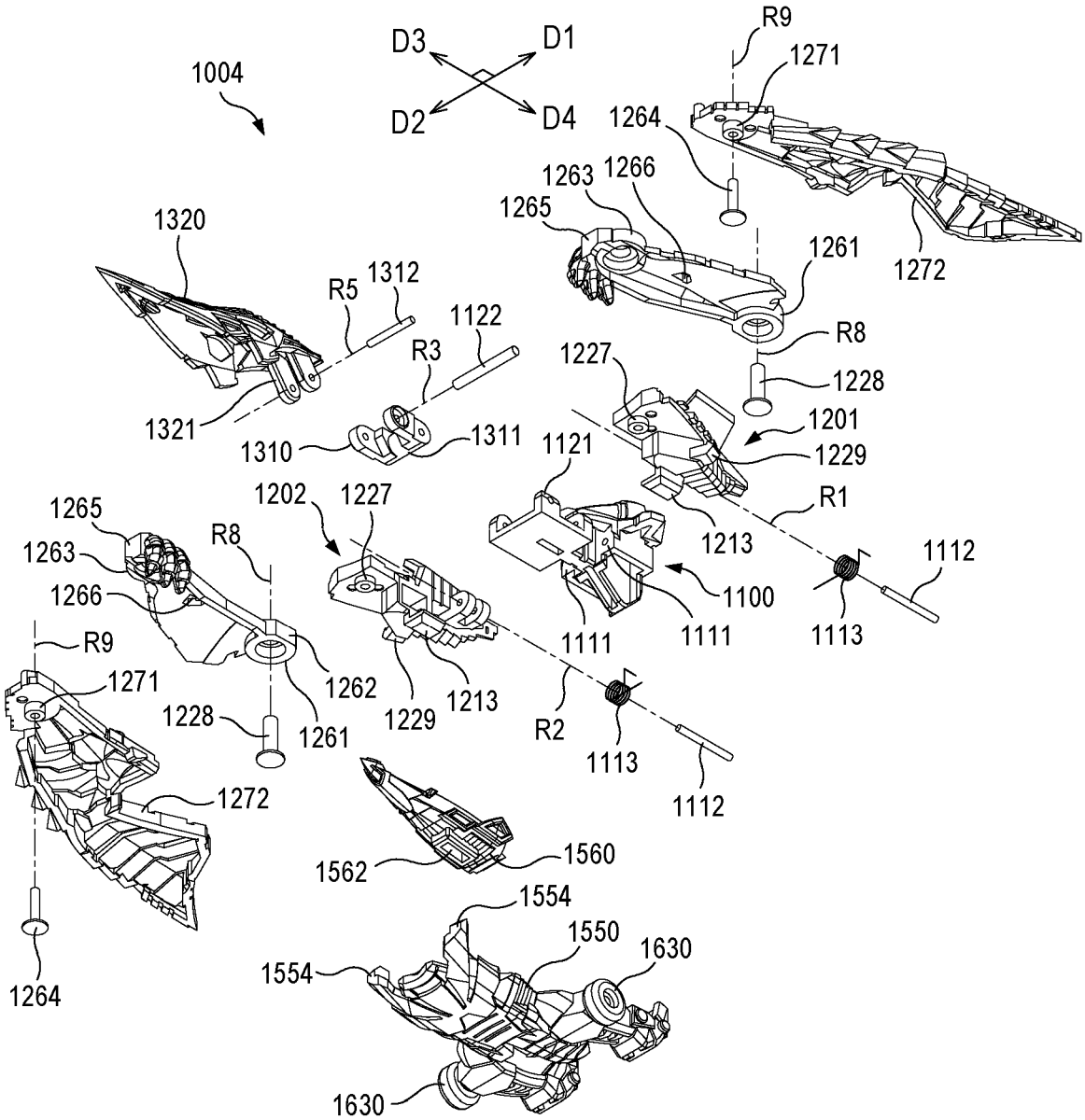
FIG. 56 is another exploded perspective view of the transformable toy shown in FIG. 50.
Figure 61:
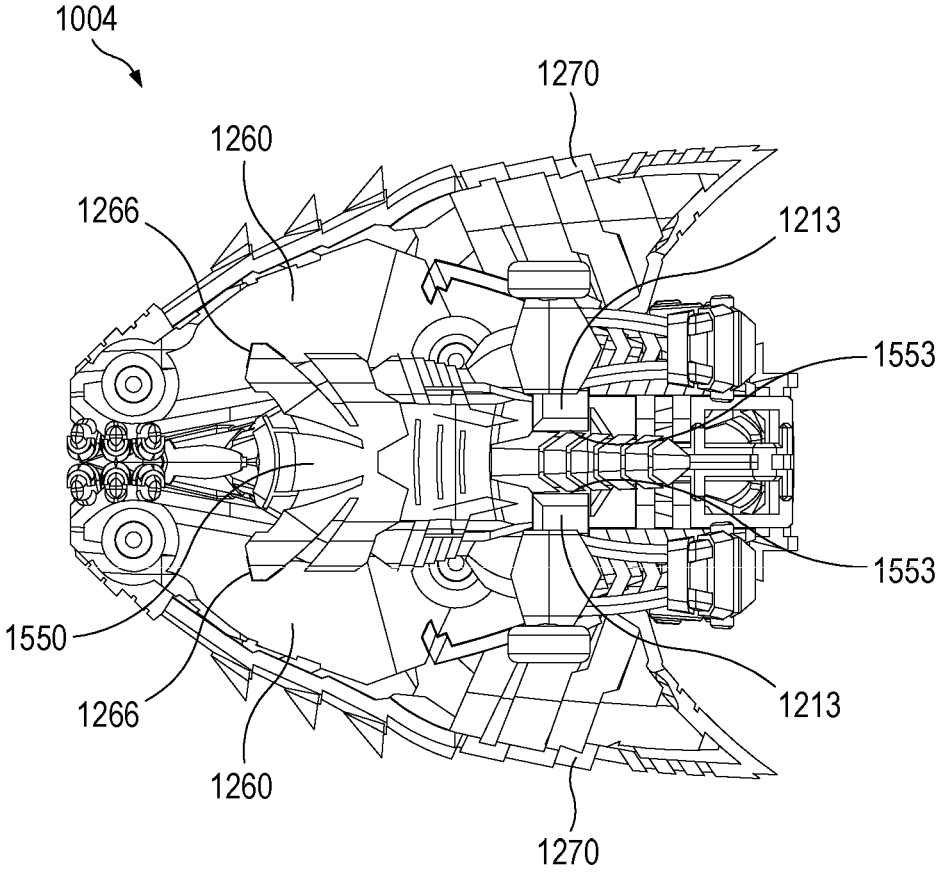
FIG. 61 is a bottom view of the transformable toy shown in FIG. 50.
Figure 62:
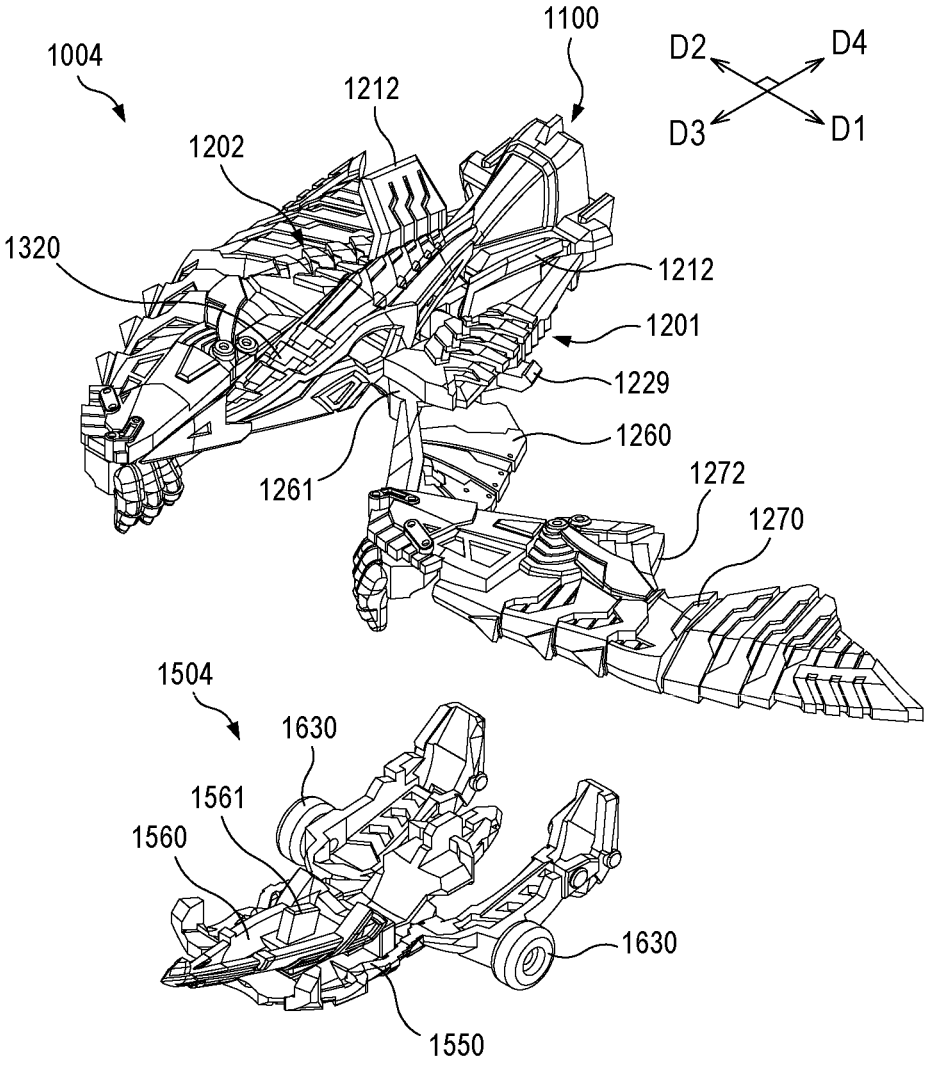
FIG. 62 is a perspective view showing a shape of one of the operations in which a rotation portion of a transformation portion is rotated in the transformable toy according to the fourth embodiment.

Hereinafter, a transformable toy 104, a model toy 204, and a toy set 14 according to a fourth embodiment of the present disclosure are described with reference to FIGS. 50 to 68. FIGS. 50, 53 and 54 show a toy set and a transformable toy according to the fourth embodiment. FIGS. 51 and 52 show another shape of the model toy according to the fourth embodiment. FIGS. 55 and 56 are exploded perspective views of the transformable toy shown in FIG. 50. FIGS. 57 to 61 are a plan view, a side view, a front view, a rear view, and a bottom view of the transformable toy shown in FIG. 50, respectively. FIG. 62 shows an example where a rotation portion is rotated in the transformable toy according to the fourth embodiment. FIGS. 63 to 68 show examples where the transformable toy according to the fourth embodiment is transformed and examples where the transformable toy is coupled to the model toy.

In the following descriptions related to the fourth embodiment, components of the fourth embodiment equivalent or corresponding to those of the foregoing first embodiment are denoted by like reference numerals, and descriptions thereof may be omitted. The components of the fourth embodiment whose description is omitted can be understood by referring to the description of the first embodiment.

Referring to FIG. 50, the toy set 14 according to the fourth embodiment includes the transformable toy 104 and the model toy 204. The model toy 204 has an appearance corresponding to a shape of a flying animal, for example, an appearance corresponding to a shape of a dinosaur which may be called a pteranodon.

In the model toy 204, a counter engaging portion 211 is formed as a fitting groove in the left and right sides of a torso portion 210, and the counter engaging portions 211 function for releasably coupling the model toy 204 and the transformable toy 104. The model toy 204 may have a pair of leg extension portions 260 extending rearward from the torso portion 210, and the pair of leg extension portions 260 may have a shape of legs of a pteranodon.

As shown in FIGS. 50 to 51, the model toy 204 includes a pair of wing extension portions 270 extending laterally from the torso portion 210. The wing extension portions 270 may have a shape of wings of a pteranodon. The wing extension portions 270 are rotatably coupled to the torso portion 210 by hinge joints. As an alternative example, the wing extension portions 270 may be formed integrally with the torso portion 210. Each wing extension portion 270 includes a first wing extension portion 271 rotatably coupled to the torso portion 210 and a second wing extension portion 272 rotatably coupled to the first wing extension portion 271 by a hinge joint. Therefore, as shown in FIGS. 51 and 52, the first and second wing extension portions 271 and 272 of each wing extension portion 270 may take a folded form. As shown in FIG. 52, a fitting hole 213 and a fitting hole 214 are formed in a lower surface of the torso portion 210, and a fitting hole 234 is formed on a lower surface of a head extension portion 230. The fitting hole 213, the fitting hole 214 and the fitting hole 234 function for coupling the model toy 204 and the accessory body of the transformable toy 104.

The transformable toy 104 shown in FIG. 50 is independent from the model toy 204. The transformable toy 104 is transformable so as to cover the model toy 204, and is releasably coupled to the model toy 204 in its transformed state. The transformable toy 104 includes a transformable body 1004 configured to be transformed and to be releasably coupled to the model toy 204. Referring to FIG. 54, the transformable toy 104 includes an accessory body 1504 removably coupled to the transformable body 1004 and configured to partially cover the model toy 204.

Referring to FIGS. 53 and 54, the transformable body 1004 and the accessory body 1504 of the transformable toy 104 are coupled to the model toy 204, thereby making a combination of the transformable toy and the model toy. Therefore, the transformable body 1004 is configured to be transformed into a first state where the transformable body 1004 is independent from the model toy 204 (the state of the transformable body shown in FIG. 50) and a second state where the transformable body 1004 at least partially covers the model toy 204 and is releasably coupled to the model toy 204 (the state of the transformable body shown in FIGS. 53 and 54).

Referring to FIGS. 55 and 56, the transformable body 1004 includes a frame portion 1100 that functions as a base or a spine of the transformable body 1004. The frame portion 1100 is configured to cover a portion of the model toy (a back portion of the torso portion of the model toy shown in FIG. 50) in the second state of the transformable body 1004. The frame portion 1100 has a protrusion 1163 protruding upward from the rear end thereof, and the protrusion 1163 may have a shape that can be recognized as a canopy covering a cockpit.

Further, the transformable body 1004 includes at least one transformation portion rotatably coupled to the frame portion 1100 and configured to be rotated with respect to the frame portion 1100. The at least one transformation portion of the transformable body 1004 is a structural member for performing transformation of the transformable body into the first state and the second state, and is a structural member coupled to the frame portion 1100 to constitute the transformable body 1004 together with the frame portion 1100. In this embodiment, the transformable body 1004 includes, as the at least one transformation portion, left and right transformation portions 1201 and 1202, and a front transformation portion 1300. The left and right transformation portions 1201 and 1202 and the front transformation portion 1300 according to this embodiment are configured to partially cover a portion of the model toy in the second state of the transformable body 1004. The left and right transformation portions 1201 and 1202 and the front transformation portion 1300 are coupled to the frame portion 1100 so as to be rotatable about their respective corresponding rotation axes. Further, for transformation of the transformable body 1004 from one of the first and second states to the other of the first and second states, the left and right transformation portions 1201 and 1202 and the front transformation portion 1300 are configured to be rotated about the respective corresponding rotation axes with respect to the frame portion 1100 or to be rotated in two or more different directions. Further, for transformation of the transformable body 1004 from the second state of the transformable body 1004 to the first state, the left and right transformation portions 1201 and 1202 and the front transformation portion 1300 are configured to be folded with respect to the frame portion 1100 about their respective corresponding rotation axes. Therefore, the left and right transformation portions 1201 and 1202 and the front transformation portion 1300 can be manipulated for transformation of the transformable body from one of the first and second states to the other of the first and second states, by being rotated with respect to the frame portion 1100 or being folded with respect to the frame portion 1100.

Referring to FIGS. 55 and 56, the transformable body 1004 includes, as the two transformation portions constituting the at least one transformation portion, a left transformation portion 1201 and a right transformation portion 1202 configured to be rotated in two different directions with respect to the frame portion 1100.

The left transformation portion 1201 and the right transformation portion 1202 are configured to be rotated in two different directions with respect to the frame portion 1100 (i.e., clockwise and counterclockwise with respect to the frame portion 1100) for transformation of the transformable body from one of the first state of the transformable body shown in FIG. 19 and the second state of the transformable body shown in FIG. 20 to the other of the states. Therefore, the left and right transformation portions 1201 and 1202 are configured to be rotated with respect to the frame portion 1100 about the respective corresponding rotation axes (i.e., the first rotation axis R1 and the second rotation axis R2) so as to be moved away from or moved toward each other. Regarding the rotation of the left and right transformation portions 1201 and 1202, the left transformation portion 1201 is coupled to the frame portion 1100 so as to be rotatable about the first rotation axis R1, and the right transformation portion 1202 is coupled to the frame portion 1100 so as to be rotatable about the second rotation axis R2 (see FIG. 57). The second rotation axis R2 is spaced apart from the first rotation axis R1 and may be parallel to the first rotation axis R1 or inclined toward the first rotation axis R1.

The first rotation axis R1 passes through a portion of the frame portion 1100 in the first direction D1, and the second rotation axis R2 passes through a portion of the frame portion 1100 in the second direction D2 opposite to the first direction D1. As an alternative example, the first rotation axis R1 and the second rotation axis R2 may constitute one rotation axis, and the frame portion 1100 may be configured to rotate the left and right transformation portions 1201 and 1202 about one rotation axis in different directions.

The left and right transformation portions 1201 and 1202 are configured to be unfolded with respect to the frame portion 1100 in the second state of the transformable body 1004 and to be folded with respect to the frame portion 1100 in the first state of the transformable body 1004. The left and right transformation portions 1201 and 1202 are unfolded with respect to the frame portion 1100 in the second state of the transformable body 1004 by being rotated in different directions while being moved away from each other with respect to the frame portion 1100. The left and right transformation portions 1201 and 1202 are folded with respect to the frame portion 1100 in the first state of the transformable body 1004 by being rotated in different directions while being moved toward each other with respect to the frame portion 1100.

The left and right transformation portions 1201 and 1202 are configured to cover a portion of the model toy in the second state of the transformable body 1004. The left transformation portion 1201 may be configured to cover a portion of the model toy in the first direction D1 (a left side surface of the torso portion of the model toy shown in FIG. 50) in the second state of the transformable body 1004. The right transformation portion 1202 may be configured to cover another portion of the model toy in the second direction D2 (a right side surface of the torso portion of the model toy shown in FIG. 50) in the second state of the transformable body 1004.

Accordingly, the left and right transformation portions 1201 and 1202 can be rotated about the first and second rotation axes R1 and R2, respectively, in the transformable body 1004 so as to be moved away from or toward each other. Specifically, the left and right transformation portions 1201 and 1202 can be rotated to an insertion position where the left and right transformation portions 1201 and 1202 are moved away from each other to allow the torso portion of the model toy to be inserted between the left and right transformation portions, and a cover position where the left and right transformation portions are moved toward each other to cover the torso portion of the model toy.

The frame portion 1100 and the left and right transformation portions 1201 and 1202 are respectively connected by the above-described first and second hinge joints. The hinge portion 1111 provided at the left side of the frame portion 1100 becomes the portion of the frame portion 1100 in the first direction D1 through which the first rotation axis R1 passes. The hinge portion 1111 provided at the right side of the frame portion 1100 becomes the portion of the frame portion 1100 in the second direction D2 through which the second rotation axis R2 passes. The respective hinge shafts 1112 correspond to the first rotation axis R1 and the second rotation axis R2.

The frame portion 1100 of the transformable body 1004 includes torsion springs 1113 disposed between the frame portion 1100 and each of the left and right transformation portions 1201 and 1202 to bias the left and right transformation portions 1201 and 1202 toward the cover position. The left and right transformation portions 1201 and 1202 are biased by the biasing force of the torsion springs 1113 so as to be moved toward each other. Accordingly, the transformable body 1004 can be stably coupled to the model toy in the state where the left and right transformation portions 1201 and 1202 biased toward each other are coupled to the torso portion of the model toy. Further, by the biasing force of the torsion springs 1113, the rotatable transformation portions of the transformable body 1004 can be stably maintained in the first state of the transformable body 1004. As an alternative example, the transformable body 1004 may include at least one spring disposed between the left and right transformation portions 1201 and 1202.

The torsion springs 1113 are disposed in the respective corresponding rotation axes of the left and right transformation portions 1201 and 1202 to bias one of the left and right transformation portions 1201 and 1202 toward the other. The torsion springs 1113 are disposed between the frame portion 1100 and the left and right transformation portions 1201 and 1202 such that the hinge shafts 1112 pass through the insides of the torsion springs 1113, respectively. For example, one end of each of the torsion springs 1113 may be engaged on the surface of the frame portion 1100, and the other end of each of the torsion springs 1113 may be engaged on the counter hinge portion 1211. The respective inner surfaces of the left and right transformation portions 1201 and 1202 biased by the torsion springs 1113 make contact with the respective side surfaces of the frame portion 1100, whereby the rotation of the left and right transformation portions 1201 and 1202 toward the inside of the frame portion 1100 can be restricted.

The left and right transformation portions 1201 and 1202 include a manipulation portion 1212. Each manipulation portion 1212 has a shape that can be recognized as a wing, and is formed as a protrusion protruding from the base end of each of the left and right transformation portions 1201 and 1202. The manipulation portions 1212 extend from the base ends of the left and right transformation portions 1201 and 1202 in an oblique direction between the first direction D1 or the second direction D2 and the upward side. The manipulation portions 1212 may be manipulated to rotate the left and right transformation portions 1201 and 1202 against the biasing force of the torsion springs 1113. The left and right transformation portions 1201 and 1202 can be rotated about the respective corresponding rotation axes (e.g., the first rotation axis R1 and the second rotation axis R2) in the direction of the force applied to the manipulation portions 1212. For example, as the user pinches the pair of manipulation portions 1212 and manipulates the pair of manipulation portions 1212 to move the pair of manipulation portions 1212 toward each other, the left and right transformation portions 1201 and 1202 are moved away from each other and are rotated to the insertion position. In the state where the left and right transformation portions 1201 and 1202 are moved away from each other by the pair of manipulation portions 1212, the torso portion of the model toy can be inserted between the left and right transformation portions 1201 and 1202. Thereafter, as the manipulation portions 1212 are released, the left and right transformation portions 1201 and 1202 are moved toward each other by the biasing force of the torsion springs 1113 and can cover the torso portion and the hind leg extension portions of the model toy.

The left and right transformation portions 1201 and 1202 are configured to grip the model toy. In this regard, the left and right transformation portions 1201 and 1202 include an engaging portion 1213 which protrudes from the distal end of each of the left and right transformation portions and is formed as a male engaging portion such as a protrusion or a pin. Further, the model toy includes, at each of the left and right surfaces of the torso portion, a counter engaging portion 211 (see FIG. 50) that is configured to be complementarily coupled to the engaging portion 1213. The counter engaging portions 211 are formed as a female engaging portion such as a concave groove. In the second state of the transformable body 1004, the engaging portions 1213 are fitted to the counter engaging portions 211 in the first direction D1 or the second direction D2. Therefore, the transformable body 1004 transformed into the second state can be coupled to the model toy while the left and right transformation portions 1201 and 1202 cover the torso portion of the model toy and releasably grip the torso portion of the model toy.

The left and right transformation portions 1201 and 1202 releasably couple the transformable body 1004 transformed into the second state to the model toy. If the transformable body 1004 transformed into the second state is coupled to the model toy, the frame portion 1100 and the left and right transformation portions 1201 and 1202 cover a portion of the model toy. Accordingly, the frame portion 1100 and the left and right transformation portions 1201 and 1202 can be recognized by the user as a portion of a kind of protector (an armor) that covers the model toy.

In this embodiment, the transformable body 1004 includes, as the at least one transformation portion, a front transformation portion 1300. The front transformation portion 1300 is coupled to the frame portion 1100 so as to be rotatable about its corresponding rotation axis, i.e., the third rotation axis R3 (see FIG. 57). In the second state of the transformable body 1004, the front transformation portion 1300 is configured to cover another portion of the model toy (e.g., the head extension portion of the model toy shown in FIG. 50) that extends in the third direction D3 from the portion of the model toy covered by the frame portion 1100 (e.g., the torso portion of the model toy shown in FIG. 50).

Figure 57:
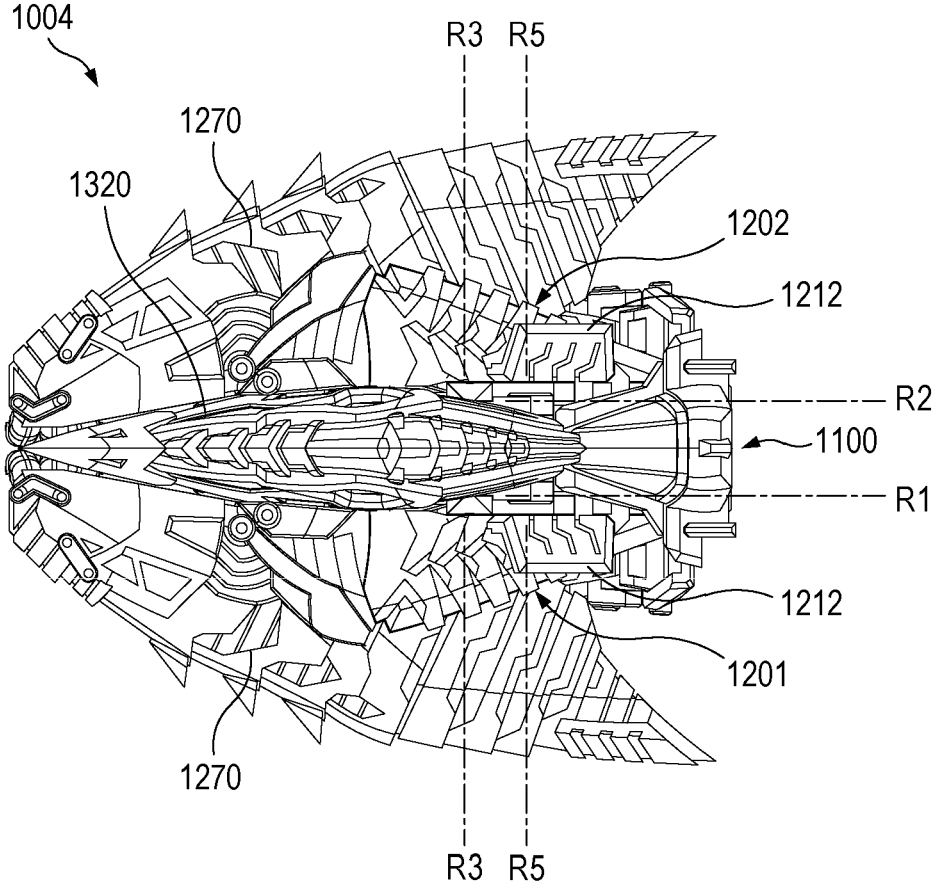
FIG. 57 is a plan view of the transformable toy shown in FIG. 50.

The front transformation portion 1300 includes a link portion 1310 coupled to the frame portion 1100 so as to be rotatable about a third rotation axis R3, and a distal end portion 1320 coupled to the vicinity of the front end of the link portion 1310 so as to be rotatable about a fifth rotation axis R5 (see FIG. 57). The distal end portion 1320 is configured to cover the head extension portion of the model toy. The distal end portion 1320 has a shape partially corresponding to an appearance of the head extension portion of the model toy, for example, a shape that can recognized by the user as a helmet covering the head extension portion.

The frame portion 1100 and the link portion 1310 are connected by the above-described third hinge joint. The link portion 1310 of this embodiment can be inserted into a recessed portion 1171 formed in the frame portion 1100 in the first state of the transformable body 1004. The link portion 1310 of this embodiment can be rotated so as to protrude from the recessed portion 1171 to the front side of the frame portion 1100. Further, in the second state of the transformable body 1004, the link portion 1310 makes contact with the front end of the frame portion 1100, whereby the downward rotation of the link portion 1310 can be restricted. The link portion 1310 and the distal end portion 1320 are connected by the above-described fifth hinge joint. In the first state of the transformable body 1004, the distal end portion 1320 is rotated such that the rear end thereof makes contact with the protrusion 1163. In the second state of the transformable body 1004, the distal end portion 1320 is positioned further frontward than the position of the distal end portion 1320 in the first state of the transformable body 1004.

Each of the left and right transformation portions 1201 and 1202 includes a support portion 1220 and a rotation portion 1230 rotatably coupled to the support portion 1220.

The support portion 1220 has a predetermined shape and may constitute a main body of each of the left and right transformation portions 1201 and 1202. The support portion 1220 may function as a support which rotatably supports the rotation portion 1230 and supports the frame portion 1100 and the model toy with respect to the rotation centers of the left and right transformation portions 1201 and 1202. The support portion 1220 is configured to cover a portion of the side surface of the torso portion of the model toy in the second state of the transformable body 1004. Since the support portion 1220 is provided with the counter hinge portion 1211, the respective corresponding rotation axes (i.e., the first rotation axis R1 and the second rotation axis R2) of the left and right transformation portions 1201 and 1202 are disposed in the support portion 1220.

The rotation portion 1230 of each of the left and right transformation portions 1201 and 1202 is configured to cover another portion of the model toy (the wing extension portion of the model toy shown in FIG. 50) that extends from the portion of the model toy corresponding to the support portion 1220 (the torso portion of the model toy shown in FIG. 50). In this embodiment, the rotation portion of each of the left and right transformation portions 1201 and 1202 includes a first rotation portion 1260 rotatably coupled to the support portion 1220 and a second rotation portion 1270 rotatably coupled to the first rotation portion 1260. The rotation portion 1230 of each of the left and right transformation portions 1201 and 1202, which is composed of the first rotation portion 1260 and the second rotation portion 1270, can be rotated to a folded position shown in FIG. 57 and an unfolded position shown in FIG. 53. At the folded position, the first rotation portion 1260 and the second rotation portion 1270 overlap each other in the left direction or the right direction, and extend substantially in the direction of the first rotation axis R1 or the second rotation axis R2. At the unfolded position, as shown in FIG. 62, the first rotation portion 1260 protrudes with respect to the support portion 1220 in the first direction D1 or the second direction D2, and the second rotation portion 1270 is rotated in the protruding direction of the first rotation portion 1260. When the first rotation portion 1260 and the second rotation portion 1270 are rotated to the unfolded position, the user can recognize that the first rotation portion 1260 and the second rotation portion 1270 are transformed into a shape of an unfolded wing.

In this embodiment, the first rotation portion 1260 is disposed at the front end of each of the left and right transformation portions 1201 and 1202 and is configured to partially cover the first wing extension portion of the model toy (see FIG. 50). The second rotation portion 1270 is disposed at the distal end of the first rotation portion 1260 and is configured to partially cover the second wing extension portion of the model toy (see FIG. 50).

Figure 58:
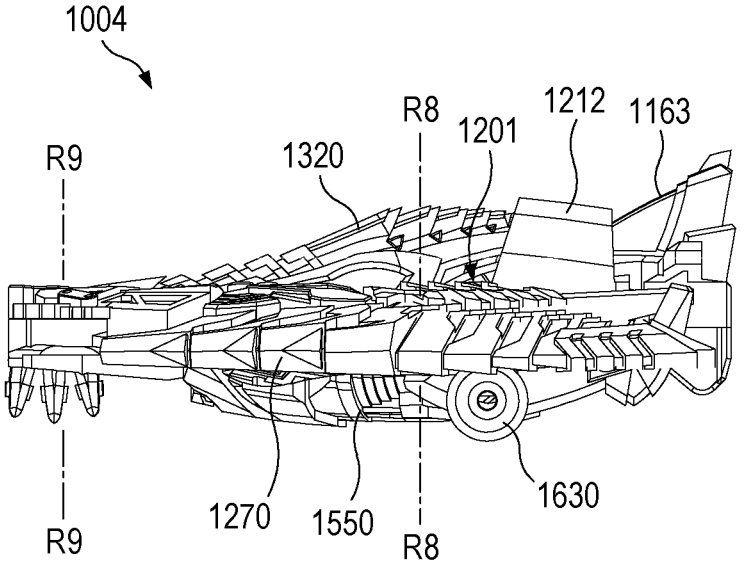
FIG. 58 is a side view of the transformable toy shown in FIG. 50.
Figure 59:
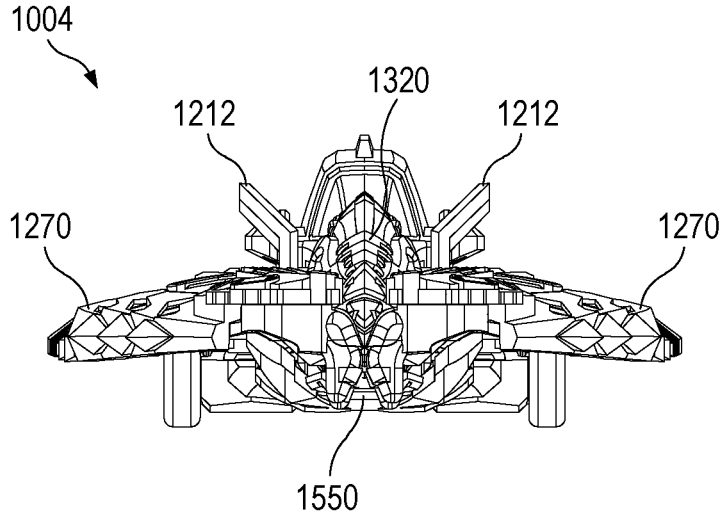
FIG. 59 is a front view of the transformable toy shown in FIG. 50.
Figure 60:
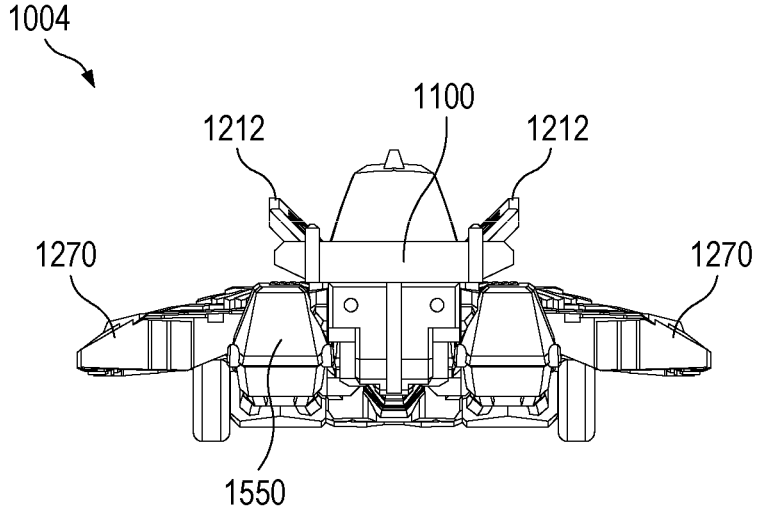
FIG. 60 is a rear view of the transformable toy shown in FIG. 50.

The first rotation portion 1260 is coupled to the support portion 1220 so as to be rotatable about an eighth rotation axis R8 (see FIG. 58). The support portion 1220 and the first rotation portion 1260 are connected by an eighth hinge joint. The eighth hinge joint may be composed of a hinge portion 1227 provided at the front end of the support portion 1220, a counter hinge portion 1261 provided at the base end of the first rotation portion 1260, and a hinge shaft 1228 coupled to the hinge portion 1227 and the counter hinge portion 1261. The support portion 1220 is provided with a stopper portion 1229 protruding outward from the lateral end of the support portion. The rear end of the first rotation portion 1260 makes contact with the stopper portion 1229, whereby the rearward rotation of the first rotation portion 1260 can be restricted. The counter hinge portion 1261 is provided with a stopper portion 1262. The stopper portion 1262 makes contact with the inner surface of the support portion 1220, whereby the frontward rotation of the first rotation portion 1260 can be restricted.

The second rotation portion 1270 is coupled to the first rotation portion 1260 so as to be rotatable about a ninth rotation axis R9 (see FIG. 58). The second rotation portion 1270 and the first rotation portion 1260 are connected by a ninth hinge joint. The ninth hinge joint may be composed of a hinge portion 1263 provided in the distal end of the first rotation portion 1260, a counter hinge portion 1271 provided in the base end of the second rotation portion 1270, and a hinge shaft 1264 coupled to the hinge portion 1263 and the counter hinge portion 1271. A stopper portion 1265 is provided in the hinge portion 1263. The stopper portion 1265 makes contact with the edge of the second rotation portion 1270 in the vicinity of the base end of the second rotation portion, whereby the frontward rotation of the second rotation portion 1270 can be restricted. A recessed portion 1272 is formed at the inner edge of the second rotation portion 1270. The recessed portion 1272 is concave so as to correspond to a shape of the front edge and the side edge of the support portion 1220. Therefore, in the first state of the transformable body 1004, the second rotation portion 1270 can be rotated to the folded position while accommodating the front edge and the side edge of the support portion 1220. Accordingly, the transformable body 1004 can have a reduced width dimension in the first state, and can be transformed into the first state more compactly.

The transformable toy 104 includes an accessory body 1504 which is removably coupled to a first position of the transformable body 1004 in the first state of the transformable body 1004 and is releasably coupled to a predetermined position of the model toy in the second state of the transformable body 1004.

The accessory body 1504 is configured to cover a portion of the model toy in the second state of the transformable body 1004. The accessory body 1504 includes a first accessory covering portion 1550 and a second accessory covering portion 1560.

The first accessory covering portion 1550 is configured to cover an abdomen portion of the torso portion of the model toy (see FIG. 54) and a lower surface of the leg extension portion of the model toy (see FIG. 54). The first accessory covering portion 1550 has, at its upper surface, a fitting protrusion 1551 and a fitting protrusion 1552. The fitting protrusion 1551 is fitted into the fitting hole 213 (see FIG. 52) formed in the torso portion of the model toy. The fitting protrusion 1552 is fitted into the fitting hole 214 (see FIG. 52) formed in the torso portion of the model toy. Therefore, in the second state of the transformable body 1004, the first accessory covering portion 1550 can be releasably coupled to the model toy so as to cover the lower portion of the torso portion of the model toy and the leg extension portion of the model toy. The first accessory covering portion 1550 can be recognized as a protector (an armor) covering the abdomen and the legs of the model toy.

The second accessory covering portion 1560 is configured to cover the lower surface of the head extension portion of the model toy. The second accessory covering portion 1560 has a fitting protrusion 1561 at its upper surface. The fitting protrusion 1561 is fitted into the fitting hole 234 (see FIG. 52) formed in the head extension portion of the model toy. Therefore, the second accessory covering portion 1560 can be recognized as a portion of a helmet covering the lower portion of the head of the model toy. Further, the second accessory covering portion 1560 is removably coupled to the first accessory covering portion 1550 in the first state of the transformable body 1004, and is located below the distal end portion 1320 in the first state of the transformable body 1004. A fitting hole 1562 is formed in the lower surface of the second accessory covering portion 1560, and the fitting protrusion 1551 of the first accessory covering portion 1550 is fitted into the fitting hole 1562. Therefore, the second accessory covering portion 1560 is coupled to the first accessory covering portion 1550 in the first state of the transformable body 1004 and is held in the transformable body 1004.

The accessory body 1504 is configured to be engaged with the left and right transformation portions 1201 and 1202 moved toward each other in the first state of the transformable body 1004. The first accessory covering portion 1550 has a pair of fitting grooves 1553 (see FIG. 61) at its lower surface in the vicinity of the rear end, and a pair of fitting protrusions 1554 (see FIG. 55) at its upper surface of the front end. As shown in FIG. 61, in the first state of the transformable body 1004, the engaging portion 1213 of each of the left and right transformation portions 1201 and 1202 is engaged with the fitting groove 1553. The first rotation portions 1260 of the left and right transformation portions 1201 and 1202 have fitting holes 1266 (see FIGS. 56 and 61) corresponding to the fitting protrusions 1554, respectively. In the first state of the transformable body 1004, the fitting protrusions 1554 of the first accessory covering portion 1550 are fitted into the fitting holes 1266 of the first rotation portions 1260. Therefore, in the first state of the transformable body 1004, the accessory body 1504 can be engaged with the left and right transformation portions 1201 and 1202 moved toward each other, by virtue of the engagement between the engaging portions 1213 and the fitting grooves 1553 and the fitting between the fitting holes 1266 and the fitting protrusions 1554.

The first state of the transformable body 1004 takes a form different from the appearance of the model toy 204. The first state of the transformable body 1004 has a form corresponding to a shape of an airplane (see FIG. 50). Further, the transformable body 1004 can be moved on the ground in the first state. For the movable form of the transformable body 1004, the transformable body 1004 includes a plurality of wheels for movement on the ground in the first state. In this embodiment, the transformable body 1004 includes wheels 1630 rotatably coupled to the respective lateral ends of the first accessory covering portion 1550. The accessory body 1504 can be coupled to the transformable body 1004 transformed into the first state, such that the wheels 1630 can be placed on the ground in the first state of the transformable body 1004. As another example of the transformable body 1004, the transformable body 1004 may further include wheels disposed at the front portion of the transformable body. Alternatively, the transformable body 1004 may further include wheels disposed in the rotation portions of the left and right transformation portions 1201 and 1202.

Examples where the transformable toy according to this embodiment is transformed and examples where the transformable toy and the model toy are coupled to each other are described with reference to FIGS. 63 to 68.

Figure 63:
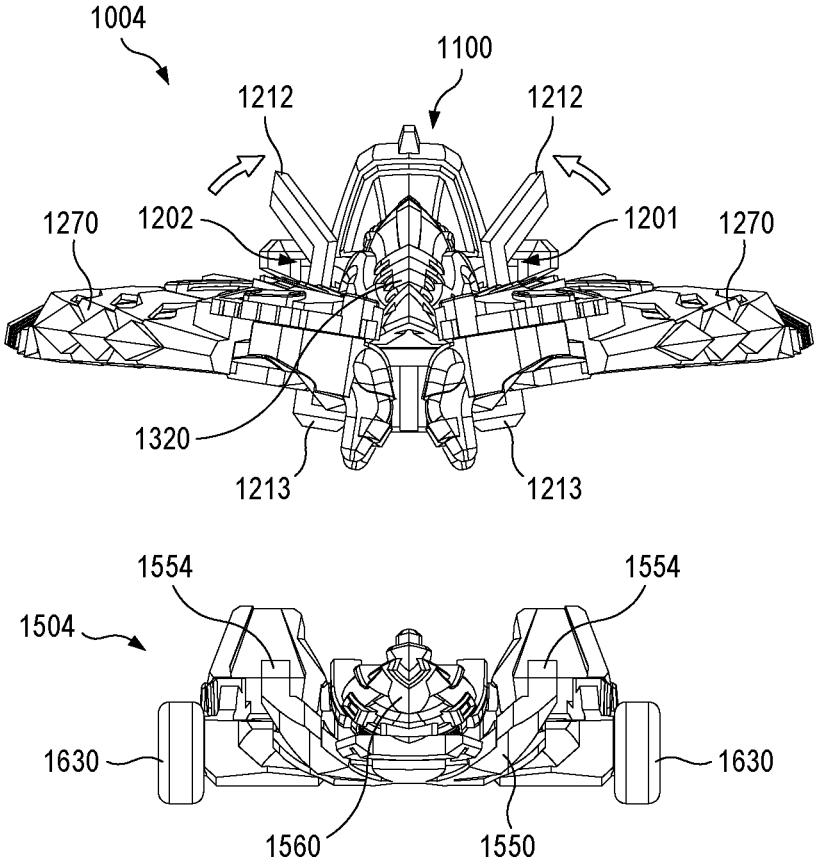
FIG. 63 is a front view showing a first example where the transformable body of the transformable toy according to the fourth embodiment is transformed.
Figure 64:
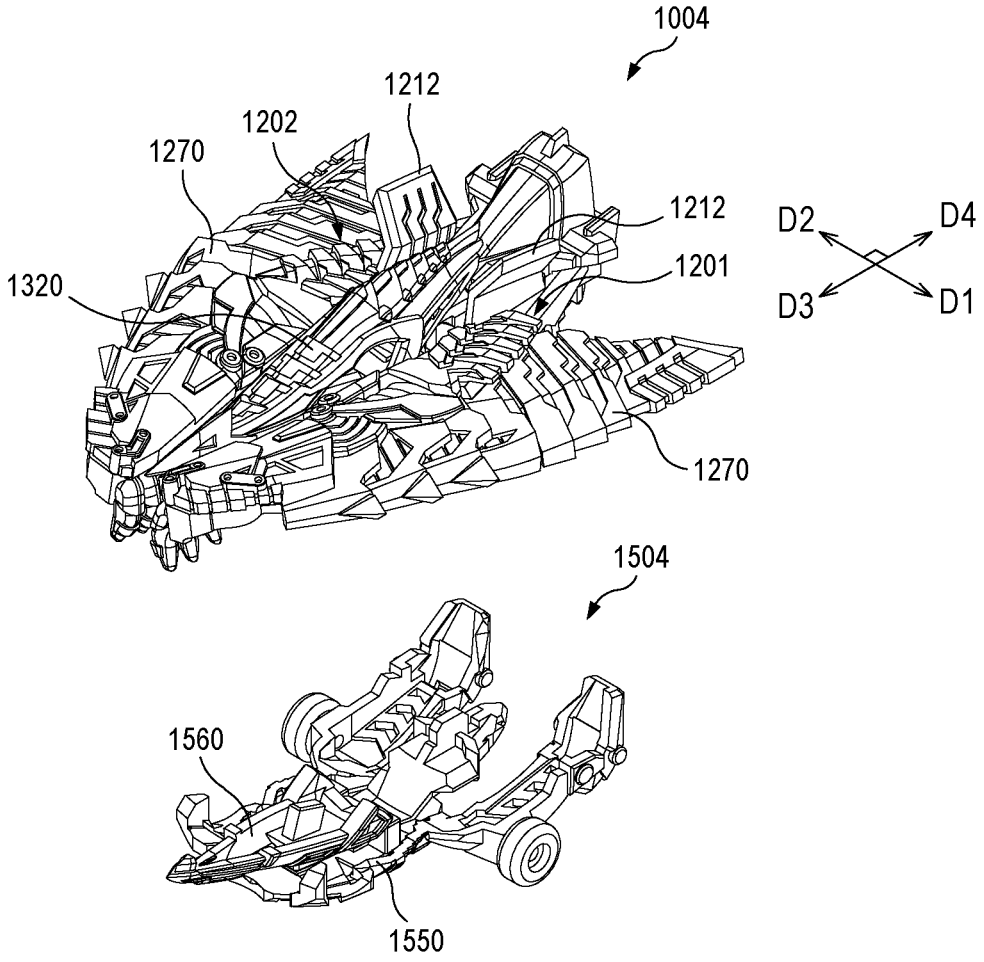
FIG. 64 is a perspective view of the transformable toy shown in FIG. 63.

Referring to FIGS. 63 and 64, in the first state of the transformable body 1004, if an external force is applied to the manipulation portions 1212 in a direction in which the manipulation portions 1212 are moved toward each other (i.e., if the user performs a motion of pinching the manipulation portions 1212), the left and right transformation portions 1201 and 1202 are rotated in different directions to the insertion position and are moved away from each other. Further, the accessory body 1504 is removed from the left and right transformation portions 1201 and 1202 which are moved away from each other. Further, in the accessory body 1504, the second accessory covering portion 1560 is detached from the first accessory covering portion 1550. The accessory body 1504 removed from the left and right transformation portions 1201 and 1202 are kept in waiting to cover the abdomen portion of the torso portion of the model toy and the lower portion of the head extension portion of the model toy.

Figure 65:
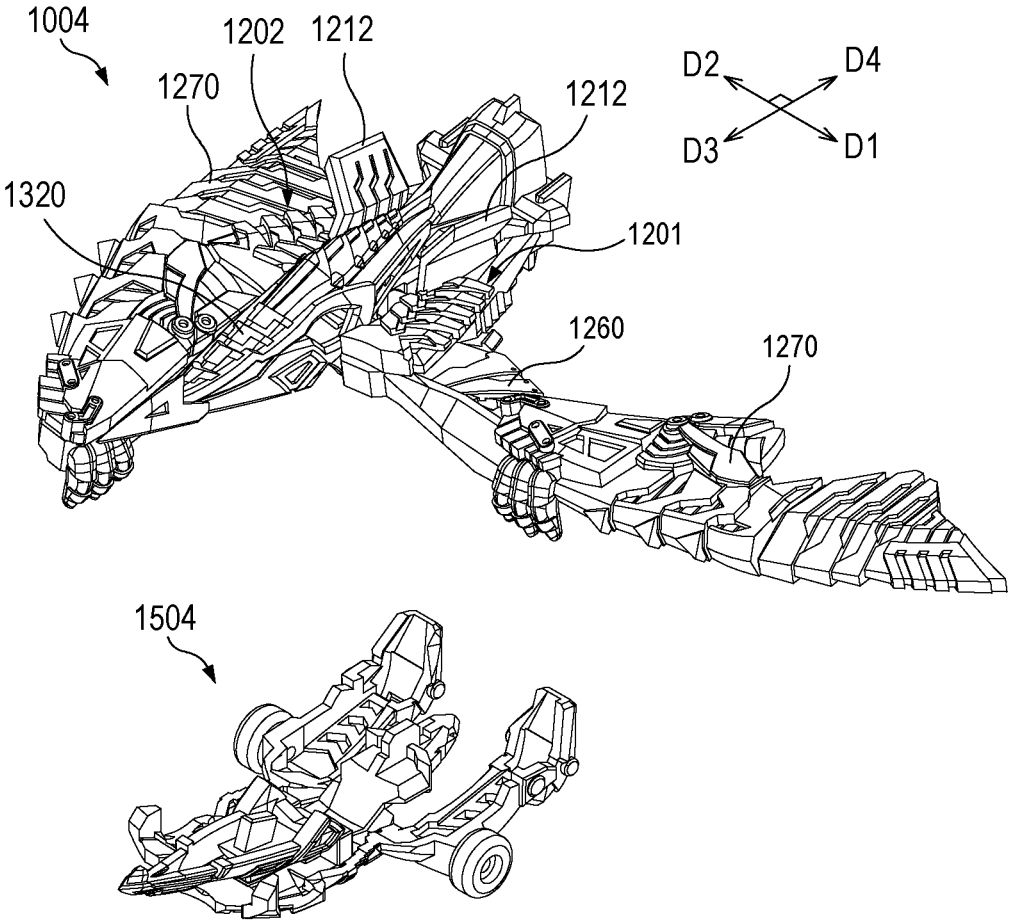
FIG. 65 is a perspective view showing a second example where the transformable body of the transformable toy according to the fourth embodiment is transformed.
Figure 66:
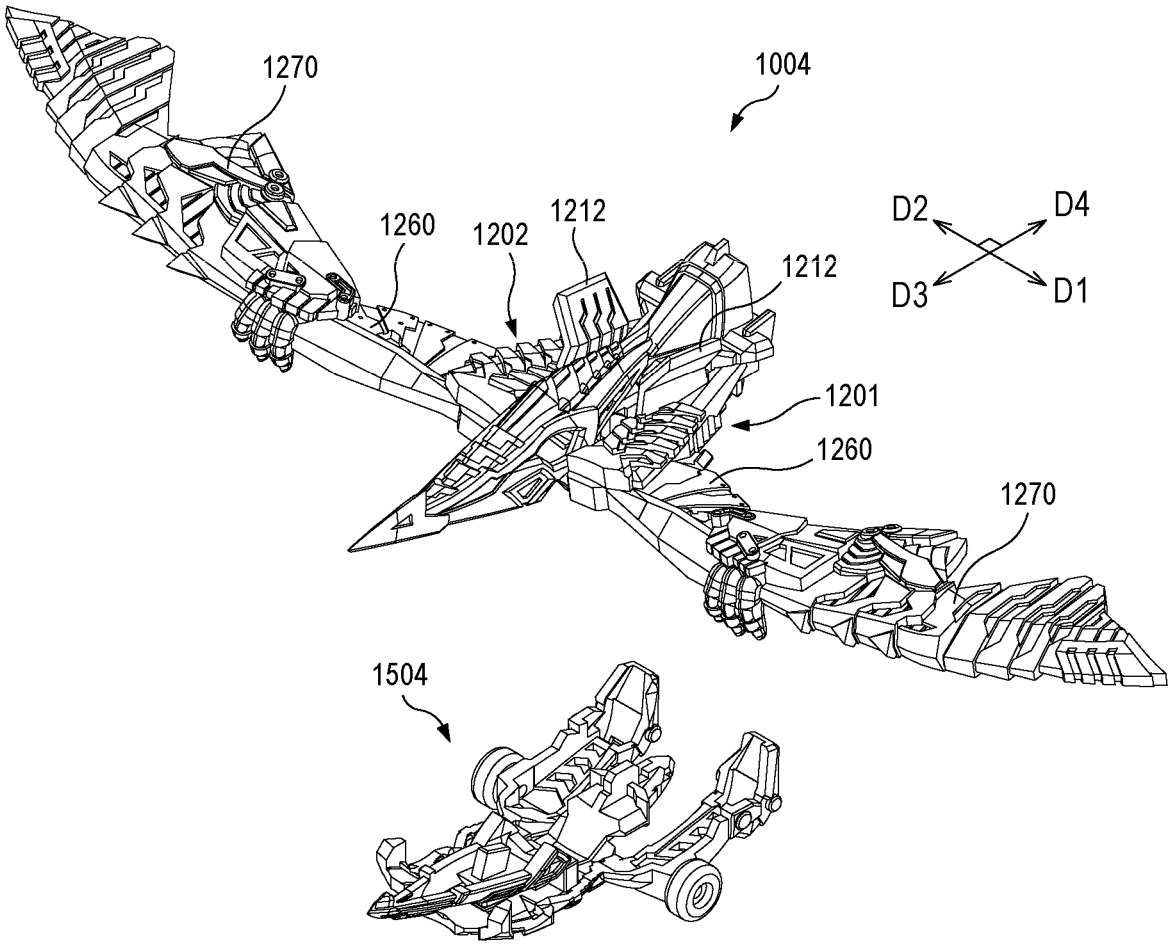
FIG. 66 is a perspective view showing a third example where the transformable body of the transformable toy according to the fourth embodiment is transformed.

Next, referring to FIGS. 65 and 66, the first rotation portion 1260 and the second rotation portion 1270 of one of the transformation portions are sequentially rotated to the unfolded position, and the first rotation portion 1260 and the second rotation portion 1270 of the other of the transformation portions are sequentially rotated to the unfolded position.

Figure 67:
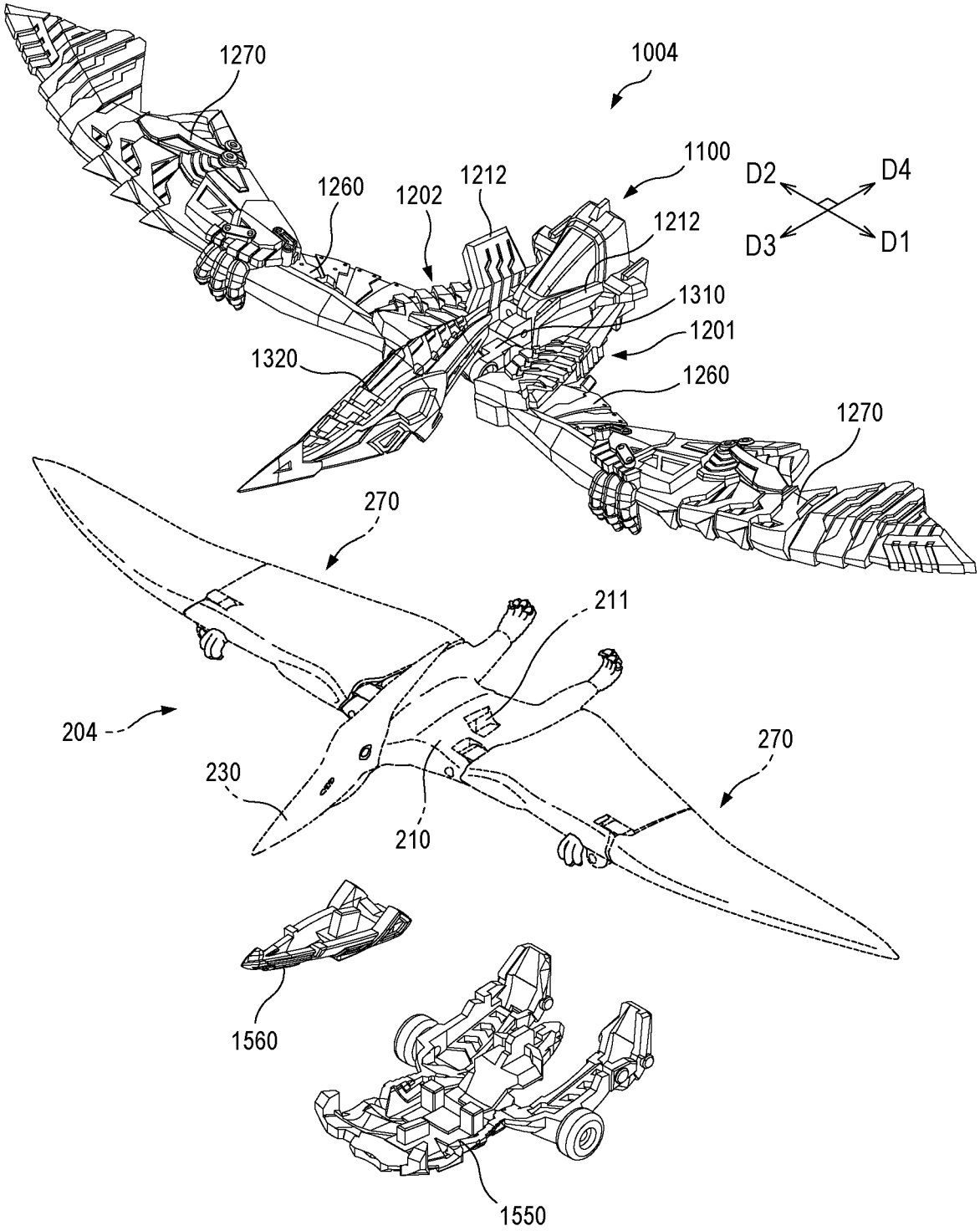
FIG. 67 is a perspective view showing that the transformable body and the accessory body of the transformable toy shown in FIG. 50 are arranged to be coupled to the model toy.
Figure 68:
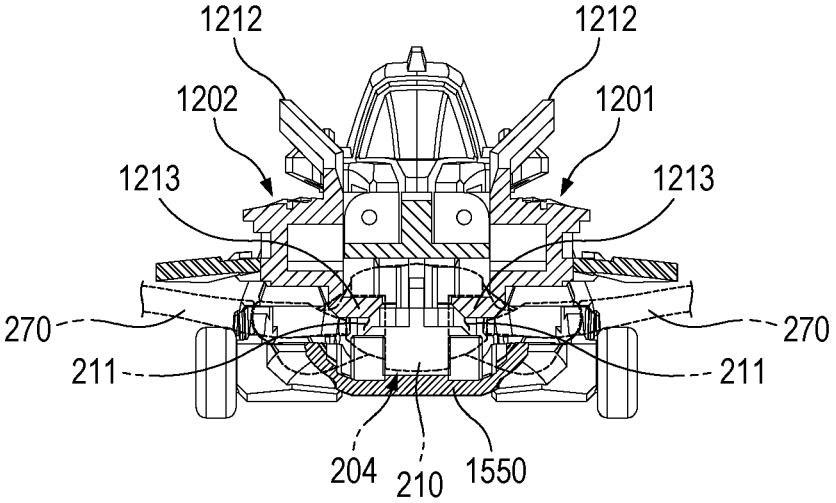
FIG. 68 is a partial cross-sectional view of the combination of the transformable toy and the model toy according to the fourth embodiment.

Next, referring to FIGS. 67 and 68, in the state where the first and second rotation portions 1260 and 1270 are unfolded to the unfolded position and the left and right transformation portions 1201 and 1202 are moved away from each other, the torso portion 210 of the model toy 204 is inserted between the left and right transformation portions 1201 and 1202 (i.e., between the engaging portions moved away from each other). At this time, the first rotation portion 1260 and the second rotation portion 1270, which are unfolded to the unfolded position, cover the wing extension portions 270 of the model toy 204. If the user releases the manipulation portions 1212, the left and right transformation portions 1201 and 1202 are rotated to the cover position by the biasing force of the torsion springs so as to be moved toward each other. Therefore, the transformable body 1004 can be temporarily fixed to the model toy 204. If the engaging portions 1213 of the left and right transformation portions 1201 and 1202 are engaged with the counter engaging portions 211 of the model toy 204, respectively, the transformable body 1004 can be releasably coupled to the torso portion 210 by the left and right transformation portions 1201 and 1202. Next, the link portion 1310 is rotated frontward with respect to the frame portion 1100, and the distal end portion 1320 is positioned further frontward than the distal end portion 1320 in the first state of the transformable body 1004 to cover the head extension portion of the model toy 204. If the distal end portion 1320 covers the head extension portion 230, the transformable body 1004 comes into the second state where the transformable body covers the model toy 204 by the frame portion 1100, the left and right transformation portions 1201 and 1202, the first and second rotation portions 1260 and 1270, and the distal end portion 1320 and is releasably coupled to the model toy 204. Thus, the transformable body 1004 can be mounted on the model toy 204. In the state where the transformable body 1004 is mounted on the model toy 204, the first accessory covering portion 1550 is coupled to the torso portion 210 of the model toy 204 from below, and the second accessory covering portion 1560 is coupled to the head extension portion 230 of the model toy 204 from below. Therefore, the transformable toy 104 is releasably coupled to the model toy 204 while covering the model toy 204.

The procedures in which the first accessory covering portion 1550 and the second accessory covering portion 1560 are removed from the model toy 204 and the transformable body 1004 is transformed from the second state to the first state may be reversed from the above-described procedures. If the transformable body 1004 is transformed from the second state to the first state and the transformable body 1004 in the first state and the accessory body 1504 are coupled to each other, the transformable toy 104 including the transformable body 1004 and the accessory body 1504 takes the airplane-shaped form capable of traveling. From the airplane-shaped form of the transformable toy 104, the user can have fun that the transformable toy before being combined with the model toy takes a form different from the model toy and is capable of flying or traveling.

As shown in FIGS. 53, 54 and 67, in the state where the transformable body 1004 in the second state covers the model toy 204 by the frame portion 1100, the left and right transformation portions 1201 and 1202, the first and second rotation portions 1260 and 1270 of the left and right transformation portions 1201 and 1202, and the front transformation portion 1300, and where the accessory body 1504 is coupled to the model toy 204, the user can recognize, from the combination of the model toy 204 and the transformable toy 104, that the model toy 204 is wearing a kind of protector (e.g., an armor and helmet) made by the transformable toy 104. Accordingly, the user can have fun that the transformable toy having the form of an airplane capable of traveling is transformed so as to become an armor and helmet for the model toy and the model toy is wearing the armor and helmet made by the transformable toy.

The transformable toy according to one embodiment can be transformed so as to be releasably coupled to the model toy while covering the model toy, and can be transformed so as to have a separate specific form in the state of being independent from the model toy. Accordingly, the transformable toy according to one embodiment can give differentiated and creative experiences to the user. For example, the user can have fun related to transformation of the transformable toy itself. The user can have fun in mounting the transformed transformable toy on the model toy as an attachment for covering the model toy, and fun that the transformed and attached transformable toy functions as a protector for protecting the model toy. Further, the user can have, from the transformable toy before being combined with the model toy, special fun that the transformable toy has a form different from the model toy.

Further, the transformable toy according to one embodiment can be transformed with a simple structure and a simple manipulation manner so as to cover the model toy or so as to be removed from the model toy.

Further, the transformable toy according to one embodiment can be easily transformed so as to be compactly folded when separated from the model toy and to have a large surface area when coupled to the model toy.

The technical idea of the present disclosure has been described heretofore with reference to some embodiments and examples shown in the accompanying drawings. However, it is to be understood that various substitutions, modifications and alterations may be made without departing from the technical idea and scope of the present disclosure that can be understood by those of ordinary skill in the technical field to which the present disclosure pertains. Further, it is to be understood that such substitutions, modifications and alterations fall within the appended claims.

What is claimed is:

1. A toy set comprising:

a model toy having an appearance corresponding to a shape of a dinosaur; and a transformable toy configured to be releasably coupled to the model toy, wherein the transformable toy comprises a transformable body configured to be transformable into a first state where the transformable body is independent from the model toy and has a form of a transport machine and a second state where the transformable body has a form partially corresponding to the shape of the dinosaur, is transformed into a protector partially covering and protecting the model toy, and is releasably coupled to the model toy, wherein the transformable body includes:

a frame portion configured to cover a back portion of a torso portion of the model toy in the second state;

a first transformation portion coupled to the frame portion so as to be rotatable about a first rotation axis passing through a portion of the frame portion in a first direction and configured to cover a left side surface of the torso portion in the first direction in the second state;

a second transformation portion coupled to the frame portion so as to be rotatable about a second rotation axis passing through a portion of the frame portion in a second direction opposite to the first direction and configured to cover a right side surface of the torso portion in the second direction in the second state; and a third transformation portion coupled to the frame portion so as to be rotatable about an orthogonal rotation axis passing through a portion of the frame portion in a direction orthogonal to the first direction and the second direction and configured to cover a head extension portion or a tail extension portion of the model toy, which extends from the torso portion, in the second state, and wherein the first transformation portion and the second transformation portion are configured to be moved toward each other to accommodate the third transformation portion in the first state, and are configured to be moved toward each other to releasably grip the model toy in the second state.

2. The toy set of claim 1, wherein the first transformation portion and the second transformation portion are configured to be rotated in two different directions with respect to the frame portion for transformation from one of the first state and the second state to the other of the first state and the second state.

3. The toy set of claim 1, wherein the first transformation portion and the second transformation portion are configured to be folded with respect to the frame portion for transformation from the second state to the first state.

4. The toy set of claim 1, wherein the transformable body includes at least one covering transformation portion configured to partially cover a portion of the model toy in the second state.

5. The toy set of claim 1, wherein the first transformation portion and the second transformation portion are configured to be moved and rotated toward each other for transformation from one of the first state and the second state to the other of the first state and the second state.

6. The toy set of claim 1, wherein the third transformation portion includes a front transformation portion coupled to the frame portion so as to be rotatable about a third rotation axis passing through a portion of the frame portion in a third direction orthogonal to the first direction and the second direction.

7. The toy set of claim 6, wherein the front transformation portion is configured to cover the head extension portion that extends in the third direction from the torso portion of the model toy in the second state.

8. The toy set of claim 6, wherein each of the first transformation portion and the second transformation portion includes an engaging portion, which protrudes so as to restrain rotation of the third transformation portion in the first state and is configured to be engaged with a counter engaging portion of the model toy in the second state.

9. The toy set of claim 6, wherein the front transformation portion includes:

a link portion rotatably coupled to the frame portion; and a distal end portion rotatably or detachably coupled to the link portion and having a shape partially corresponding to the head extension portion of the model toy.

10. The toy set of claim 6, wherein the third transformation portion further includes a rear transformation portion coupled to the frame portion so as to be rotatable about a fourth rotation axis passing through a portion of the frame portion in a fourth direction opposite to the third direction.

11. The toy set of claim 1, wherein each of the first transformation portion and the second transformation portion includes:

a support portion in which the first rotation axis and the second rotation axis are disposed; and a rotation portion rotatably coupled to the support portion.

12. The toy set of claim 11, wherein the support portion is configured to cover the torso portion of the model toy in the second state, and wherein the rotation portion is configured to cover a leg extension portion or a wing extension portion of the model toy that extends from the torso portion of the model toy in the second state.

13. The toy set of claim 1, wherein the transformable toy further comprises an accessory body removably coupled to a first position of the transformable body in the first state and releasably coupled to a second position of the transformable body different from the first position or a predetermined position of the model toy in the second state.

* * * * *